US009638188B2

(12) United States Patent
Mathers

(10) Patent No.: US 9,638,188 B2
(45) Date of Patent: May 2, 2017

(54) HYDRAULIC MACHINE WITH VANE RETAINING MECHANISM

(71) Applicant: Norman Ian Mathers, Brisbane (AU)

(72) Inventor: Norman Ian Mathers, Brisbane (AU)

(73) Assignee: Mathers Hydraulics Technologies Pty Ltd, Bridgeman Downs (AU)

( * ) Notice: Subject to any disclaimer, the term of this patent is extended or adjusted under 35 U.S.C. 154(b) by 0 days.

(21) Appl. No.: 14/095,654

(22) Filed: Dec. 3, 2013

(65) Prior Publication Data

US 2014/0328709 A1 Nov. 6, 2014

Related U.S. Application Data

(63) Continuation of application No. 12/466,280, filed on May 14, 2009, now Pat. No. 8,597,002, which is a (Continued)

(30) Foreign Application Priority Data

Jul. 15, 2003 (AU) ..... 2003903625
May 12, 2005 (AU) ..... 2005902406

(51) Int. Cl.
*F04C 14/06* (2006.01)
*F04C 14/02* (2006.01)

(Continued)

(52) U.S. Cl.
CPC ..... *F04C 14/06* (2013.01); *F01C 21/0818* (2013.01); *F01C 21/0863* (2013.01);

(Continued)

(58) Field of Classification Search
CPC F01C 21/0818; F01C 21/0863; F04C 11/001; F04C 14/02

(Continued)

(56) References Cited

U.S. PATENT DOCUMENTS 2,696,790 A 12/1954 Crow
3,035,554 A 5/1962 Selzler (Continued)

FOREIGN PATENT DOCUMENTS

CN 1186173 A 7/1998
CN 101233297 B 9/2010

(Continued)

OTHER PUBLICATIONS

"Chinese Application Serial No. 200680025085.2, Office Action mailed Oct. 17, 2008", (w/ English Translation), 10 pgs.

(Continued)

*Primary Examiner* — Mary A Davis

(74) *Attorney, Agent, or Firm* — Schwegman Lundberg & Woessner, P.A.

(57) ABSTRACT

A hydraulic pump or motor includes a body having a chamber and a rotor rotatably mounted within the chamber. The chamber and rotor are shaped to define one or more rise regions, fall regions, major dwell regions and minor dwell regions between walls of the chamber and the rotor. The rotor has a plurality of slots and vanes located in each slot. Each vane is movable between a retracted position and an extended position. In the retracted position, the vanes are unable to work the hydraulic fluid introduced into the chamber whereas they are able to work the hydraulic fluid introduced into the chamber in the extended position. A vane retaining member that is selectively actuable enables the vanes to be retained in the retracted position.

19 Claims, 37 Drawing Sheets

Related U.S. Application Data continuation-in-part of application No. 11/914,203, filed as application No. PCT/AU2006/000623 on May 12, 2006, now Pat. No. 7,955,062, said application No. 12/466,280 is a continuation-in-part of application No. 11/331,356, filed on Jan. 13, 2006, now abandoned, and a continuation of application No. PCT/AU2004/000951, filed on Jul. 15, 2004.

(51) Int. Cl.
*F04C 2/344* (2006.01)
*F01C 21/08* (2006.01)
*F04C 11/00* (2006.01)

(52) U.S. Cl.
CPC ..... *F04C 2/3446* (2013.01); *F04C 11/001* (2013.01); *F04C 14/02* (2013.01); *Y10T 29/49316* (2015.01)

(58) Field of Classification Search
USPC ..... 418/16, 23, 24, 26, 268
See application file for complete search history.

(56) References Cited

U.S. PATENT DOCUMENTS

| | | | | | |
|---|---|---|---|---|---|
| 3,042,163 | A * | 7/1962 | Lapsley | F16D 31/06 192/58.91 | |
| 3,208,570 | A * | 9/1965 | Aschauer | F16D 31/06 418/173 | |
| 3,421,413 | A | 1/1969 | Adams et al. | | |
| 3,451,346 | A | 6/1969 | Pettibone et al. | | |
| 3,586,466 | A | 6/1971 | Erickson | | |
| 4,132,512 | A | 1/1979 | Roberts et al. | | |
| 4,260,343 | A | 4/1981 | Watanabe et al. | | |
| 4,412,789 | A * | 11/1983 | Ohe | F04C 14/02 417/288 | |
| 4,472,119 | A * | 9/1984 | Roberts | 418/23 | |
| 4,516,919 | A * | 5/1985 | Roberts | 418/23 | |
| 5,170,636 | A * | 12/1992 | Hitosugi | F04C 23/001 236/1 EA | |
| 5,509,793 | A | 4/1996 | Cherry | | |
| 6,015,278 | A | 1/2000 | Key et al. | | |
| 6,634,865 | B2 | 10/2003 | Dalton | | |
| 7,070,399 | B2 | 7/2006 | Konishi et al. | | |
| 7,094,044 | B2 | 8/2006 | Strueh | | |
| 7,955,062 | B2 * | 6/2011 | Mathers | 418/23 | |
| 8,597,002 | B2 * | 12/2013 | Mathers | 418/23 | |
| 2006/0133946 | A1 | 6/2006 | Mathers | | |
| 2008/0310988 | A1 | 12/2008 | Mathers | | |
| 2009/0280021 | A1 * | 11/2009 | Mathers | 418/184 | |

FOREIGN PATENT DOCUMENTS

| | | | |
|---|---|---|---|
| DE | 1728268 | A1 | 3/1972 |
| GB | 2015084 | A | 9/1979 |
| GB | 2042642 | A | 9/1980 |
| GB | 2176537 | A | 12/1986 |
| WO | WO-95/08047 | A1 | 3/1995 |
| WO | WO-2004/000951 | A1 | 12/2003 |

OTHER PUBLICATIONS

"Chinese Application Serial No. 200680025085.2, Response filed May 4, 2009 to Office Action mailed Oct. 17, 2008", 9 pgs.
"European Application Serial No. 04761081, Supplementary Partial European Search Report mailed Mar. 31, 2011", 2 pgs.
"European Application Serial No. 04761081.1, Office Action mailed Apr. 11, 2012", 7 pgs.
"European Application Serial No. 04761081.1, Response filed Feb. 4, 2013 to Office Action mailed Apr. 11, 2012", 12 pgs.
"European Application Serial No. 04761081.1, Supplementary European Search Report mailed Apr. 14, 2011", 3 pgs.
"International Application Ser. No. PCT/AU2006/000623, International Preliminary Report for Patentability dated Nov. 13, 2007", 6 pgs.
"International Application Ser. No. PCT/AU2006/000623, International Search Report mailed Sep. 4, 2006", 4 pgs.
"International Application Ser. No. PCT/AU2006/000623, Written Opinion mailed Sep. 4, 2006", 5 pgs.
"Germany Application Serial No. 112006001186.3, Office Action mailed Nov. 20, 2015", w/ English Translation, 11 pgs.
"Indian Application Serial No. 4640/KOLNP/2007, First Examiner Report mailed Jul. 15, 2016", 8 pgs.

* cited by examiner

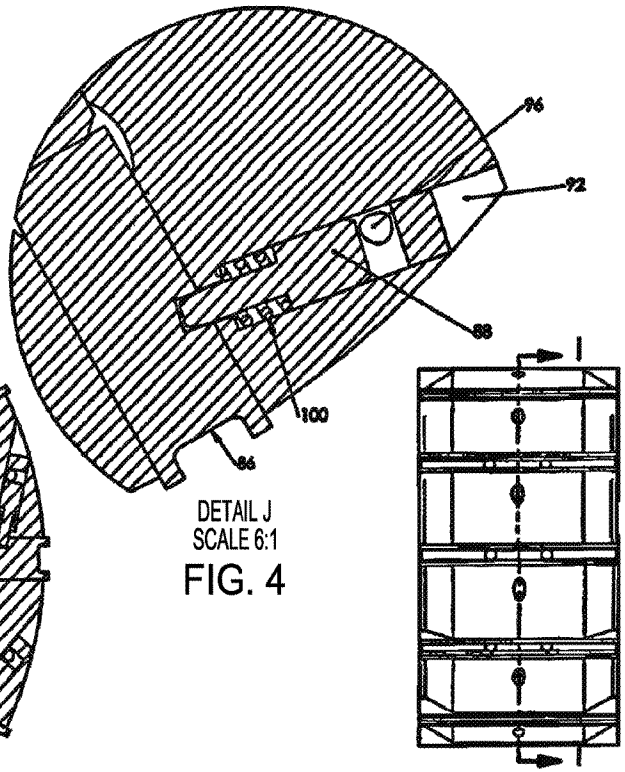
SIDE VIEW
FIG. 3a
DETAIL J
SCALE 6:1
FIG. 4
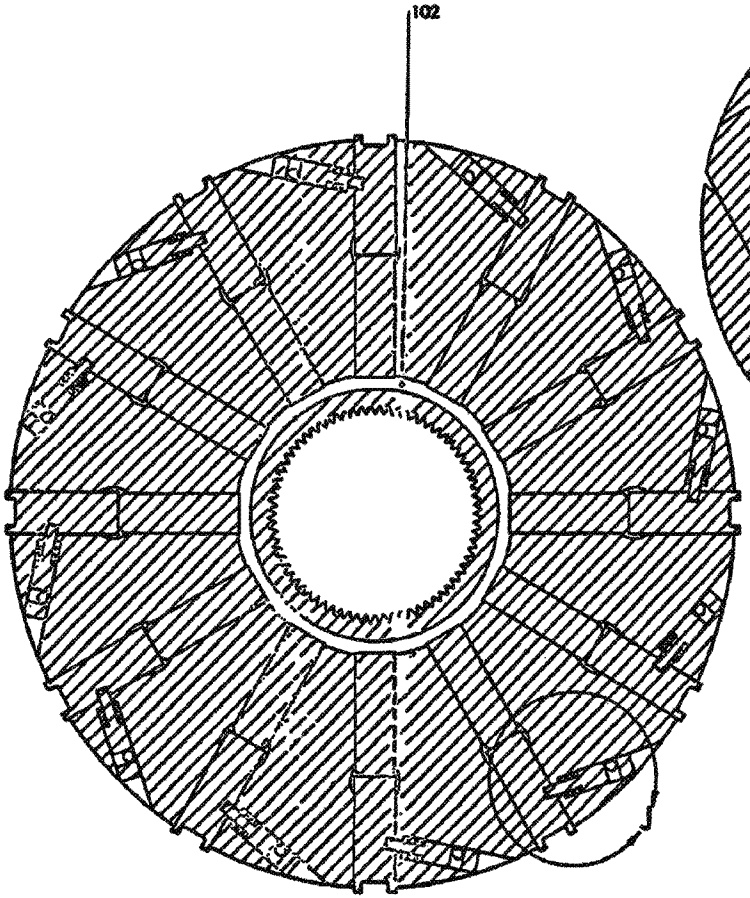
SECTION H
SCALE 2:1
FIG. 3

FRONT VIEW

SECTION H-H
SCALE 2 : 1

FRONT VIEW

SECTION E-E
SCALE 2 : 1

SIDE VIEW

DETAIL G
SCALE 5 : 1

SECTION F-F
SCALE 5 : 1

SECTION E-E AND SECTION F-F
3D REPRESENTATION

SECTION A-A
SCALE 4 : 1

SECTION D-D

SECTION K - K
SCALE 3 : 1

SECTION J - J
SCALE 3 : 1

SECTION J - J
SCALE 3 : 1

DETAIL L
SCALE 8 : 1

HYDRAULIC MACHINE WITH VANE RETAINING MECHANISM

CROSS-REFERENCE TO RELATED APPLICATIONS

This application is a continuation of application Ser. No. 12/466,280 filed May 14, 2009, which is (a) a continuation-in-part of application Ser. No. 11/914,203 filed Jul. 1, 2008, which is a 371 filing of International Patent Application PCT/AU2006/000623 filed May 12, 2006, and (b) a continuation-in-part of application Ser. No. 11/331,356 filed Jan. 13, 2006, which is a continuation of International Patent Application PCT/AU2004/000951 filed Jul. 15, 2004. The entire content of each earlier filed application is expressly incorporated herein by reference.

FIELD OF THE INVENTION

This invention relates to a hydraulic machine. In particular, the invention relates to a hydraulic machine that may be used as a rotary vane pump or a rotary vane motor.

BACKGROUND OF THE INVENTION

Hydraulic vane pumps are used to pump hydraulic fluid in many different types of machines for different purposes. Such machines include, for instance, earth moving, industrial and agricultural machines, waste collection vehicles, fishing trawlers, cranes, and vehicle power steering systems.

Hydraulic vane pumps typically have a housing with a chamber formed therein. A rotor is rotatably mounted in the housing. The rotor is typically of generally cylindrical shape and the chamber has a shape such that one or more rise and fall regions are formed between the walls of the rotor and the walls of the chamber. In the rise regions, a relatively large space opens between the outer wall of the rotor and the inner wall of the chamber. On the leading side of the rise region, there exists a region which is substantially a dwell, although in usual practice there exists a small amount of fall. This is sometimes called a major dwell or major dwell region. The major dwell is followed by a fall region, in which the space between the rotor and the chamber decreases. Outside of the rise, fall and major dwell regions, the space between the outer wall of the rotor and the inner wall of the chamber is small. In practice, this is usually a true dwell of zero vane extension and is sometimes called the minor dwell. The rotor normally has a number of slots and movable vanes are mounted in the slots. As the rotor rotates, centrifugal forces cause the vanes to move to an extended position as they pass through the rise regions. As the vanes travel along the fall regions, the vanes are forced to move to a retracted position by virtue of the rotors contacting the inner wall of the chamber as they move into the region of restricted clearance between the rotor and chamber. Hydraulic fluid lubricates the vanes and the inner wall of the chamber.

Hydraulic vane pumps are usually coupled to a drive, such as to a rotating output shaft of a motor or an engine and, in the absence of expensive space invasive clutches or other disconnecting means, continue to pump hydraulic fluid as long as the motor or engine continues to operate. A rotor of the pump also usually has a rotational speed determined by the rotational speed of the motor or engine.

A problem with known hydraulic vane pumps is that they continuously pump hydraulic fluid, regardless of whether or not a hydraulic system of a machine is being utilised in a working mode of the machine. That is, a machine may be idle or may be in the process of being driven from one job location to another (i.e. in a non-working mode), yet the pump may continue to consume energy in pumping fluid excessively or unnecessarily.

A related problem is that hydraulic hoses, pipes and valves of hydraulic systems of machines such as waste collectors and hydraulic cranes tend to be larger than actually required in order for the machines to carry out lifting in their working mode. That is, lifting may be normally carried out at moderate engine speeds, yet the machines may attain high engine speeds when being driven from one location to another. Consequently, larger and more expensive hydraulic hoses, pipes and valves are required in order to accommodate the higher fluid pressures generated by the pump at high engine speeds.

A problem with some known hydraulic vane motors is that, like with hydraulic vane pumps, in the absence of expensive space invasive clutches or other disconnecting means, hydraulic vane motors may also be worked by the hydraulic fluid incessantly and excessively.

U.S. Pat. No 3,421,413 to Adams et al describes a sliding vane pump in which hydraulic pressure is applied to each vane in order to maintain the vanes in optimum engagement with a cam surface that encircles the rotor which carries the vanes. This patent is directed towards ensuring that the vanes remain in optimum contact with the encircling cam.

U.S. Pat. No. 3,586,466 to Erickson describes a rotary hydraulic motor having a slotted rotor and a movable vane located in each slot. The rotor is journalled in a chamber that defines three circumferentially spaced crescent-shaped pressure chamber sections. The hydraulic motor includes a valve control means and associated passages to be able to selectively control the flow of pressurised fluid to the pressure chamber sections. This allows pressurised fluid to be supplied to one, two or all three pressure chamber sections. When pressurised fluid is delivered to all three pressure chamber sections, low speed, high torque operation occurs. When pressurised fluid is delivered to two pressure chamber sections, higher speed but lower torque operation occurs. When pressurised fluid is delivered to only one pressure chamber section, even higher speed but lower torque operation of the motor occurs.

The hydraulic motor of Erickson also includes an arrangement of passages that allow pressurised fluid to impart radially outward movement to the vanes adjacent the inlet passages to the pressurized chamber sections and to impart radially inward movement to the vanes adjacent the outlet passages of the pressurized chamber sections. Thus, each vane is fluid pressure urged radially outwardly into sealing engagement with the concavity or concave surface of each pressurized chamber section during initial movement of the vane circumferentially across the pressurize chamber section, the vane being moved radially inwardly by fluid pressure at the circumferentially opposite end of the pressurized chamber section, to reduce the frictional load between each vane and the inner peripheral surface portions of the chamber at areas wherein there is little or no circumferential pressure applied to the vanes (see column 4, lines 55 to 72).

The entire contents of U.S. Pat. Nos. 3,421,413 and 3,586,466 are expressly incorporated herein by cross reference.

SUMMARY OF THE INVENTION

It is therefore an object of the present invention to provide a hydraulic machine that overcomes or minimises at least one of the problems referred to above, or to provide the public with a useful or commercial choice.

According to a first aspect, the present invention provides a hydraulic machine having:

a body having a chamber, an inlet for introducing hydraulic fluid into the chamber, an outlet through which hydraulic fluid leaves the chamber, a rotor rotatable within the chamber, the chamber and the rotor being shaped to define one or more rise, fall and dwell regions between walls of the chamber and the rotor, a shaft extending from the rotor, the rotor having a plurality of slots, a plurality of vanes located such that each slot of the rotor has a vane located therein, each vane being movable between a retracted position and an extended position wherein in the retracted position, the vane is unable to work the hydraulic fluid introduced into the chamber and in the extended position the vane is able to work the hydraulic fluid introduced into the chamber, and vane retaining means being selectively actuable such that, when activated, the vane retaining means retains the vanes in the retracted position.

Preferably, the hydraulic machine further comprises an under vane passage for selectively receiving pressurised hydraulic fluid to facilitate moving the vanes located in a dwell region from the retracted position to the extended position. Although the vanes of a hydraulic pump are likely to automatically move from the retracted position to the extended position as they enter a rise region after inactivation of the vane retaining means, use of an under vane passage to supply pressurised hydraulic fluid to under the vanes will assist in this movement and also minimise the likelihood of a vane sticking in the retracted position. For hydraulic motors, inclusion of under vane passages can be used to actively drive the vanes to the extended position. Conventional hydraulic motors use springs to drive the vanes to the extended position. The under vane passages can either complement or replace such springs.

The under vane passage may also function to allow hydraulic fluid located under the vanes to drain away from under the vanes as the vanes move from the extended position to the retracted position.

In some instances, the vanes may have a vane pin located underneath each vane. The vane pins typically can move in a vane pin duct. In such embodiments, the under vane passage may include a passage located under the vane pin.

Preferably, the vane retaining means can be selectively actuated to retain all of the vanes in the retracted position. Preferably, the vane retaining means can retain the vanes in the retracted position for at least an entire revolution of the rotor.

The inlet may be branched and may have one or more openings into the chamber, adjacent a start of each rise region. An end of the inlet at a periphery of the body may be attached to a hydraulic line.

The outlet may be branched and may have one or more openings from the chamber, adjacent an end of each fall region. An end of the outlet at a periphery of the body may be attachable to a hydraulic line.

The under vane passages may extend from under each of the vanes to the outlet and the under vane passages may be pressurised with hydraulic fluid from the outlet. Alternatively, the under vane passages may be pressurised with pressurised hydraulic fluid from a pilot source of pressurised hydraulic fluid.

The under vane passage may also communicate with the inlet such that when the vane retaining means is actuated, hydraulic fluid drained from under the vanes is directed to the inlet, to allow the vanes to be retained in the retracted position. In other embodiments, the outlet chamber may be vented when the vanes are retracted (as the vanes are no longer working the hydraulic fluid) to enable under vane fluid to be vented to the outlet. In this embodiment, the under vane passages are indirectly placed into communication with the inlet because venting the outlet chamber to the inlet chamber also effectively vents the under vane passages to the inlet chamber. In embodiments where the vane pump or motor includes an intravane and an undervane passage, the under vane passage may be connected to the pumping chamber and the intra vane may be connected to the outlet. When the outlet chamber is vented to the inlet chamber, the under vane and intra vane is also vented to the inlet chamber, This may be done just before the vanes are clamped for smooth operation.

A control valve, such as a pressure sensitive spring loaded spool valve, may be located within the under vane passage or in fluid communication with the under vane passages. The control valve may direct hydraulic fluid from the outlet to under the vanes when the vane retaining means is not actuated, and may direct hydraulic fluid from under the vanes to the inlet when the vane retaining means is actuated.

The vane retaining means is selectively actuable to retain the vanes in the retracted position. The vane retaining means suitably utilises pressurised hydraulic fluid to retain the vanes in the retracted position. In one embodiment, the vane retaining means comprises an engagement member movable between a disengaged position and an engaged position in which the engagement member contacts the vane to retain the vane in the retracted position. The engagement member may be an engagement pin or an engagement ball that engages with a side wall of the vane. More preferably, the engagement member is an engagement pin or an engagement ball that engages with a recess in the vane to retain the vane in the retracted position.

In another embodiment, the vanes may be affixed to the rotor by a vane pin, which vane pin moves with the vane as the vane moves between the retracted and extended positions and the engagement member may be an engagement pin or ball that engages with the vane pin to thereby retain the vane in the retracted position.

The engagement member is suitably moved from the disengaged position to the engaged position by pressurised hydraulic fluid. The pressurised hydraulic fluid may be selectively applied to the engaging means when it is desired to retain the vanes in the retracted position.

The engagement member may be provided with a biasing means, such as a return spring, to disengage the engagement member when maintaining the vanes in the retracted position is no longer required. Alternatively, hydraulic pressure may be used to move the engagement member to a disengaged position. As a further alternative, the engagement member may be arranged such that centrifugal forces cause the engagement member to move to the disengaged position when the engagement member is inactivated.

In another embodiment, the vane retaining mean comprises a vane retaining passage for receiving pressurised hydraulic fluid, the vane retaining passage directing the pressurised hydraulic fluid to at least one face of the vane such that the pressurised hydraulic fluid forces (i.e. clamps) the vane against at least one face of the respective slot. For instance, a respective groove extending longitudinally along a radially extending face of each vane may provide a section of the vane retaining passage, a respective groove extending along a radially extending face of each slot may provide a section of the vane retaining passage, or the vane retaining passage may extend through the rotor and direct hydraulic fluid onto a radially extending face of each vane. The vane retaining passage may extend from each of the vanes to a port at a periphery of the body. The port may be attached to a hydraulic line.

Preferably, concentric annular sections of the vane retaining passage and under vane passage communicate hydraulic fluid to each of the vanes.

In one mode of operation, the hydraulic machine may function as a pump. In another mode of operation the hydraulic machine may function as a motor. When operated as a pump, the drive shaft may be coupled to an output shaft of an engine or motor. The slotted rotor may be splined to fit the drive shaft. When operated as a motor, the drive shaft may be coupled to another hydraulic machine such as a pump.

The machine may have any suitable number of vanes and preferably the machine has 10 or 12 vanes. The vanes may be of any suitable shape and size. Each vane may have an enlarged base, each slot may have an enlarged portion within which the base may move when the vane is extending or retracting, and each slot may have a restriction through which the base may not move when the vane is extending.

The machine may have a safety pressure relief valve, a solenoid valve (mechanically, piloted or electrically actuated) for selecting whether the pump vanes are to be retained in the retracted position or not, and a pressure responsive shuttle valve.

The machine may have features of known hydraulic vane pumps or motors, such as the Vickers® V10 or V20 or VMQ series of rotary vane pumps. For instance, the body may have ball bearings and bushings for supporting opposing ends of the drive shaft and to centre the slotted rotor within the chamber. The body may comprise two or more attachable pieces. An O-ring may be used to provide a fluid tight seal when connecting the body pieces together.

Any suitable type of hydraulic fluid may be used. Pilot values of three to four liters per minute and 10 to 15 bar pressure may be suitable for pressurising the vane retaining passage, to clamp the vanes and to activate the control valve such that hydraulic fluid from under the vanes is directed to the inlet.

According to a second aspect of the present invention, there is provided a method for retaining vanes of a hydraulic vane pump or motor in a retracted position within a slotted rotor of the pump or motor, the pump or motor including a chamber and a rotor mounted for rotation within the chamber, the chamber and the rotor being shaped to define one or more rise, fall and dwell regions between walls of the chamber and the rotor, the rotor having a plurality of slots and a plurality of vanes located such that each slot of the rotor has a vane located therein, each vane being movable between a retracted position and an extended position wherein in the retracted position, the vane is unable to work the hydraulic fluid introduced into the chamber and in the extended position the vane is able to work the hydraulic fluid introduced into the chamber wherein the method includes the steps of:

operating the pump or motor such that the vanes move to the extended position when passing through the rise regions and the vanes move towards or into the retracted position when passing along the fall regions and selectively actuating vane retaining means to retain the vanes in the retracted position.

Suitably, the vanes are retained in the retracted position by the vane retaining means for at least an entire revolution of the rotor.

Preferably, the method further includes the step of draining hydraulic fluid from under the vanes as the vanes move towards the retracted position. In some instances, the vanes may be provided with vane pins positioned under the vanes and the step of draining hydraulic fluid from under the vanes includes draining hydraulic fluid from under the vane pins.

The method may further include releasing the retaining means to allow the vanes to move to the extended position as the vanes enter the rise regions.

Most suitably, the method comprises applying hydraulic fluid pressure to activate the vane retaining means to retain each of the vanes in the retracted position.

In a third aspect, the present invention provides a hydraulic machine comprising a body having a chamber, a rotor rotatable within the chamber, the chamber and the rotor being shaped to define one or more rise, fall and dwell regions between the walls of the chamber and the rotor, the rotor having a plurality of slots, a plurality of vanes located such that each slot of the rotor has a vane located therein, each vane being moveable between a retracted position and an extended position wherein in the retracted position the vane is unable to work the hydraulic fluid introduced into the chamber and in the extended position the vane is able to work the hydraulic fluid introduced into the chamber, an inlet for introducing hydraulic fluid into the chamber, an outlet through which hydraulic fluid leaves the chamber, and vane retaining means being selectively actuable to retain the vanes in the retracted position and selectively actuable to release the vanes and allow the vanes to move from the retracted position to the extended position, wherein the vane retaining means comprises moveable engagement means to move between a retaining position and a non-retaining position, and moveable actuating means moveable between a first position and a second position wherein the moveable engagement means are forced to move from a non-retaining position to a retaining position by movement of the moveable actuation means between the first position and the second position.

The moveable actuation means may be of any suitable size, shape and construction. Suitably, each moveable actuation means comprises a spool having a region of relatively large cross sectional area and a region of relatively small cross sectional area with the regions of relatively large cross sectional area and relatively small cross sectional area being connected by a ramped or sloping portion. The moveable engagement means can move to the non-retaining position when the relatively small cross sectional region of the moveable actuation means contacts the moveable engagement means. The moveable engagement means is forced to move to the retaining position when the relatively larger cross sectional area region contacts the moveable engagement means.

Preferably, pressurised hydraulic fluid (oil) is used to move the moveable actuation means in at least one direction. Preferably, a spring causes the moveable actuation means to move in the opposite direction once pressurised hydraulic fluid has been removed from the moveable actuation means. Suitably, the moveable actuation means moves between the first position (in which the vanes are not retained) and the second position (in which the vanes are retained) by virtue of applied pressurised hydraulic fluid.

The spool suitably has a region of relatively smaller diameter and a region of relatively larger diameter, with the two regions being connected by a generally frustoconical region having sloped or ramped side walls.

The moveable engagement means may be of any suitable size, shape and construction. Each moveable engagement means may comprise, for instance, at least one ball, pin, plate or other type of retaining member which detents into a hole formed in a side of the vane. The moveable engagement means suitably comprises two small balls, more suitably one small ball, which detent into a hole formed in a side of the vane.

In another aspect, the present invention provides a hydraulic machine comprising a body having a chamber, an inlet for introducing hydraulic fluid into the chamber, an outlet through which hydraulic fluid leaves the chamber, a rotor rotatably mounted within the chamber, the chamber and the rotor being shaped to define one or more rise regions, fall regions and dwell regions between walls of the chamber and the rotor, a shaft extending from the rotor, the rotor having a plurality of slots, a plurality of vanes located such that each slot of the rotor has a vane located therein, each vane being movable between a retracted position and an extended position wherein in the retracted position, the vane not working the hydraulic fluid introduced into the chamber and in the extended position the vane working the hydraulic fluid introduced into the chamber, vane retaining means being selectively actuable such that, when actuated, the vane retaining means retains the vanes in the retracted position, said vane retaining means being arranged such that pressurised hydraulic fluid actuates the vane retaining means to retain the vanes in the retracted position or pressurised hydraulic fluid deactivates the vane retaining means such that the vanes move from the retracted position to the extended position, and under vane passages for draining fluid from under the vanes when the vanes move from the extended position to the retracted position, wherein the rotor comprises a first rotor part joined to a second rotor part, one or both of the first rotor part and the second rotor part defining fluid flow passages for providing pressurised hydraulic fluid to the vane retaining means, one or both of the first rotor part and the second rotor part defining vane retaining means movement passages, said vane retaining means being located in said vane retaining means movement passages wherein said vane retaining means move in said vane means movement passages between a retaining position and a non-retaining position.

In yet a further aspect, the present invention provides method for manufacturing a rotor for use in the hydraulic machine as described herein, the method comprising providing a first rotor part and a second rotor part, machining fluid flow passages for providing pressurised hydraulic fluid to the vane retaining means or to the under vane region or to the intra vane region in one or both of the first rotor part and the second rotor part, machining faint retaining means movement passages in one or both of said first rotor part and said second rotor part, positioning vane retaining means in the vane retaining means movement passages, and joining the first rotor part to the second rotor part to thereby form the rotor.

In some embodiments, the fluid flow passages for providing pressurised hydraulic fluid are machined in one of the first rotor part the second rotor part and the vane retaining means movement passages comprise passages machined in the first rotor part and the second rotor part. In some embodiments, the method further comprises providing dowel holes in the first rotor part and the second rotor part, inserting dowels in the dowel holes, dowelling the first rotor part and the second rotor part together and welding or bonding the first rotor part in the second rotor part together.

The vane retaining means may comprise a plurality of spools that move one or more balls into contact with a side wall of the vanes, the spools including a ramped portion and the method may comprise positioning the spools in the vane retaining means movement passages and positioning one or more balls adjacent the ramped portion of the spools, and subsequently joining the first rotor part to the second rotor part.

BRIEF DESCRIPTION OF THE DRAWINGS

Preferred embodiments of the invention will now be described by way of reference to the accompanying drawings in which:

FIG. 3 is a cross-sectional front view of the rotor used in the hydraulic pump of FIG. 2;

FIG. 3*a* is a side view of the rotor shown in FIG. 3. FIG. 3*a* is provided to show the line of section I-I for the cross sectional view shown in FIG. 3;

FIG. 4 is an enlargement of detail J shown in FIG. 3;

FIG. 34 shows positioning of the spool valve when the retaining means are disengaged, respectively.

FIGS. 49 and 50 show the two rotor parts separately;

FIG. 51 shows how the rotor parts can be joined using dowels;

FIG. 52 shows the two rotor parts connected; and

FIG. 53 is an exploded view of the two rotors with the internal components and external oil galleries shown.

DETAILED DESCRIPTION OF THE PREFERRED EMBODIMENTS

Figure 1:
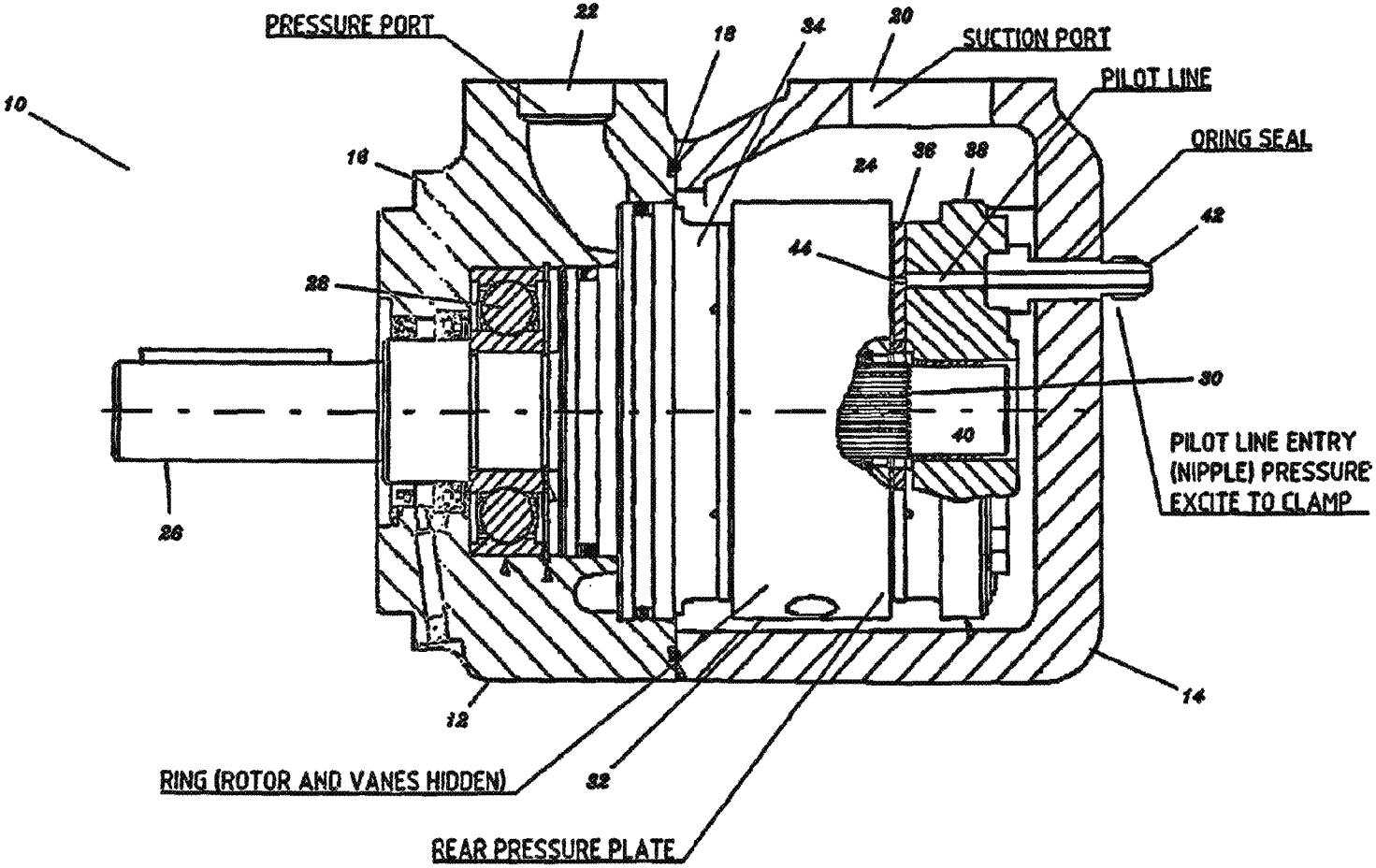
FIG. 1 shows a side view, partly in cross-section, of a hydraulic pump in accordance with an embodiment of the present invention.

In the figures, like reference numerals refer to like features. In moving vane hydraulic machines, normal operation requires venting of under vane fluid. There are numerous such venting arrangements know to the person skilled in the art and the hydraulic machines in accordance with the present invention may incorporate any known under vane venting technologies. Such under vane venting is not part of the inventive concept of the present invention and need not be described in great detail FIG. 1 shows a side view, partly in cross-section, of one embodiment of a hydraulic pump in accordance with the present invention. The pump 10 of FIG. 1 comprises a housing 12 having a first part 14 attached to a second part 16, for example by bolts or the like. An O-ring 18 is positioned between first part 14 and second part 16 of the housing to ensure a fluid tight seal is obtained between the housing parts. The housing 12 includes an inlet 20 for hydraulic fluid (often referred to in this art as a suction port) and an outlet 22 for hydraulic fluid (often referred to in this art as a pressure port).

The housing 12 defines an inlet chamber 24 that receives hydraulic fluid via inlet 20.

A drive shaft 26 is journaled into housing 12 by bearings 28. The drive shaft includes a splined section 30. The splined section of the driveshaft 26 is in fluid communication with the inlet of the hydraulic machine. Thus, the splined section of the driveshaft is a region containing low pressure hydraulic fluid. The splined section 30 of the drive shaft 26 is splined into a complementary spline formed or press fitted into an opening through a rotor (not shown) inside ring 32. Further details of the rotor will be provided with reference to the other drawings attached to this specification. Ring 32 defines a chamber that will be described in more detail in later Figures and a rotor (hidden in FIG. 1) is mounted in the ring 32. Ring 32 is mounted between front cartridge 34 and rear cartridge 38 in a fashion that enables the rotor to rotate within the housing. The pump 10 further includes a rear pressure plate 36 which is attached to rear cartridge 38. Rear cartridge 38 receives the rear end 40 of drive shaft 26. It will be understood that the rotor rotates relative to the rear pressure plate 36 and rear cartridge 38.

The housing 12 includes a pilot line entry 42 in the form of a nipple that allows a pilot line to be connected thereto. The pilot line entry 42 is provided to enable pressurised hydraulic fluid to travel down the pilot line into the housing. The pilot line 42 is in fluid communication with a fluid slot 44 formed in the pressure plate 36. Although FIG. 1 shows slot 44 in the rear pressure plate, the slot could be in a front pressure plate with pilot hydraulic fluid being delivered via the front pressure plate.

Figure 2:
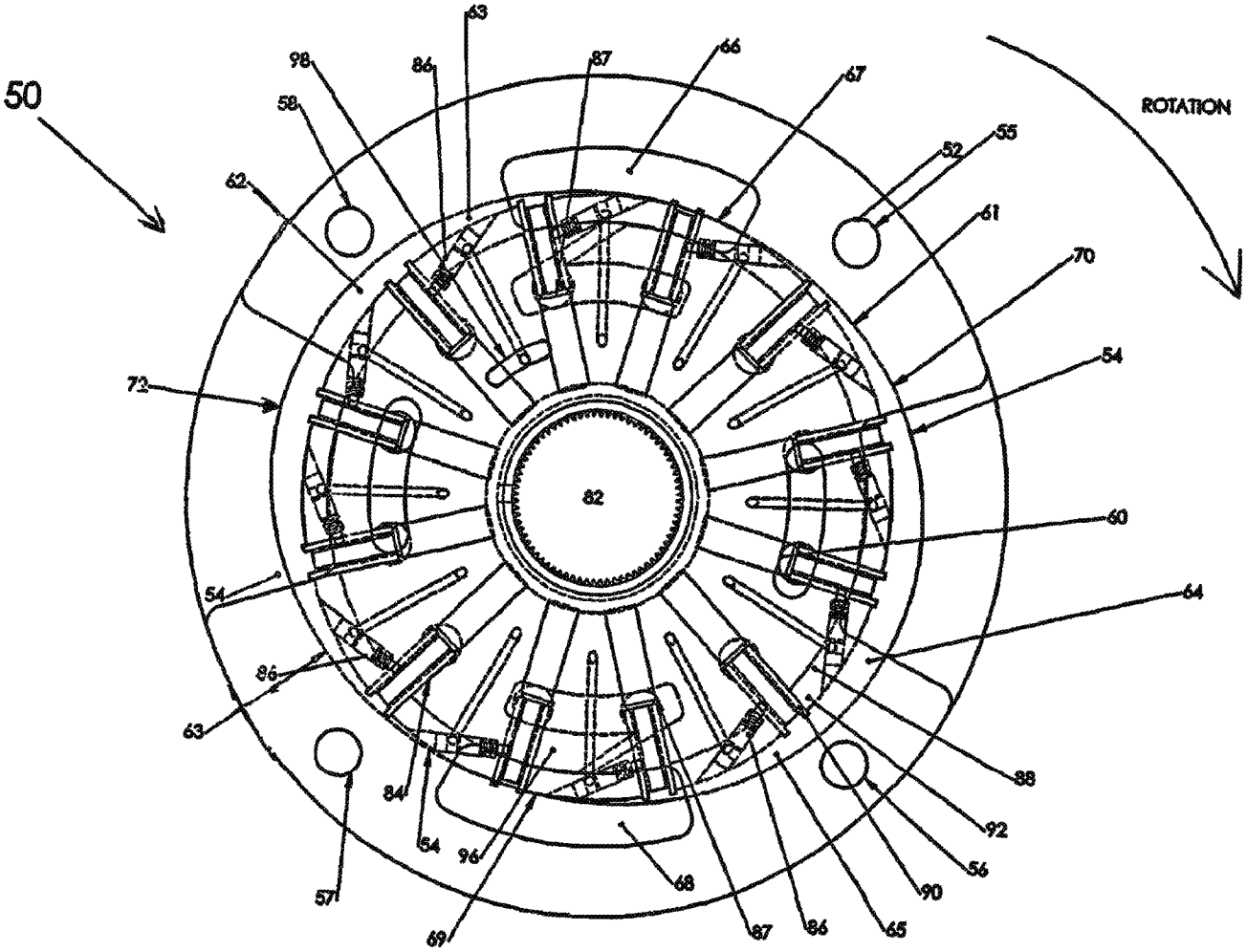
FIG. 2 shows a front view, partly in cross-section, of a hydraulic pump in accordance with an embodiment of the present invention.

FIG. 2 is a detailed front view of part of an hydraulic pump, in particular the ring, rotor, vanes and pressure plate of a hydraulic pump, in accordance with an embodiment of the invention. The front view shown in FIG. 2 is partly in cross section. Some details of the pump shown in FIG. 2 have been deleted for clarity.

The pump 50 shown in FIG. 2 comprises a body 52. The body 52 may be made from two or more parts joined together in a fluid tight manner. The body 52 has a chamber having walls 54. As can be seen from FIG. 2, chamber 54 is an elliptical chamber. The body 52 is also provided with appropriate bolt holes 55, 56, 57, 58 which allow for assembly of the parts of the body.

A rotor 60 is rotatably mounted within the chamber defined by chamber walls 54. Rotor 60 is of generally cylindrical shape. As the rotor 60 is generally cylindrical, and as the chamber defined by chamber walls 54 is generally elliptical, two rise regions 61,63, two major dwell regions 62, 64 and two fall regions 63,65 are formed in the space between the outer walls of the rotor 60 and the chamber walls 54. In the major dwell regions 62, 64, a significant space exists between the outer walls of the rotor 60 and the chamber walls 54. Outside of the major dwell regions 62, 64, the clearance between the wall of the chamber and the rotor 60 is either expanding or decreasing. However, along the minor dwell regions 67, 69, there is only a small clearance between the wall of the rotor 60 and the chamber wall 54. This is well known and is conventional in the sliding vane pump and motor art.

The body 52 includes two hydraulic fluid inlets 70, 72 through which hydraulic fluid passes into entry to the rise regions 61, 63. The body also includes fluid outlets at 66, 68 through which pressurised hydraulic fluid leaves the fall regions of the chamber.

A drive shaft 82 is splined to rotor 60. In this regard, rotor 60 has a central passage passing therethrough. An appropriate spline connection is fitted into the passage passing through the rotor 60, for example by press fitting, or the spline is formed on the passage, to enable the splined drive shaft 82 to be splined to the rotor.

The rotor 60 has a plurality of radially extending slots, some of which are referred to by reference numeral 84. Radial slots 84 each house a vane 86. Respective vane pins 87 are positioned under the vanes 86. In conventional pumps that are generally similar to that shown in FIG. 2 (often referred to as vane pumps) the vanes can move from a retracted position in which the vane is essentially fully located within its respective slot to an extended position in which the vane extends out of its respective slot. As will be appreciated from viewing FIG. 2, as the rotor 60 rotates, typically at speeds well in excess of 1000 rpm, each vane will move into a rise region. As the space between the outer wall of the rotor and the chamber walls increases in the rise region, centrifugal force and any force imparted by pressure acting on the bottom of pin 87 or any pressure acting directly on the bottom of vane 86 forces the vanes to move outwardly along the slot so that contact between the end of the vane and the chamber wall is maintained (it being appreciated that a thin film of hydraulic fluid will be present between the end of the vane and the chamber wall to provide lubrication). As the vane rotates through the fall region, the space between the outer wall of the rotor and the chamber walls starts to decrease. As a result, the vane is pushed back into the rotor. When the vane is along the minor dwell regions 67, 69, contact between the end of the vane and the chamber wall keeps the vane in a retracted position.

When the vane is free to move in its slot, i.e. extend or retract, the vane can work the hydraulic fluid as necessary. If the hydraulic machine is being used as a pump, the collapsing chamber volume associated with the fall regions and the system resistance act to pressurise the hydraulic fluid. If the hydraulic machine is being used as a motor, the hydraulic fluid is pumped through the chamber and the hydraulic fluid interacts with the extended vanes to cause the rotor to rotate.

In conventional hydraulic machines of the general type similar to that shown in FIG. 2, the position of the vanes is controlled only by the relative positioning between the rotor and the chamber. When the vanes are travelling through the rise and fall regions, the vanes are in an extending or collapsing position. When the vanes have passed into the minor dwell region, they are in the retracted position. As a result, the vanes in the rise and fall regions are always working the hydraulic fluid The present inventor has realised that significant efficiency gains can be made if the vanes can be held in the retracted position (or slightly below the minor dwell diameter) throughout the entire rotation of the rotor if working of the hydraulic fluid by the vanes is not required. To this end, the present inventor has proposed that the hydraulic machine be provided with retaining means for selectively retaining the vanes in the retracted position. The retaining means are capable of retaining the vanes in the retracted position even as the vanes pass through the rise regions, the major dwell regions and the fall regions. The retaining means are also selectively actuable. In the embodiment shown in FIG. 2, the retaining means include a number of engagement pins 88 (these may also be referred to as detent pins). Detent pins 88 are mounted in passageways 90 that intersect with the radially extending slots 84 at an angle. Passageways 90 may suitably formed by machining or drilling a passage through the rotor from the outside wall and fitting a plug 92 into passageway 90. Passageway 90 is in fluid communication with a further passageway 96 that opens at an end face of the rotor 60. As shown in FIG. 2, the end of longitudinal passageway 96 comes into register with slot 98 that is connected to a pilot source of a pressurised hydraulic fluid (not shown).

If it is desired to retain the vanes in the retracted position, a signal may be sent to a control valve to pass pressurised fluid through the pilot feed line. When the end of passageway 96 comes into register with slot 98, pressurised fluid enters passageway 96 and travels along passageway 96 and into passage 90. The pressurised hydraulic fluid then pushes the engagement pin 88 into engagement with the side of the vane 86. As best shown in FIGS. 3 and 4, the end of engagement pin 88 extends into a complementarily shaped recess formed in the side of vane 86 to thereby retain the vane 86 in the retracted position. Although FIG. 1 shows a single slot 98 which will excite gallery 96 when the vanes are in one minor dwell region, this slot 98 may be replicated to excite galleries 96 in the other minor dwell region of the pump.

Whilst the pilot line is supplying pressurised hydraulic fluid to the slot 98, the vanes 86 will remain in the retracted position for the entire revolution of the rotor 60.

When supply of the pressurised pilot fluid to the slot 98 is ceased, and preferably the slot 98 is placed in fluid communication with low pressure hydraulic fluid as the ends of passageways 96 come into register with slot 98, the pressurised hydraulic fluid in passageways 96 and 90 is released in those passageways. Consequently, the pressurised fluid no longer acts on engagement pin 88. Return spring 100 (see FIG. 4) then acts to return the engagement pin 88 such that its rear face comes into contact with plug 92. In this position, the engagement pin 88 is no longer in engagement with the vane 86. Consequently, the vane 86 can move (under centrifugal force) to the extended position when the vanes pass through the rise regions. Although a spring 100 is shown in FIG. 4 to return the engagement pin to the non-engaged position, it may be possible to orient the engagement pin such that centrifugal force causes the engagement pin to return without having to provide a return spring.

Figure 5:
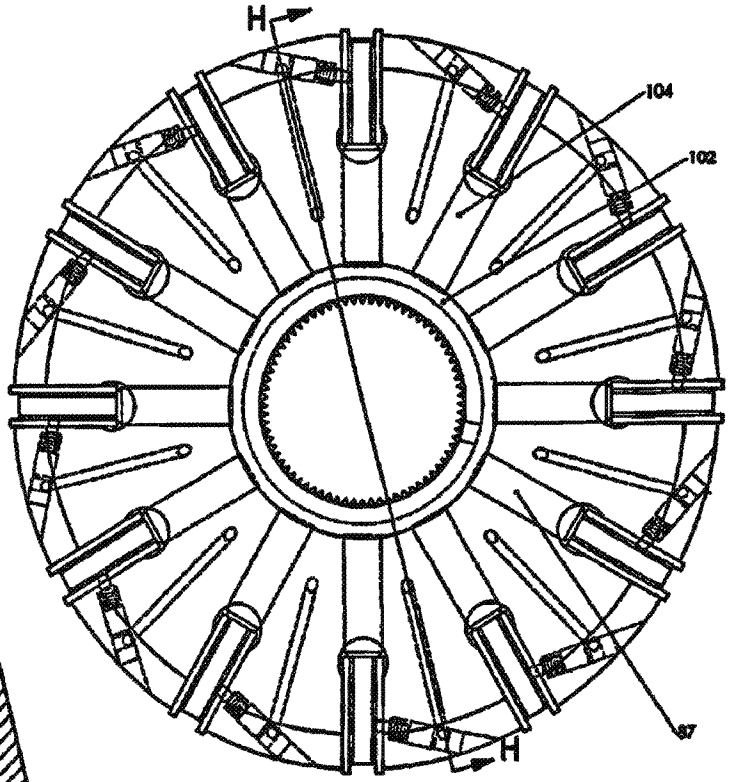
FIG. 5 is a front view of the rotor shown in FIG. 3.
Figure 6:
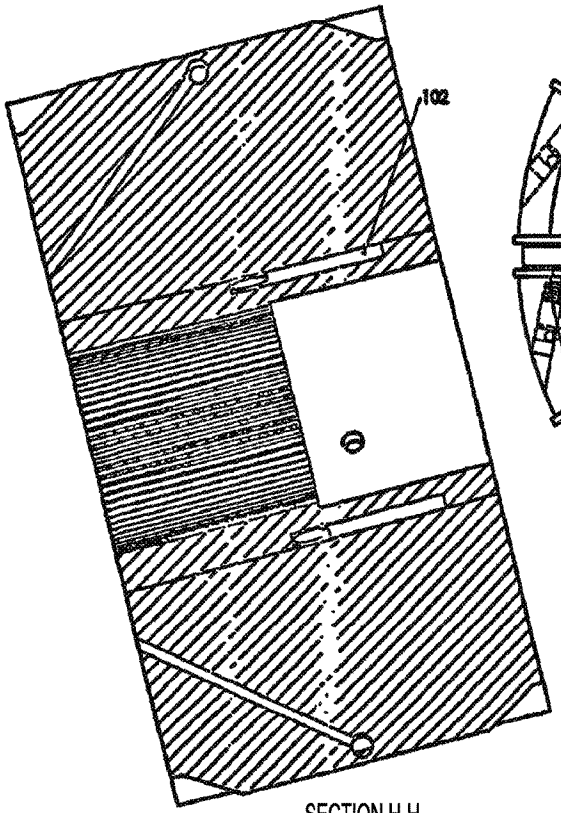
FIG. 6 is a sectional side view taken along line H-H of FIG. 5.
Figure 7:
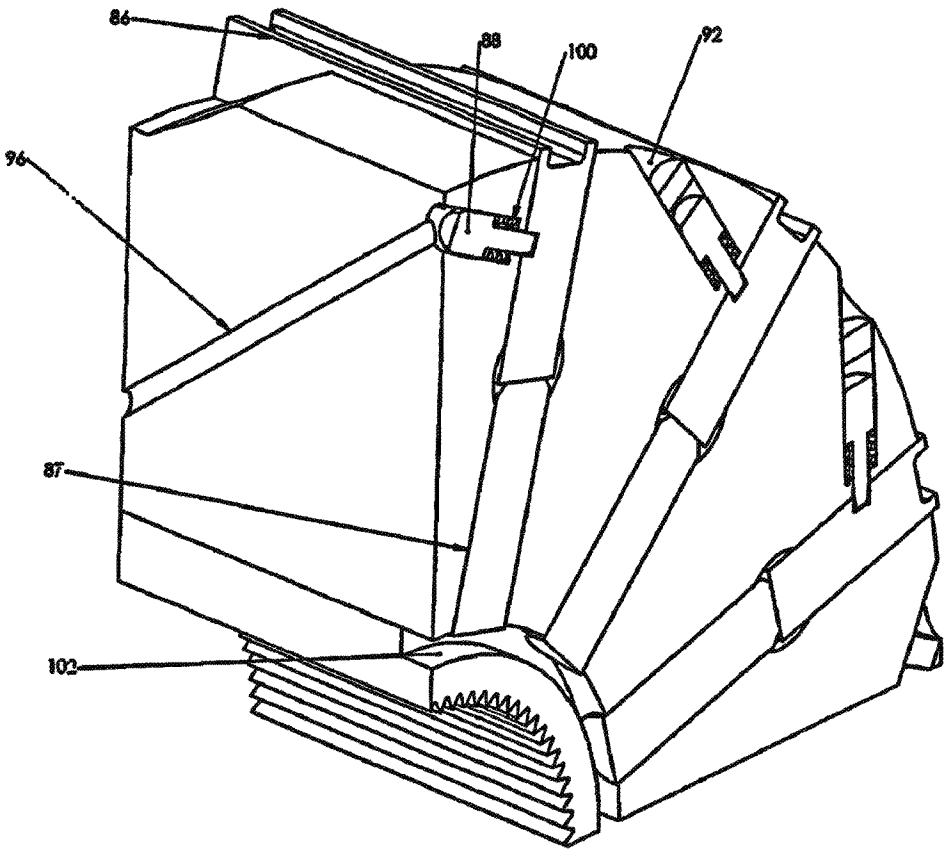
FIG. 7 is a three dimensional perspective view, partly in cross-section, showing detail of the rotor of FIG. 5.

Although the vanes will typically move from the retracted position to the extended position automatically, by virtue of centrifugal force caused by rotation of the rotor, when the engagement pins 88 are withdrawn, it may be advantageous to provide some means to assist in or facilitate movement of the vanes from the retracted position to the extended position. In usual practice, such means takes the form of hydraulic pressure acting on a vane or, more frequently, on a pin which then acts on a vane. For example, an oil gallery 102 may be provided around the drive shaft (see FIG. 3). Oil gallery 102 may be provided by fitting, such as by means of press fitting, a sleeve having an appropriate gallery space preformed therein into the central aperture of the rotor. Oil gallery 102 is in fluid communication with the underneath part of the vane pins 87 via under vane passages 104 (refer FIGS. 2 and 5). Oil gallery 102 is also in communication with outlet pressure or some other elevated pressure source.

In normal use of the hydraulic machine shown in FIGS. 2 to 7, with the vanes extending as they enter the rise regions and retracting as enter the fall regions, the fluid in the undervane passages associated with the vanes that are retracting is compressed and is forced into oil gallery 102. At the same time, the vanes that are extending have the pressure in their undervane passages decreasing. Consequently, hydraulic fluid is drawn out of the oil gallery into those undervane passages. Generally, during normal use, an equal number of vanes are extending and retracting at any one time, thereby maintaining a generally equilibrated pressure in oil gallery 102 at outlet pressure or some other elevated pressure level.

When it is desired to maintain the vanes in the retracted position, the control system associated with the hydraulic machine supplies pressurised pilot hydraulic fluid to slot 98 which, in turn, activates the retaining means as described above. As the vanes are retracted by rotation through the fall regions, the engagement pins 88 are activated to retain the vanes in the retracted position.

Figure 8:
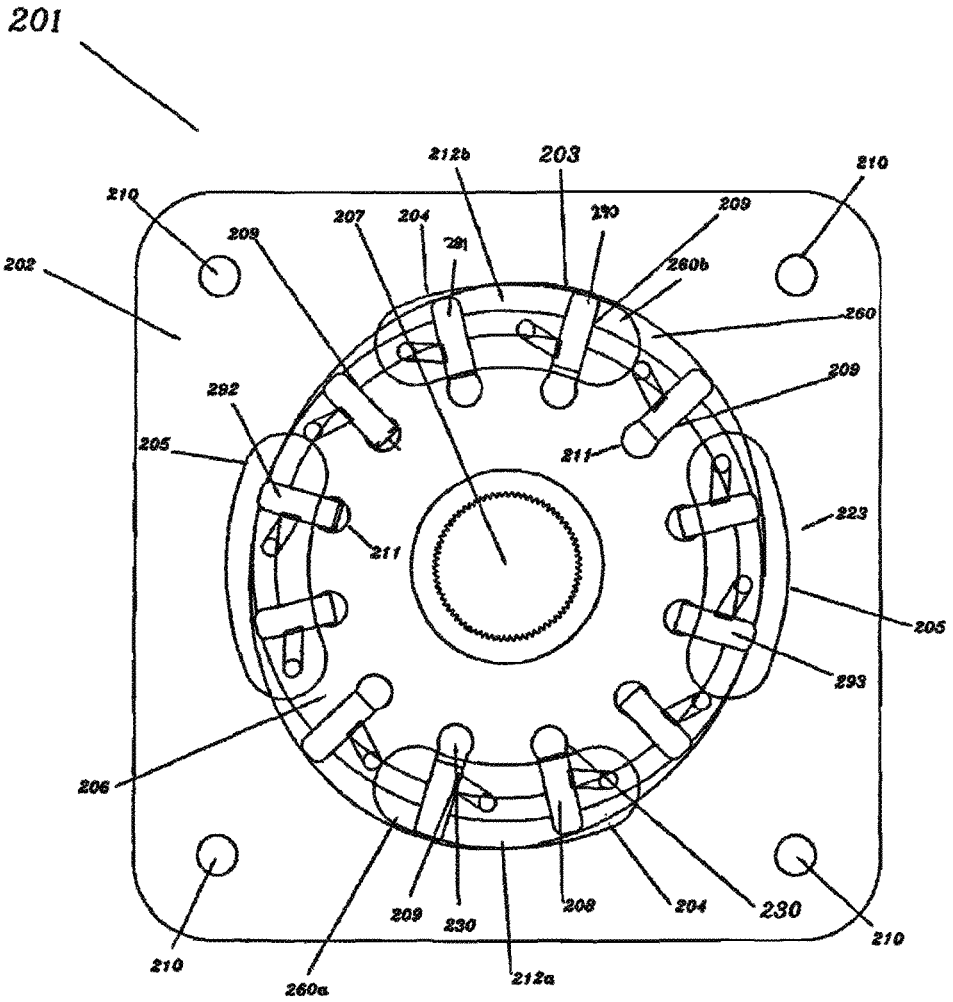
FIG. 8 is a detailed front view an assembly used in a hydraulic machine according to an embodiment of the invention.

When it is desired to operate the hydraulic machine such that the vanes work the hydraulic fluid as they pass through the rise and fall regions, the engagement pins 88 are disengaged FIGS. 8 to 11 show a hydraulic machine in accordance with another embodiment of the present invention. FIG. 8 shows a front view of a ring rotor, vane and pressure plate assembly of the pump. In FIG. 8, the assembly 201 of a hydraulic pump includes a body 202, an elliptical chamber 203 located within the body 202, inlets 204 through which hydraulic fluid may be introduced into the chamber 203, outlets 205 from which hydraulic fluid may leave the chamber 203, a slotted rotor 206 rotatable within the chamber 203, a drive shaft 207 extending through the slotted rotor 206, a plurality of vanes 208 (only some of which have been labelled) located within each slot 209 (only some of which have been labelled) of the rotor 206, and openings 210 for bolts. Passages 211 are located under each vane 208. The assembly 201 includes an inlet for hydraulic fluid (not shown) that can be connected to an appropriate hydraulic line, in accordance with conventional practice in this art.

Figure 9:
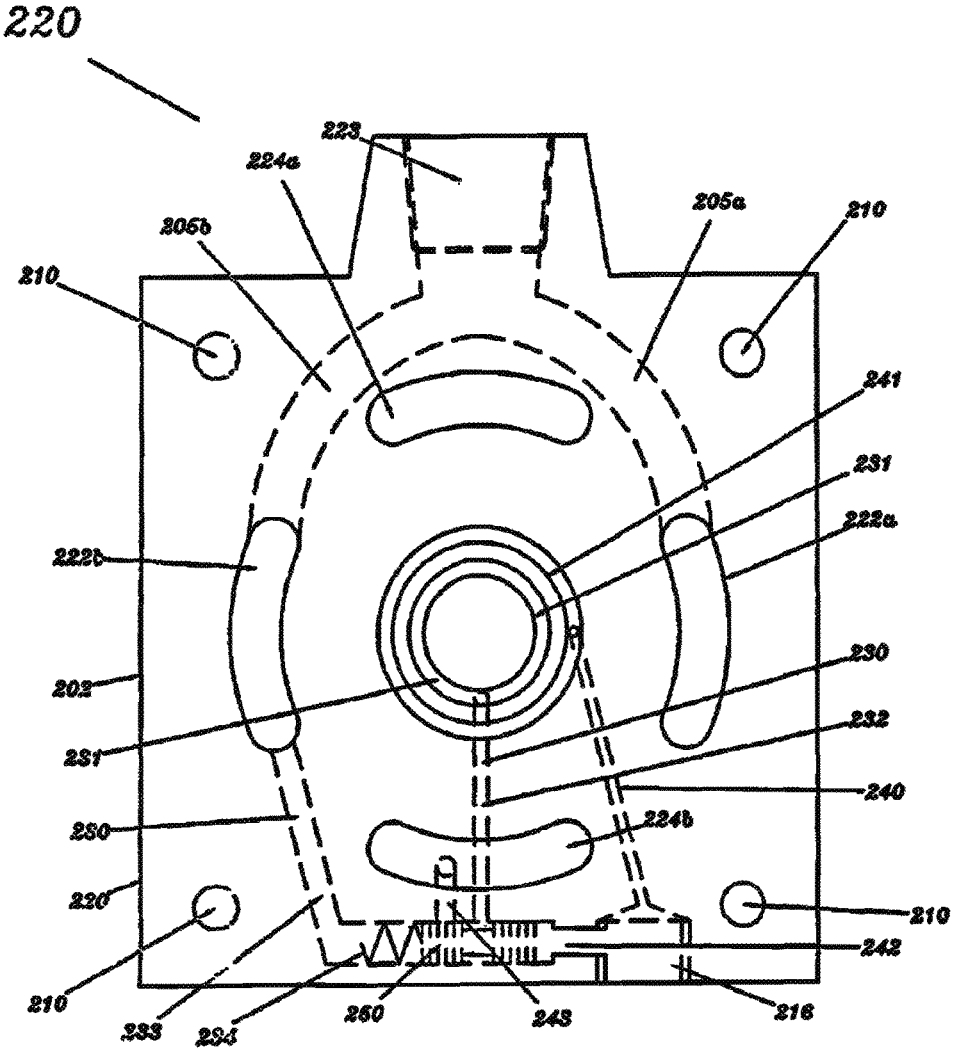
FIG. 9 is a detailed front view of another part of a hydraulic machine that is connected to the assembly shown in FIG. 8, according to an embodiment of the invention.
Figure 11:
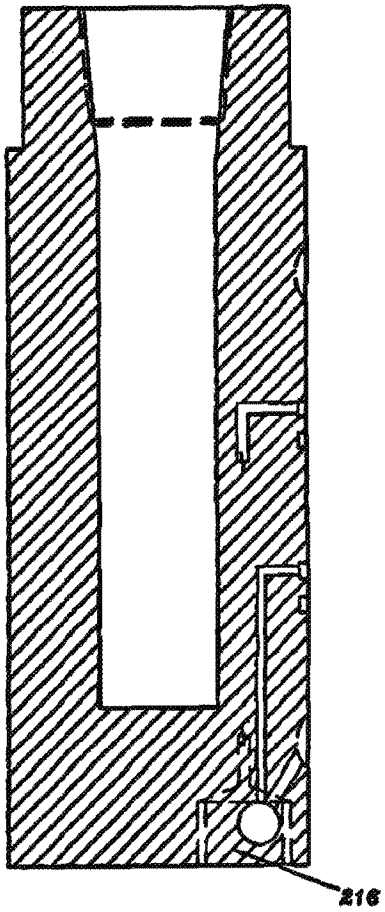
FIG. 11 is a cross-sectional side view of the machine part shown in FIG. 9 and taken from the other side to that shown in FIG. 10.
Figure 10:
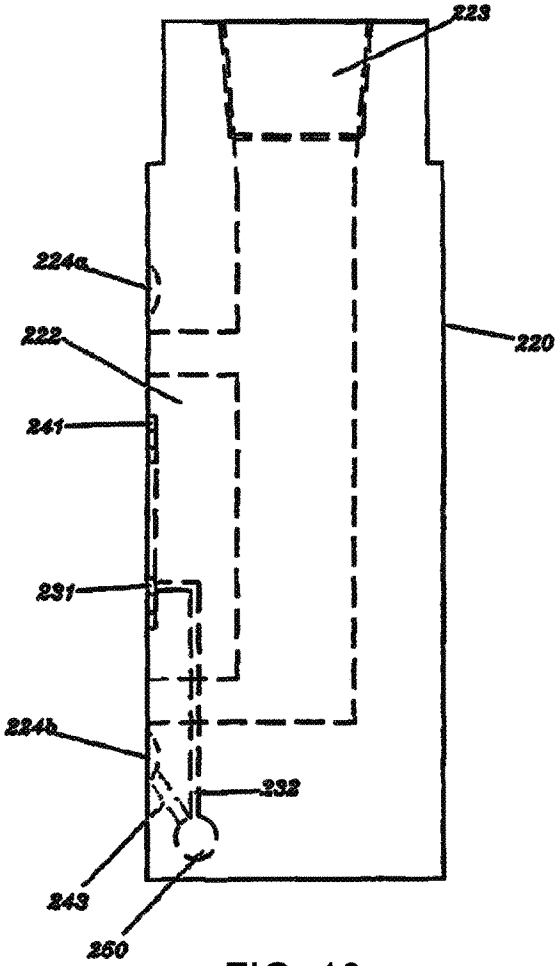
FIG. 10 is a detailed side view of FIG. 9.

FIGS. 9 to 11 show another part 220 of the hydraulic pump. Assembly 201 and part 220 are joined together to form the hydraulic pump. For clarity, some details have been omitted from FIGS. 8 to 11, although the omitted parts relate to features known to the person skilled in this art. Part 220 has bolt openings 210 in the body 202 that coincide with the openings 210 of assembly 201 so that part 220 may be bolted face to face to the assembly shown in FIG. 8 in a fluid tight manner.

Part 220 has an outlet 223 that is threaded for attachment to a hydraulic line (not shown). Outlet 223 communicates with branched fluid passages 205*a*, 205*b* which, in turn, communicate with kidney shaped openings 222*a*, 222*b*. Openings 222*a*, 222*b* are positioned in register with respective openings 205 on the pump assembly 201 shown in FIG. 8 when assembly 201 and part 220 are joined together. Part 220 includes kidney shaped recesses 224*a*, 224*b* that are in fluid communication with the inlet of the machine and in fluid communication with the suction quadrants 212*a* and 212*b* of assembly 201.

Since the chamber 203 is elliptical and the rotor is generally cylindrical, the space between the inner wall of the chamber and the outer wall of the rotor defines two lobes that form the rise, fall and major dwell regions 260*a* and 260*b* (see FIG. 8). Each vane 208 is movable between a retracted position and an extended position relative to a respective slot 209. The vanes 208 can only extend whilst within the rise regions. Vanes 290 and 291, for example, are in the extended position. Vanes 292 and 293, for example, are the retracted position. In the retracted position the vane 208 is unable to work hydraulic fluid introduced into the chamber 203, whereas in the extended position the vane 208 is able to work hydraulic fluid introduced into the chamber 203. The rotor includes under vane passages 211 under each of the vanes. A circular groove 231 in part 220 is in fluid communication with high pressure fluid in accordance with conventional practice to deliver pressurised hydraulic fluid to passage 211. This assists in moving the vanes to the extended position during normal operation of the machine.

A spool valve 250 is provided to allow venting of the under vane pressure by allowing passage 232 to communicate with inlet recess 224*b* when it is desired to retain the vanes in the retracted position. This is achieved by pilot pressure from pilot inlet 216 passing along passage 242 and exciting spool valve 250 to allow fluid communication between passage 232 and inlet recess 224*b*. When pilot pressure is released, spring return 234 returns spool valve to a position where passage 232 is in fluid communication with pressurised fluid. As will be understood, this also disconnects fluid communication between passage 232 and recess 224*b*. The machine shown in FIGS. 8 to 11 also includes a gallery 230 that prevents the spool moving to a position where passage 232 can communicate with the inlet recess 224*b* when under normal operation. This feature is optional.

The machine has a communication gallery 240 for selectively delivering hydraulic fluid to the vane retaining passage 241 (shown in FIG. 10) to operate the retaining means associated with each of the vanes 208. When the vane retaining passage 241 is pressurised with hydraulic fluid, for example by pressurised hydraulic fluid delivered from a pilot line via pilot inlet 216 and the vanes 208 are in a minor dwell section 260 of the chamber 203, the fluid clamps the vanes 208 within the respective slots 209. The mechanism for achieving this will be described in more detail with reference to FIGS. 12, 15 and 16.

When the vane retaining passage 241 is pressurised, hydraulic fluid is directed to a face of the vane 208 and forces the vane 208 against one or more surfaces defining the slot 209. This retains the vanes in the retracted position. More specific details of how the vanes are retained in the retracted position will now be described with reference to FIGS. 12, 15, 16 and 17.

Figure 12:
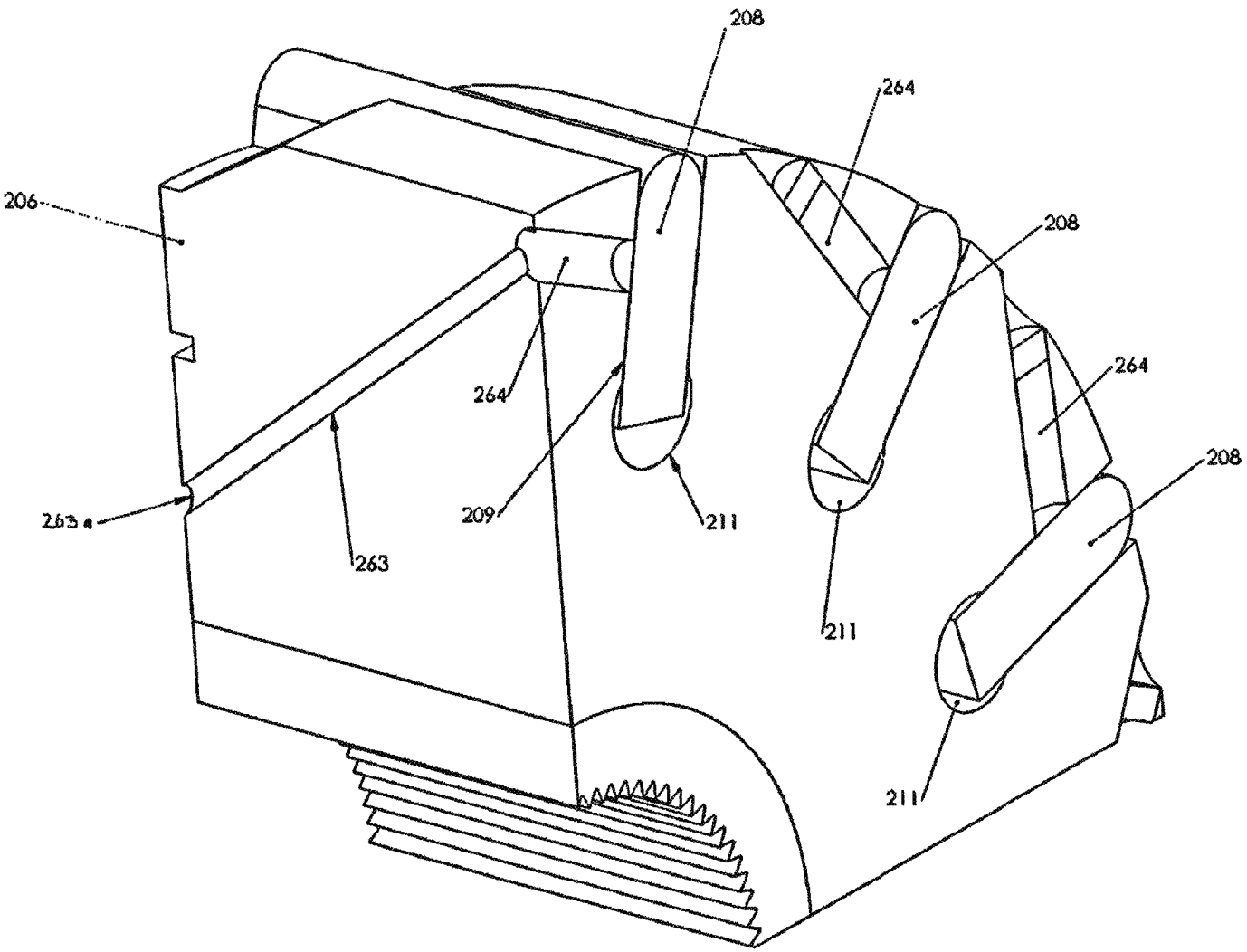
FIG. 12 shows an enlarged fragmentary perspective view of one embodiment of a retaining means for use in the hydraulic machine shown in FIGS. 8 to 11.
Figures 15, 15A:
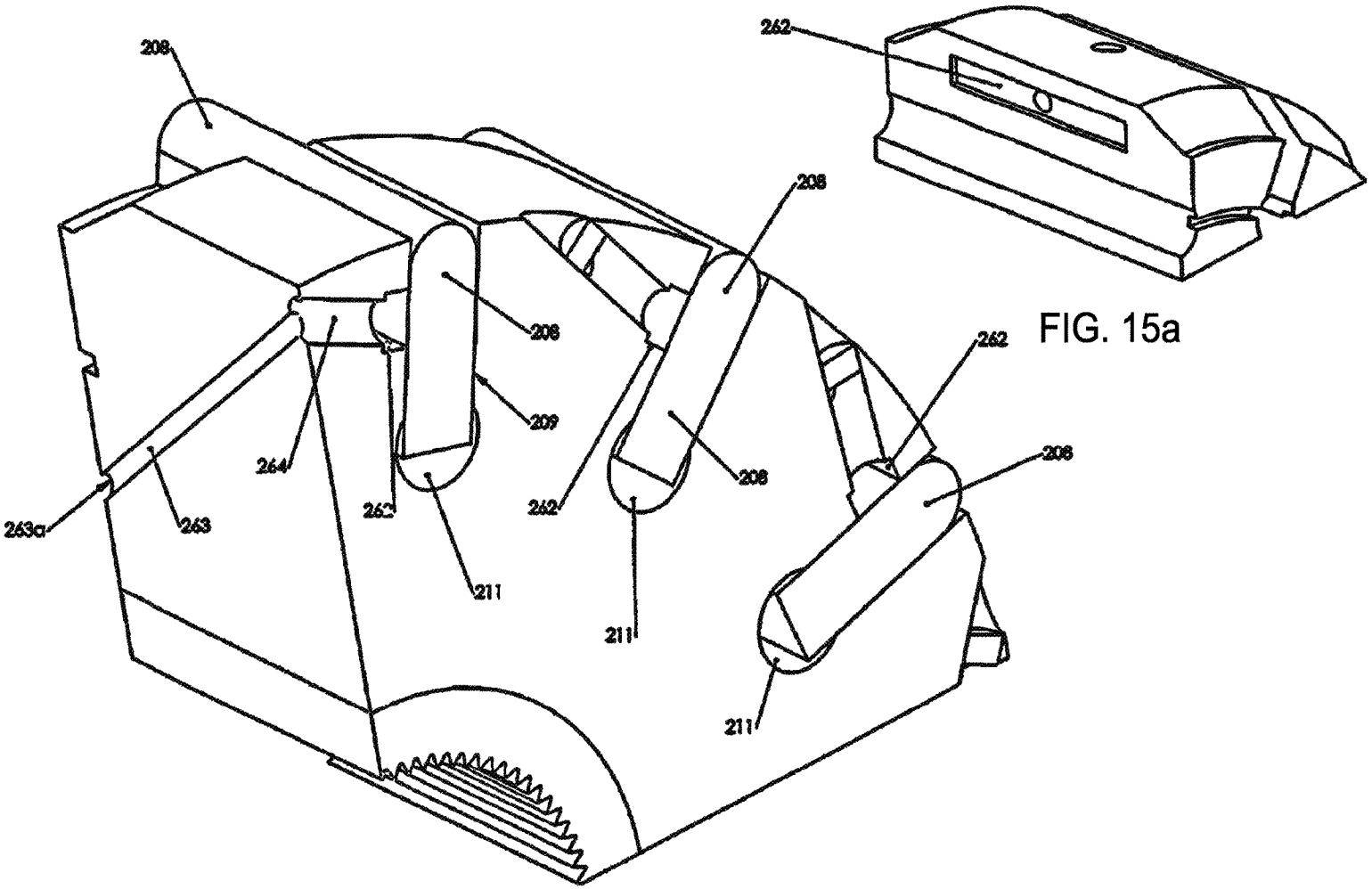
FIG. 15 shows an enlarged fragmentary perspective view of another embodiment of a retaining means for use in the hydraulic machine shown in FIGS. 8 to 11.
FIG. 15*a* shows a perspective view of a rotor slot with the vane removed to show more detail of the rotor groove of the embodiment of FIG. 15.
Figures 16, 16A:
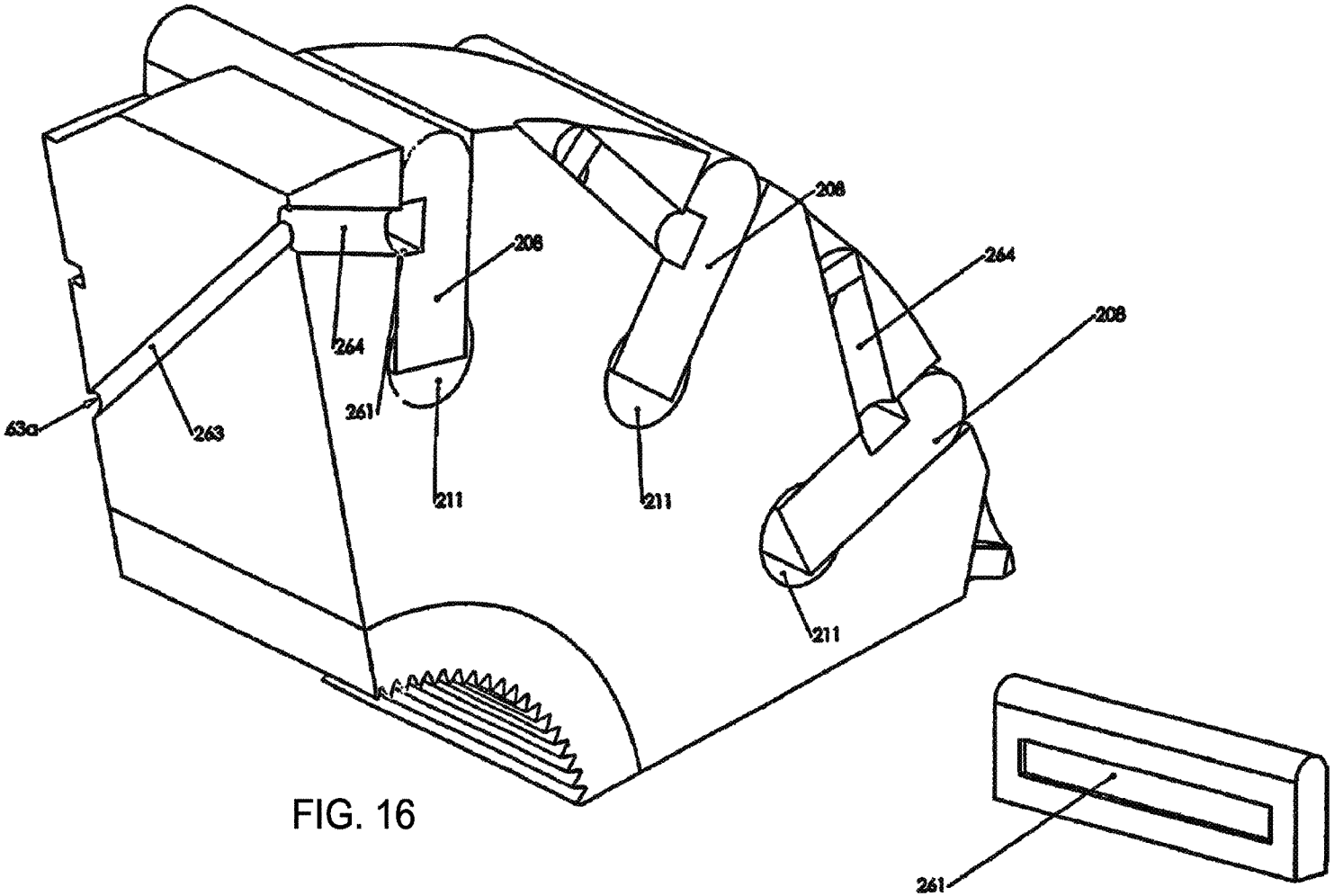
FIG. 16 shows an enlarged fragmentary perspective view of yet another embodiment of a retaining means for use in the hydraulic machine shown in FIGS. 8 to 11.
FIG. 16*a* shows a perspective of a vane removed from the rotor to show more detail of the vane groove on the vane of the embodiment of FIG. 16

In one embodiment shown in FIG. 12, a passage 263 extends through the rotor 206 into passage 264 to a surface defining each slot 209. The rear end 263*a* of passage 263 can be placed in fluid communication with vane retaining passage 241 to create pressurised hydraulic fluid against a side face of vane 208 to force vane 208 against slot 209 to restrain the vane 208 against slot 209. In the embodiment shown in FIG. 15, a respective groove 262 extends longitudinally along a surface defining each slot 209 and the vane retaining passage 241 supplies each groove 262 with hydraulic fluid. In the embodiment shown in FIG. 16, a respective groove 261 extends longitudinally along a face of each vane 208 (only some of which have been labelled) and the vane retaining passage 241 supplies each groove 261 with hydraulic fluid via passages 263, 264. When pressurised hydraulic fluid is supplied to passages 263,264 shown in FIGS. 12, 15 and 16, the pressurised hydraulic fluid applies a force against the side of the vane 208 and this force acts to clamp the vane in the retracted position. The grooves 261, 262 shown in FIGS. 15 and 16 act to increase the area on which the hydraulic force acts, thereby increasing the retaining effect. Grooves 261 and 262 suitably extend along the entire axial extent of the vane and slot, respectively as shown in FIGS. 15*a* and 16*a*. FIGS. 12, 15 and 16 have many features in common and like parts are denoted by like reference numerals.

In one mode of operation the hydraulic machine may be used as a pump. In another mode of operation the hydraulic machine may be used as a motor.

Figure 13:
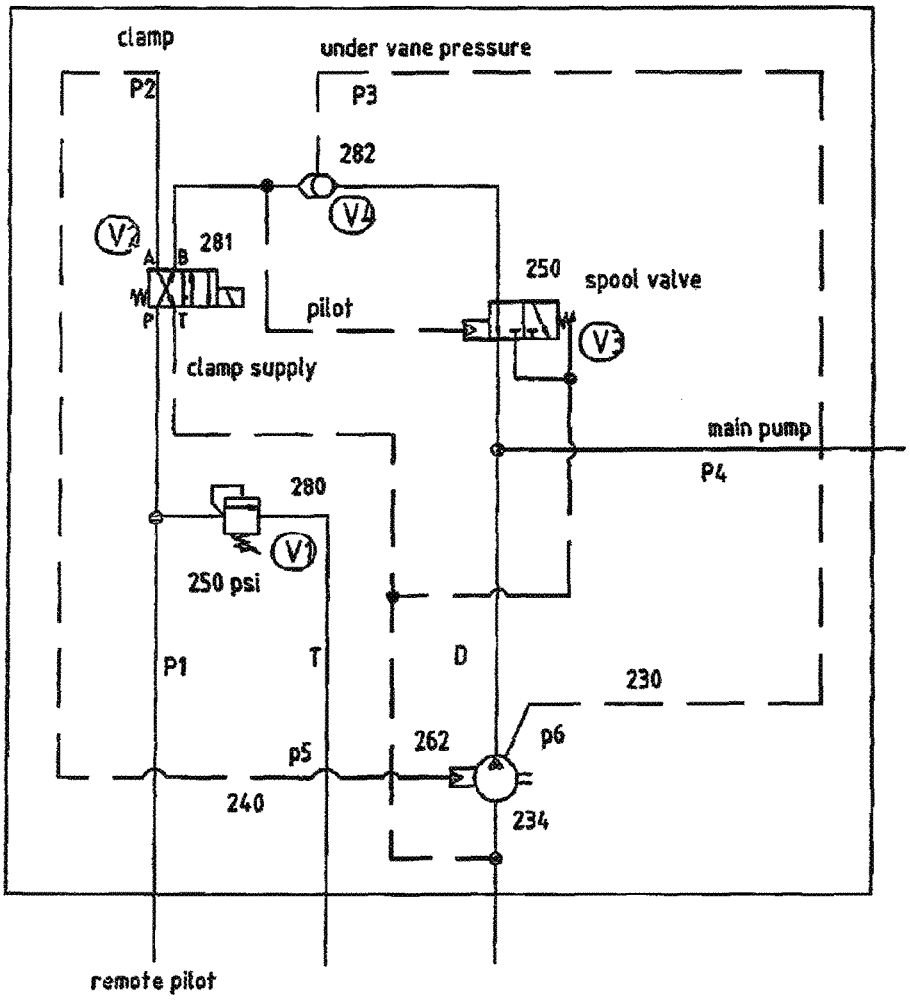
FIG. 13 shows part of a hydraulic circuit for the machine shown in the preceding figures, when used as a pump, according to an embodiment of the invention.

A hydraulic circuit showing how the machine may be used as a pump is shown in FIG. 13. The figure shows a safety pressure relief valve 280 (V1) for the clamping pressure supply, a solenoid valve 281 (V2) which selects whether the pump is on or off (i.e. whether the vanes are extended or retracted and clamped), spool valve 250 (V3) which is controlled by remote pilot fluid (oil), a pressure responsive shuttle valve 282 (V4), rotor 206, an enlarged view of a section of the rotor, 206, a slot 209, section 262 of passage 240, and section 234 of passage 230.

In order to turn the pump on such that fluid may be circulated, pilot hydraulic fluid is directed by solenoid valve 281 (V2) (in a spring offset mode) to under vane passage 230, 234 for introducing hydraulic fluid under each of the vanes 208, so as to move the vanes 208 to the extended position when located in a dwell section 260. In order to prevent circulation of the fluid, solenoid valve 281 (V2) is armed (mechanically, piloted or electrically), hydraulic fluid is directed to passage 240, 262, valve 250 moves to a spring return position, hydraulic fluid is drained from under the vanes 208 and the vanes 208 are clamped within the slots 209 once the vanes 208 leave the dwell sections 260. When solenoid valve 281 (V2) is disarmed the spring offset condition returns the vanes 208 to the extended position under moderate pressure to prevent shock When the setting pressure of valve 250 is reached, then the valve 250 is reset to allow the main pump pressure to be directed under the vanes 208 when the main pump pressure exceeds the low pilot and clamping pressure. Pressure responsive shuttle valve 282 (V4) prevents loss of the under vane pressure. It will be appreciated that hydraulic pumps may not necessarily require hydraulic pressure to be applied under the vanes (or under the vane pins) because centrifugal force typically causes the vanes to extend when the retaining means are released.

Figure 14:
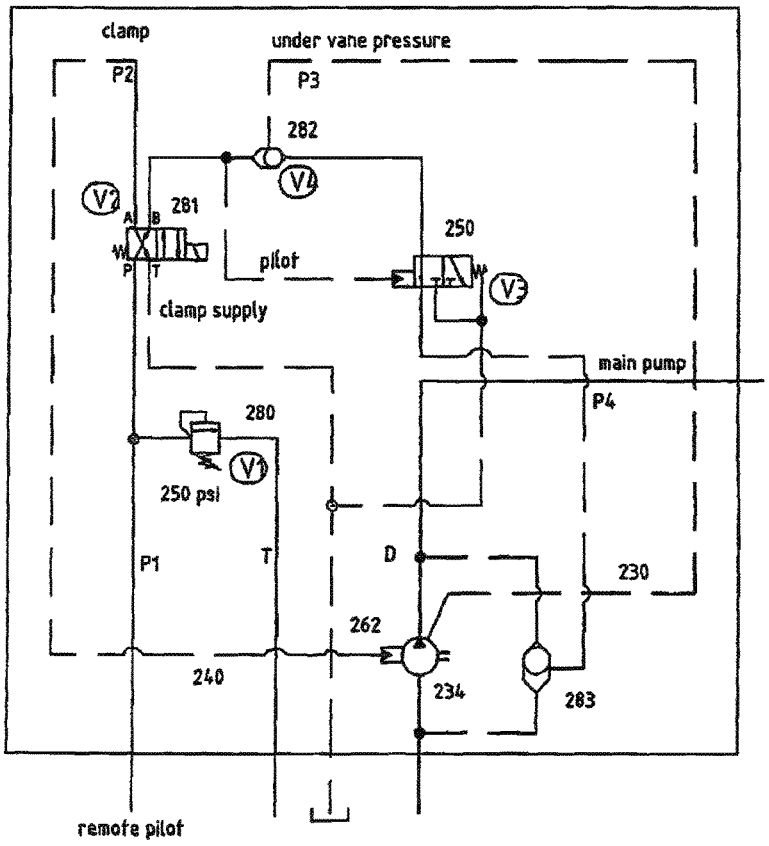
FIG. 14 shows part of a hydraulic circuit for the machine shown in FIGS. 8 to 13, when used as a motor, according to an embodiment of the invention.

A hydraulic circuit showing how the machine may be used as a motor is shown in FIG. 14. The figure shows a safety pressure relief valve 280 (V1) for vane retaining passage 240, a solenoid valve 281 (V2) which selects whether the pump is on or off, valve 250 (V3) which is controlled by pilot hydraulic fluid, pressure responsive shuttle valves 282 (V4), 283, rotor 206, an enlarged view of a section of the rotor, 206, a slot 209, section 262 of passage 240, and section 234 of passage 230. The motor operates basically the same way as the pump in FIG. 13. For convenience, FIGS. 13 and 14 show drain and an under vane pressure source.

Figure 17:
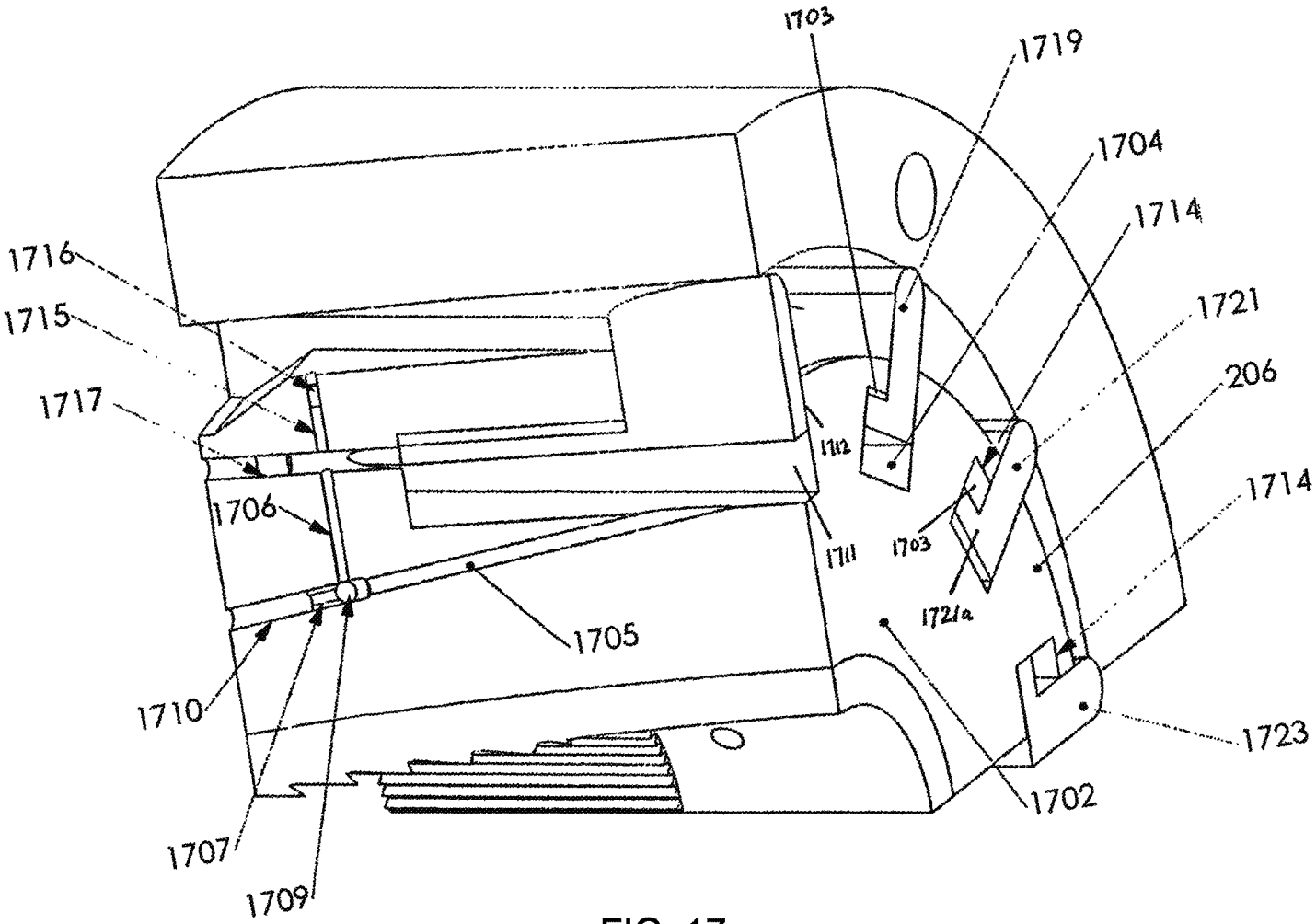
FIG. 17 shows an enlarged fragmentary perspective view of a further embodiment of a retaining means for use in the hydraulic machine shown in FIGS. 2 to 7.
Figure 18:
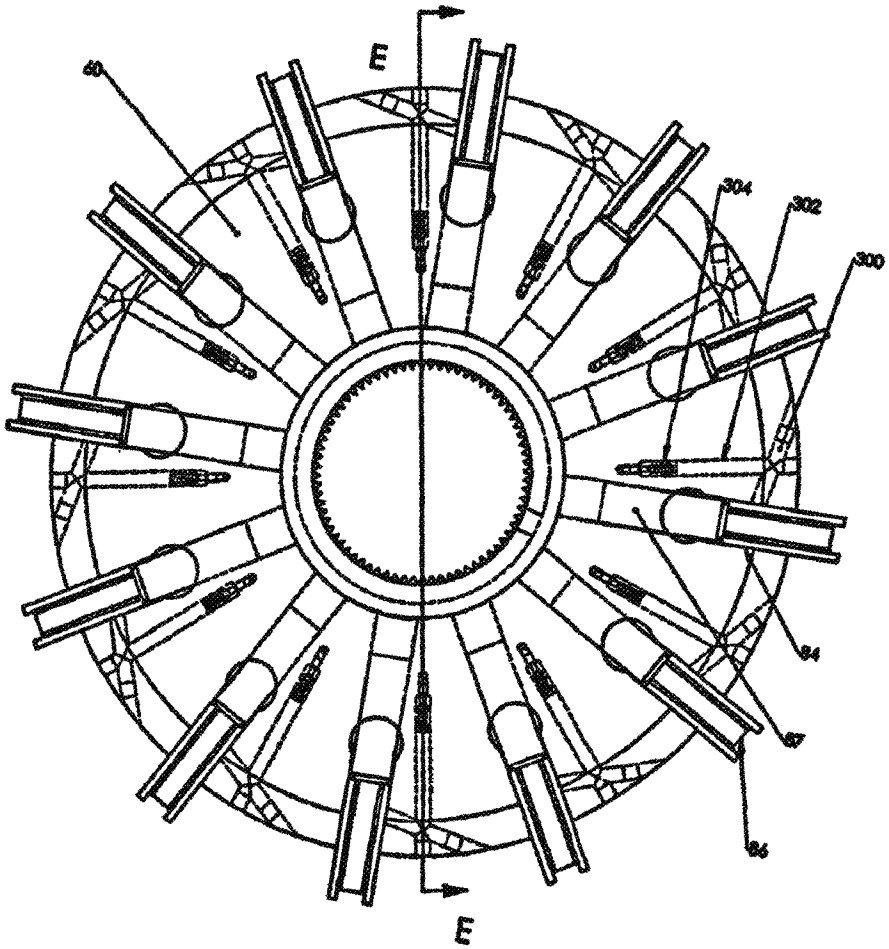
FIG. 18 is a front view of a rotor for use with another embodiment of the present invention.

FIG. 17 shows another embodiment of the pin retaining means that can be used with the hydraulic machine shown in FIGS. 2 to 7. In FIG. 17, the rotor 206 is provided with a plurality of slots 1710 that have an enlarged slot portion 1711 and a narrower outer slot portion 1712. Vanes 1719, 1721, and 1723 are positioned in each slot. Each vane 1719, 1721, and 1723 has an enlarged lower portion, one of which is shown in 1721*a* that fits into enlarged slot portion 1711. The enlarged vane portion 1721*a* prevents removal of the vane from the slot by movement in the radial direction. As can be seen from FIG. 17, a chamber 1703 is formed between the upper surface of the enlarged portion 1721*a* of the vane and the surface 1714 of the enlarged portion of the slot. Another chamber 1704 is formed between the floor of the enlarged portion 1711 of the slot and the lower surface of the vane.

The rotor 206 has a passage 1710 formed therein. Passage 1710 can come into register with a source of pressurised pilot hydraulic fluid. Passage 1710 is in fluid communication with another passage 1706 that, in turn, is in fluid communication with another passage 1715. Plugs 1716 and 1717 close respective ends of passages 1706 and 1715.

Passage 1715 opens into chamber 1703. Passage 1705 opens into chamber 1704. Ball 1709 acts as a shuttle valve in a manner known to the person skilled in the art. In particular, if there is high pressure in passage 1705 and low pressure in orifice plug 1707, then ball 1709 is held against the seat of orifice 1707 as a check and fluid can move from chamber 1704 to chamber 1703.

If high pressure is applied to orifice 1707 via passage 1710 (such as would occur when it is desired to actuate the retaining means), the ball 1709 sits against the seat of gallery 1705 and pressure is applied to chamber 1703 to retain the vane in the retracted position (and potentially to drive the vane into the retracted position).

In the embodiment of FIG. 17, the vane retaining passages are progressively and sequentially actuated as the vanes of each passage move into the minor dwell region. This is shown in FIG. 17, which shows vane 1723 being fully retracted and clamped by the vane retaining means, vane 1721 moving through the fall region (and hence being retracted) but not yet clamped and vane 1719 moving through the major dwell region. To achieve this, a slot of relatively small circumferential extent, similar to slot 98 shown in FIG. 2, is used to pressurise the vane retaining passages with pressurised pilot fluid.

In normal operation when the retaining means are not operated, fluid flows from chamber 1704 to chamber 1703 through passages 1705 and 1706 to maintain hydraulic balance and ensure that the force on the top of the vane is not increased due to the larger base of vane, as is known in this art.

FIGS. 18 to 22 show another embodiment of the present invention using a different retaining means to retain the vanes in the retracted position. The embodiment shown in FIGS. 18 to 22 has a number of features similar to the embodiment shown in FIGS. 2 to 7. For convenience, like reference numerals will be used to denote like parts and further description of those parts will not be provided.

Figure 20:
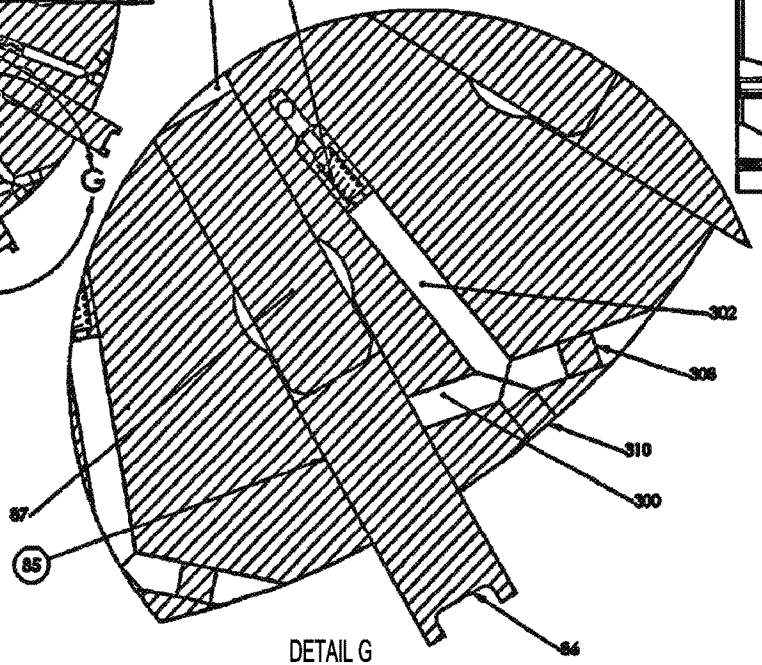
FIG. 20 is an enlarged view of detail G of FIG. 19.
Figure 19:
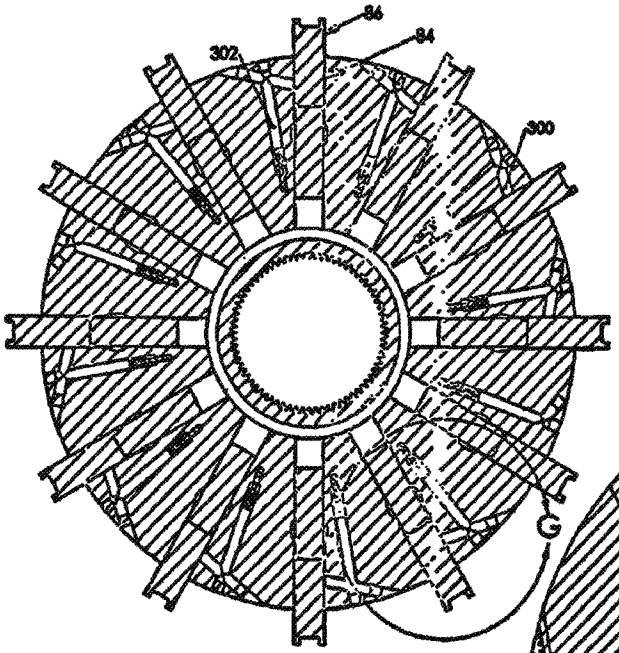
FIG. 19 is a cross-sectional view of the rotor shown in FIG. 18, with the cross section taken along line F-F of FIG. 19*a;*

The embodiment shown in FIGS. 18 to 22 does not use a movable engagement pin or detent pin to retain the vanes in the retracted position. Instead, the embodiment shown in FIGS. 18 to 22 uses hydraulic fluid pressure to hydraulically clamp the vanes in the retracted position. To this end, the rotor 60 has a plurality of passages drilled therein. As best seen in FIG. 20, the passages include a passage 300 that opens in a side wall of slot 84. As can be seen from FIG. 20, passage 300 extends obliquely to the radially extending slot 84. Passage 300 is in fluid communication with another passage 302 that extends inwardly in a generally radial direction. A check valve 304 is mounted in an inner part of passage 302. Check valve 304 allows oil to flow through passage in 302 in the direction towards passage 300. However, oil flow in the reverse direction is not permitted by the check valve 304. Check valve 304 acts as a non-return valve in a manner known to the person skilled in the art Suitable check valves may be purchased from many suppliers.

Figure 21:
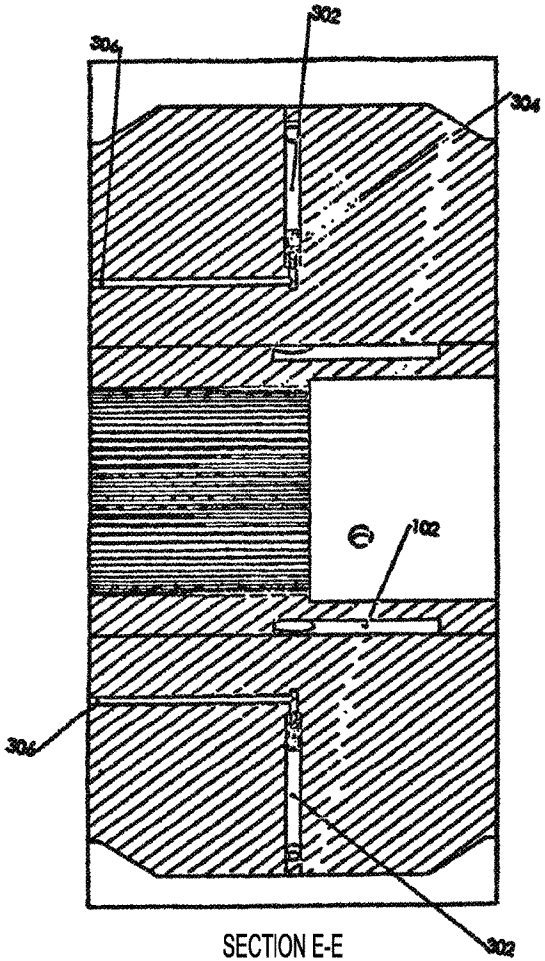
FIG. 21 is a cross-sectional view taken along line E-E of FIG. 18.
Figure 19A:
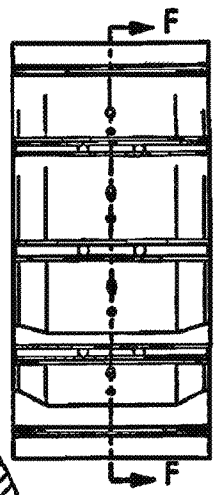
FIG. 19*a* is a side view of the rotor of FIG. 18, with FIG. 19*a* being provided to show the section line along which the sectional view of FIG. 19 is shown.
Figure 22:
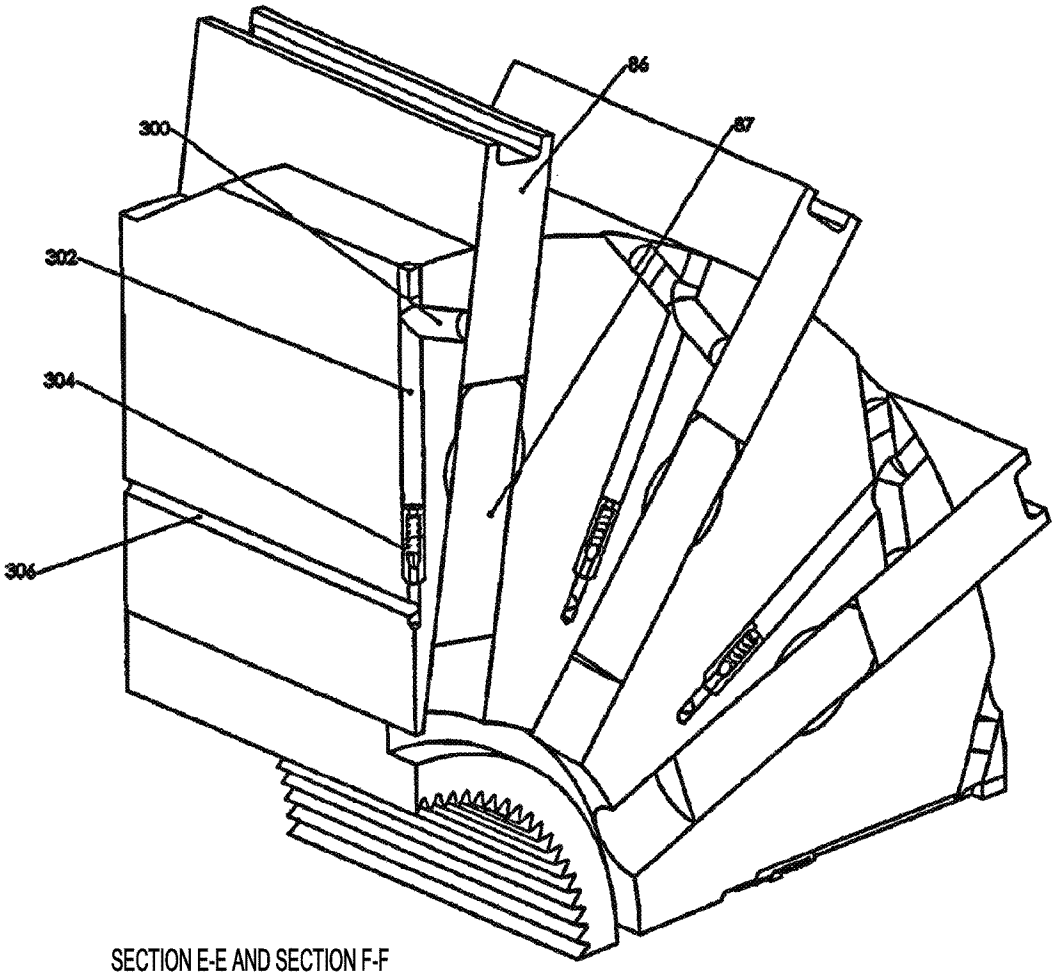
FIG. 22 is a perspective view, partly in cross-section, of the rotor shown in FIG. 18.

An inner part of passage 302 is in fluid communication with a longitudinal passage 306 (best shown in FIGS. 21 and 22). Passage 306 comes into register with a slot that communicates pressurised pilot hydraulic fluid when it is desired to retain the vanes in the retracted position.

Passage 300 is plugged by plug 308 and passage 302 is plugged by plug 310.

When it is desired to retain the vanes in the retracted position, pressurised pilot hydraulic fluid is provided to passages 306, 302 and 300. The pressurised hydraulic fluid attempts to leave passage 300 and, in doing so, comes into contact with a sidewall of the vane 86. The pressurised pilot hydraulic fluid applies a force against the vane 86, normal to the face of the vane. As a result, the vane 86 is pressed against the opposed wall of the slot 84. This acts to retain the vane in the retracted position.

When the pressurised pilot hydraulic fluid is removed from passage 300, the hydraulic clamping force is removed and the vanes can again operate normally.

The embodiment shown in FIGS. 18 to 22 is suitable for use with smaller hydraulic pumps and motors because the centrifugal force acting on the vanes in smaller pumps and motors is lower. The embodiment of FIGS. 18 to 22 is also similar to the embodiment of FIGS. 8 to 17, except that the embodiment of FIGS. 8 to 17 does not include under vane pins.

Figure 23:
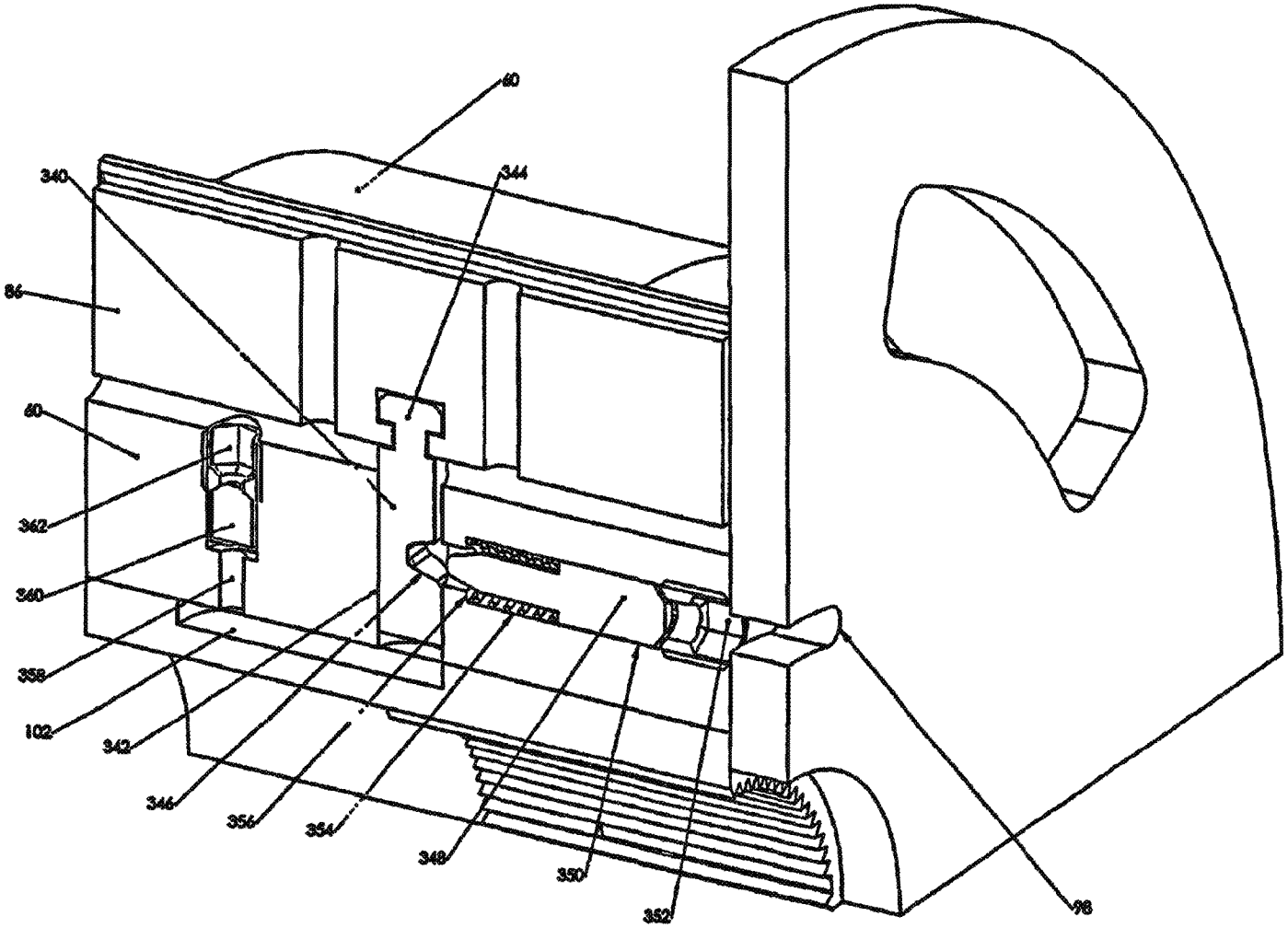
FIG. 23 is a perspective view of a cross-section of a rotor for use with another embodiment of the present invention.
Figure 24:
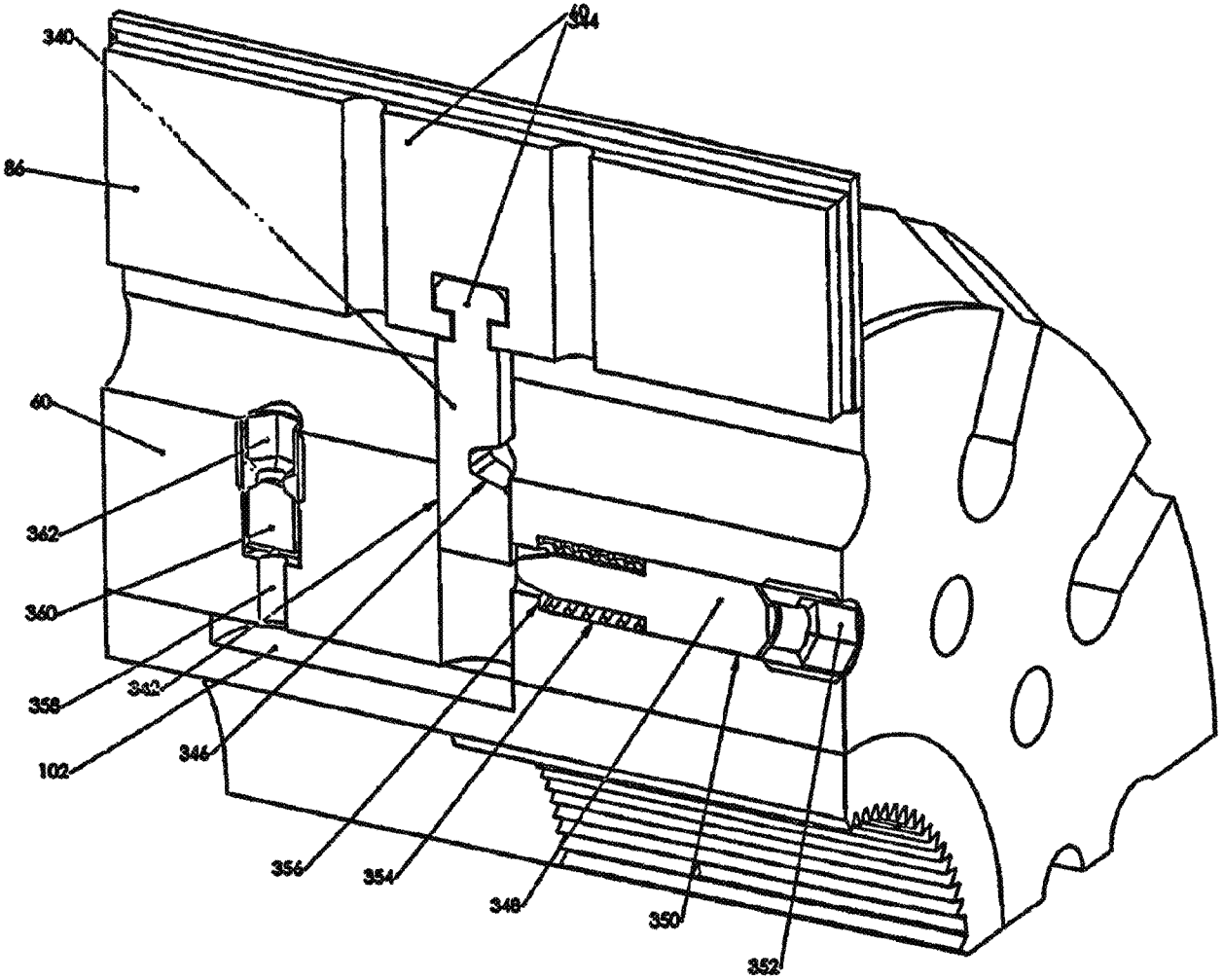
FIG. 24 is an enlarged view of part of the rotor of FIG. 23.
Figure 25:
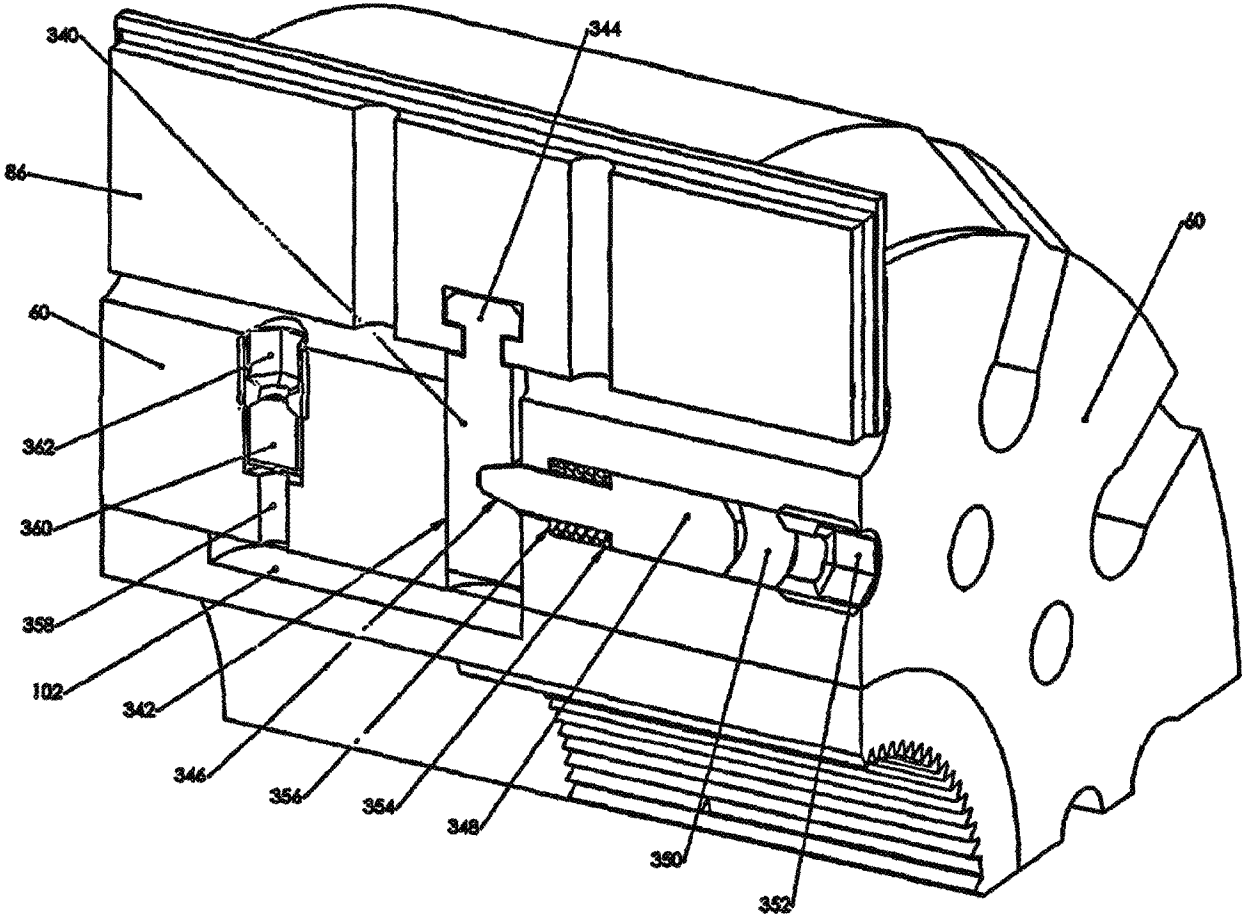
FIG. 25 is a view similar to that of FIG. 24, but with an engagement pin shown in the engaged position.
Figure 27:
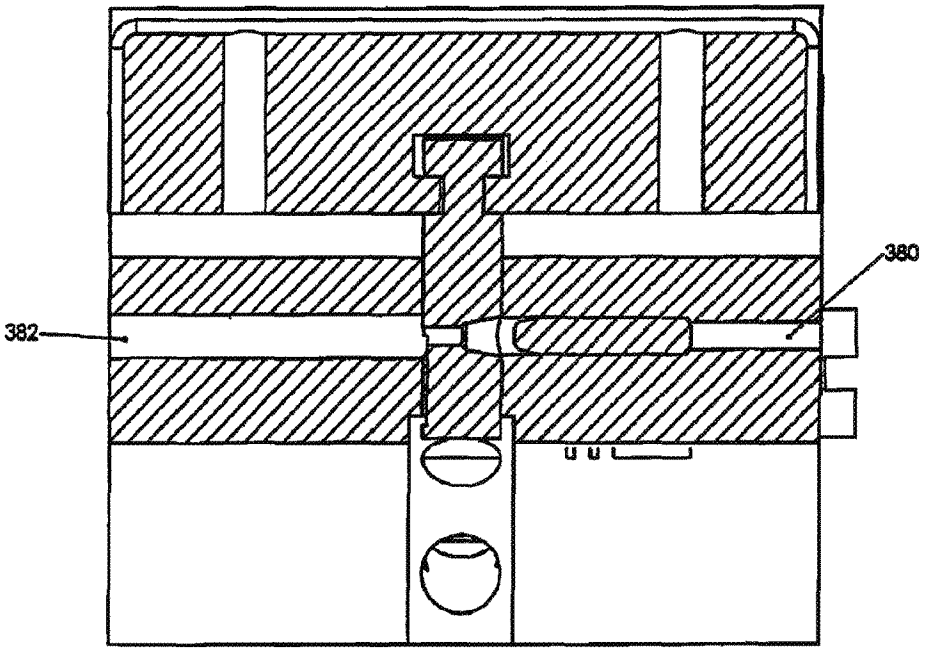
FIG. 27 is a cross-sectional view taken along line A-A of FIG. 26.

FIGS. 23 to 25 show a further embodiment of the present invention. The embodiment shown in FIGS. 23 to 25 has a number of features in common with the embodiment shown in FIGS. 2 to 7. For convenience, like reference numerals will be used to refer to like parts and further description of those like parts will not be provided.

In the embodiments shown in FIGS. 23 to 25, the vanes 86 are mounted to the rotor 60 by use of an undervane pin 340. Undervane pin 340 is slidably mounted in pin opening 342. The lower end of pin opening 342 is in fluid communication with oil gallery 102. Undervane pin 340 includes a T-shaped head 344 that is fitted into a complementary shaped recess formed in vane 86. In this fashion, vane 86 and undervane pin 342 move together.

As best shown in FIG. 24, undervane pin 342 is provided with a recess 346. Recess 346 is particularly a tapered recess having walls that taper outwardly.

An engagement pin 384 is positioned inside passageway 350. Passageway 350 comes into register with a slot that provides for fluid communication of pressurised pilot hydraulic fluid. A screw plug 352 having an opening therethrough is screwed into the end of passage 350 in order to retain the engagement pin 384 in passageway 350. A return spring 354 is mounted between the engagement pin 384 and a shoulder 356 formed near the end of passageway 350.

A further passage 358 having a check valve 360 and a screw in plug 362 is provided to enable hydraulic fluid to move from either the chamber at system pressure or underneath the vane 86 into the oil gallery 102 positioned under the under vane pins 340. This allows the oil gallery 102, which is located under the under vane pins and hence under the vanes, to always contain pressurised hydraulic fluid during use of the machine. The machine is preferably arranged such that a check valve is always positioned in fluid communication with the pressurised regions of the chamber during normal use. In this manner, system hydraulic pressure acts on pin 340 to provide appropriate pressure balance on the vane and to ensure that the vane remains in contact with the chamber wall whilst travelling along the rise regions. Other known arrangements, such as using annular grooves, may also be used to supply system hydraulic pressure to under the vane pins 340.

FIG. 24 shows operation of the apparatus in the normal mode in which the vanes can move between the retracted and extended positions. FIG. 25 shows the apparatus in the mode of operation where the vanes are retained in the retracted position. In order to retain the vanes in the retracted position, the control system is actuated to pass pressurised pilot hydraulic fluid through plug 352 to passage 350. The pressurised pilot hydraulic fluid forces the engagement pin 348 to move against the bias of the return spring 354 and into recess 346 in the undervane pin 340. Due to the complementary tapered shape of the recess in 346 and the engagement pin 348, it can be ensured that the vane is retracted below the diameter of the minor dwell. It is advantageous to retract the vane below the minor dwell diameter to ensure that the vane never contacts the chamber wall while pinned in place. If it did, it would gouge the chamber wall. The taper assists in retracting the vane below the minor diameter so contact with the chamber wall while pinned can never occur. A further advantageous feature arising from the complementary tapered shape of the recess 346 and the engagement pin 348 is that the vane 86 does not need to be in a fully retracted position in order to be properly retained. If the vane 86 is not in the fully retracted position, the tapered head of engagement pin 348 engages with the tapered wall of recess 346. As the engagement pin 348 is driven into the recess 346 by virtue of the pressurised pilot hydraulic fluid, the undervane pin 340 is forced to move downwardly, which consequently forces the vane 86 to move downwardly to the fully retracted position. A groove (not shown) on pin 340 allows oil to escape from the spring side of the engagement pin 348 upon actuation. If the groove runs towards the T-head side of the pine 340, the pump can be unloaded at high working pressures. If the groove runs to the other end of pin 340 it can be unloaded only at low working pressure. Alternately, holes could be drilled through rotor 60 to achieve the same effect.

When the pressurised pilot hydraulic fluid is removed from passageway 350, the return spring 354 causes the engagement pin 348 to be moved out of engagement with the undervane pin 340. Thus, the vane 86 is then free to move to the extended position as the rotor passes into the rise regions.

FIGS. 26 to 30 show an embodiment that has a number of similarities to that shown in FIGS. 23 to 25. For convenience, like features will be denoted by like reference numerals.

Figure 26:
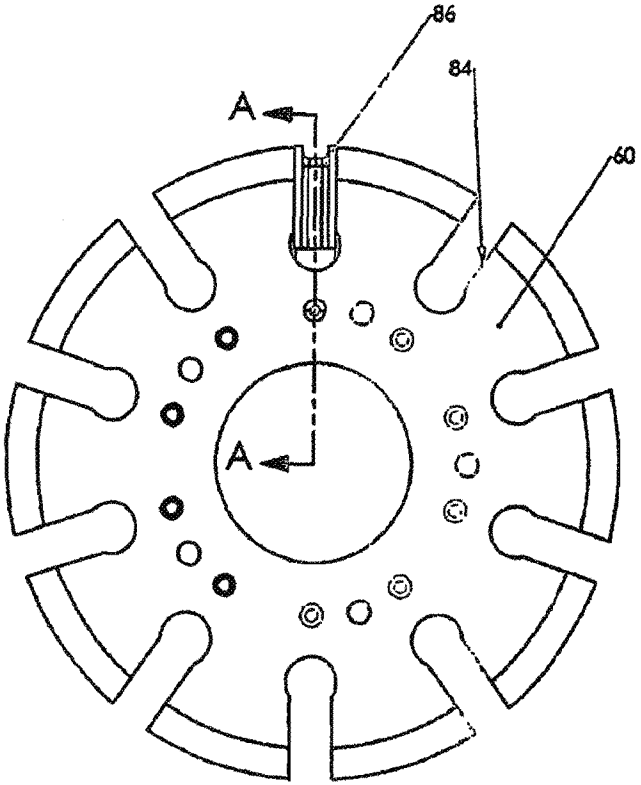
FIG. 26 is a front view of a rotor in accordance with another embodiment of the present invention.
Figure 28:
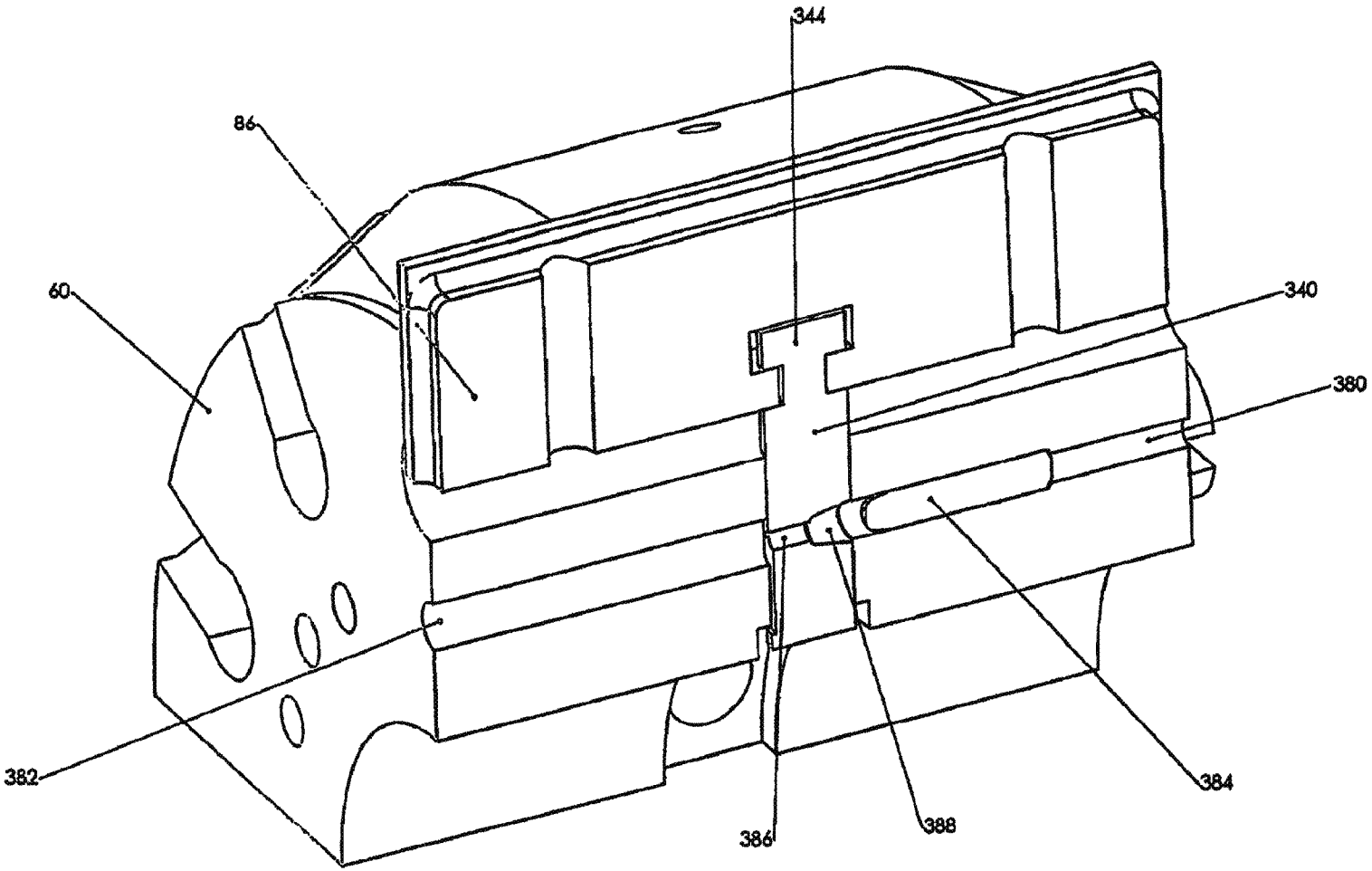
FIG. 28 is a three dimensional view of the cross-section shown in FIG. 27.
Figure 29:
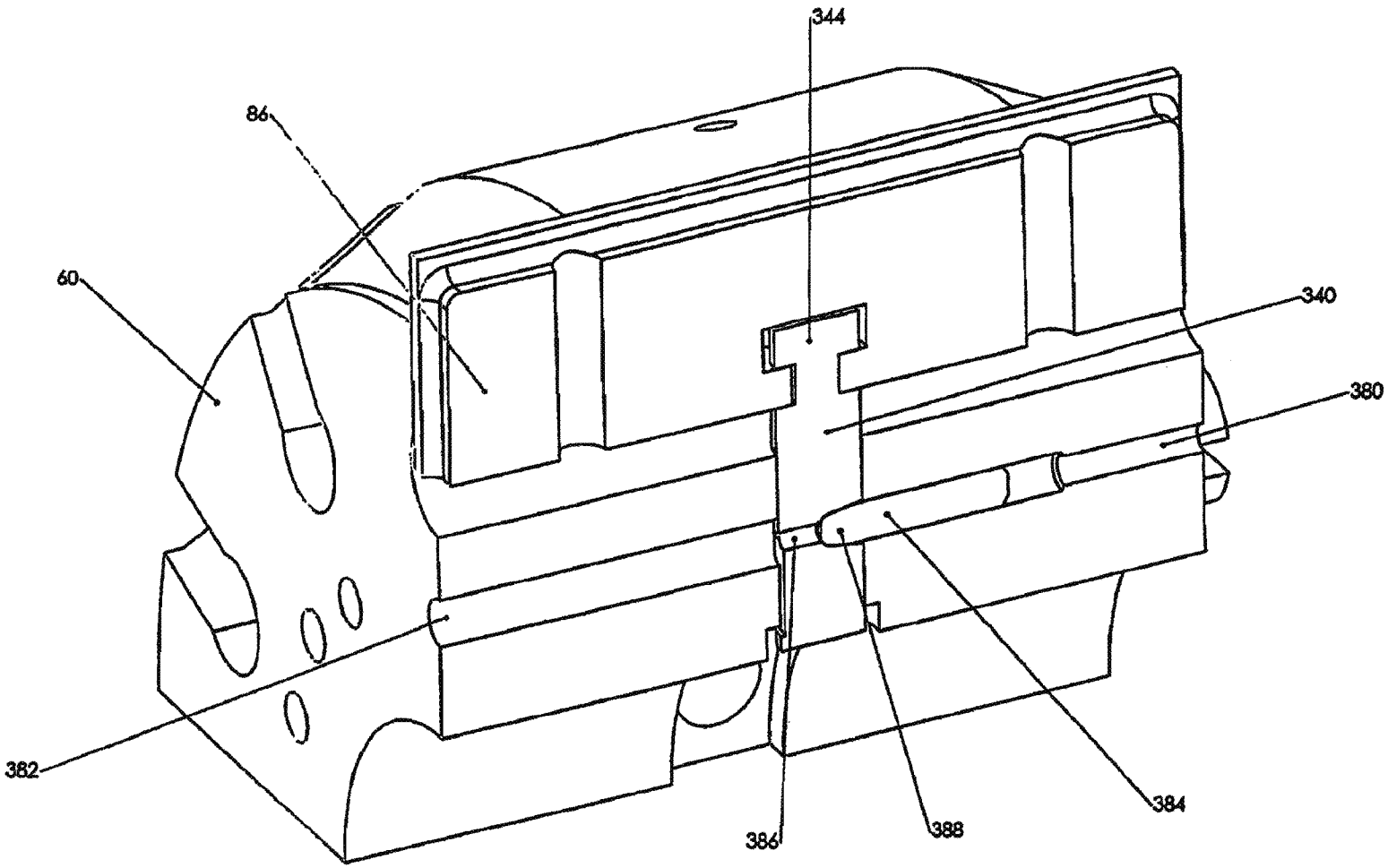
FIG. 29 is a three dimensional view, on enlarged scale, similar to that, shown in FIG. 28 but with the engagement pin in an engaged position.
Figure 30:
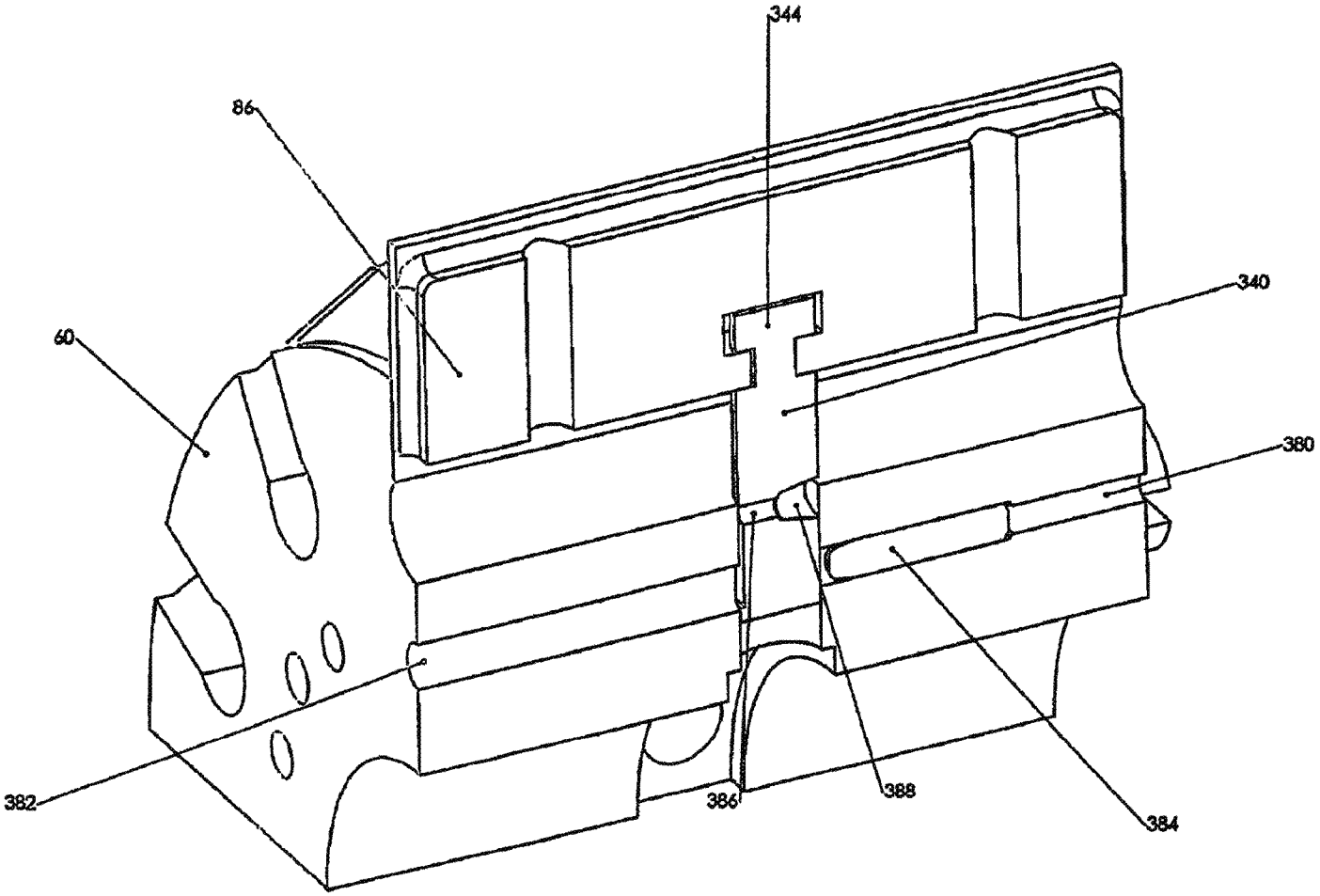
FIG. 30 is a three dimensional view of the embodiment shown in FIG. 29 but with the engagement pin in a disengaged position.

FIG. 26 shows an end view of a rotor 60 in accordance with the further embodiment of the invention. As best shown in FIGS. 27 to 30, vanes 86 are slidably affixed in slots 84 by use of undervane pins 340 having a T-shaped head 344.

The body of the rotor 60 is also provided with a first passage 380 and a second passage 382. An engagement pin 384 is positioned in first passage 380.

Engagement pin 384 is provided with a bore 386 that passes through the engagement pin 384. Bore 386 defines, at one end, a tapered recess 388 that engages with a complementary shaped tapered head on the engagement pin 384. As can be seen from FIGS. 27 to 30, engagement pin 384 is not provided with a return spring.

In order to retain the vanes 86 in the retracted position, pressurised pilot hydraulic fluid is supplied via passage 380. This forces the engagement pin 384 to move such that its tapered head fits into the tapered recess 388 on undervane pin 340. In order to disengage the engagement pin 384, the pressurised pilot hydraulic fluid flow to passage 380 is stopped and pressurised pilot hydraulic fluid then sent to passage 382. The pressurised hydraulic fluid travels along passage 382, through bore 386 and thereafter engages with the head of engagement pin 384. This causes engagement pin 384 to move out of the tapered recess 388. This then allows the vane 86 to move between the retracted and extended position. Travel of the pin 384 away from undervane pin 340 is limited by appropriate shaping of the passage 380. The shape of passage 380, together with the engagement pin 384, acts as a check valve to prevent flow of pressurised hydraulic fluid from passage 382 through all of passage 380.

Figure 31:
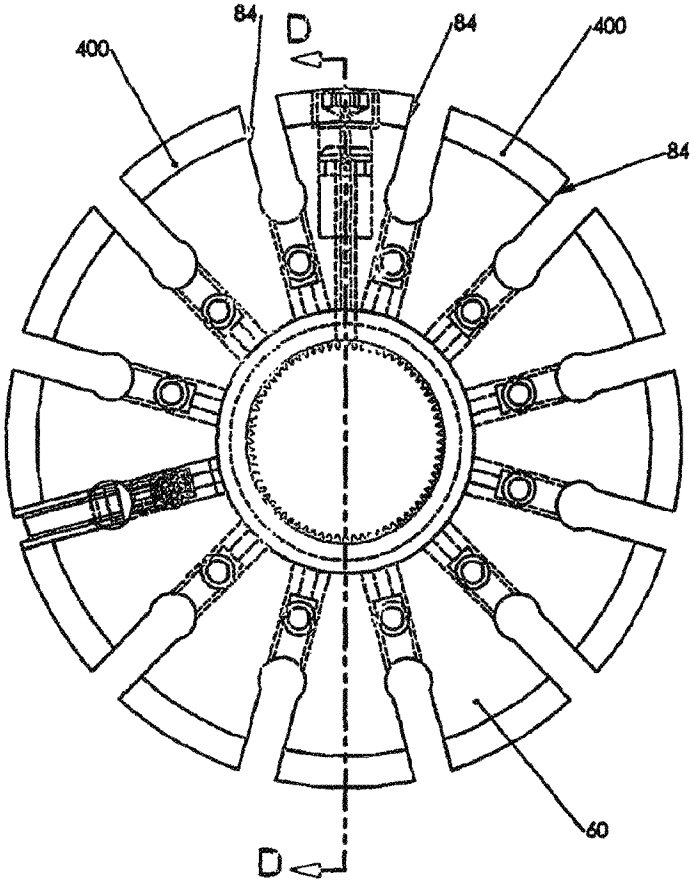
FIG. 31 is a front view of a rotor for use with another embodiment in accordance with the present invention.

FIGS. 31 to 34 show an embodiment of the invention that includes alternative means for draining hydraulic fluid from the undervane passages, in particular from the passages under the under vane pins. In this regard, it will be appreciated that, as all the vanes of the rotor become locked down when it is desired to retain the vanes in the retracted position, any hydraulic fluid positioned under the vane pins must be able to be vented from under the vane pins. The embodiment of FIGS. 31 to 34 provides one way of achieving this. As shown in FIG. 31, the rotor 60 having a plurality of radially extending slots 84 also defines a plurality of raised lands 400 positioned between the slots 84.

Figure 33:
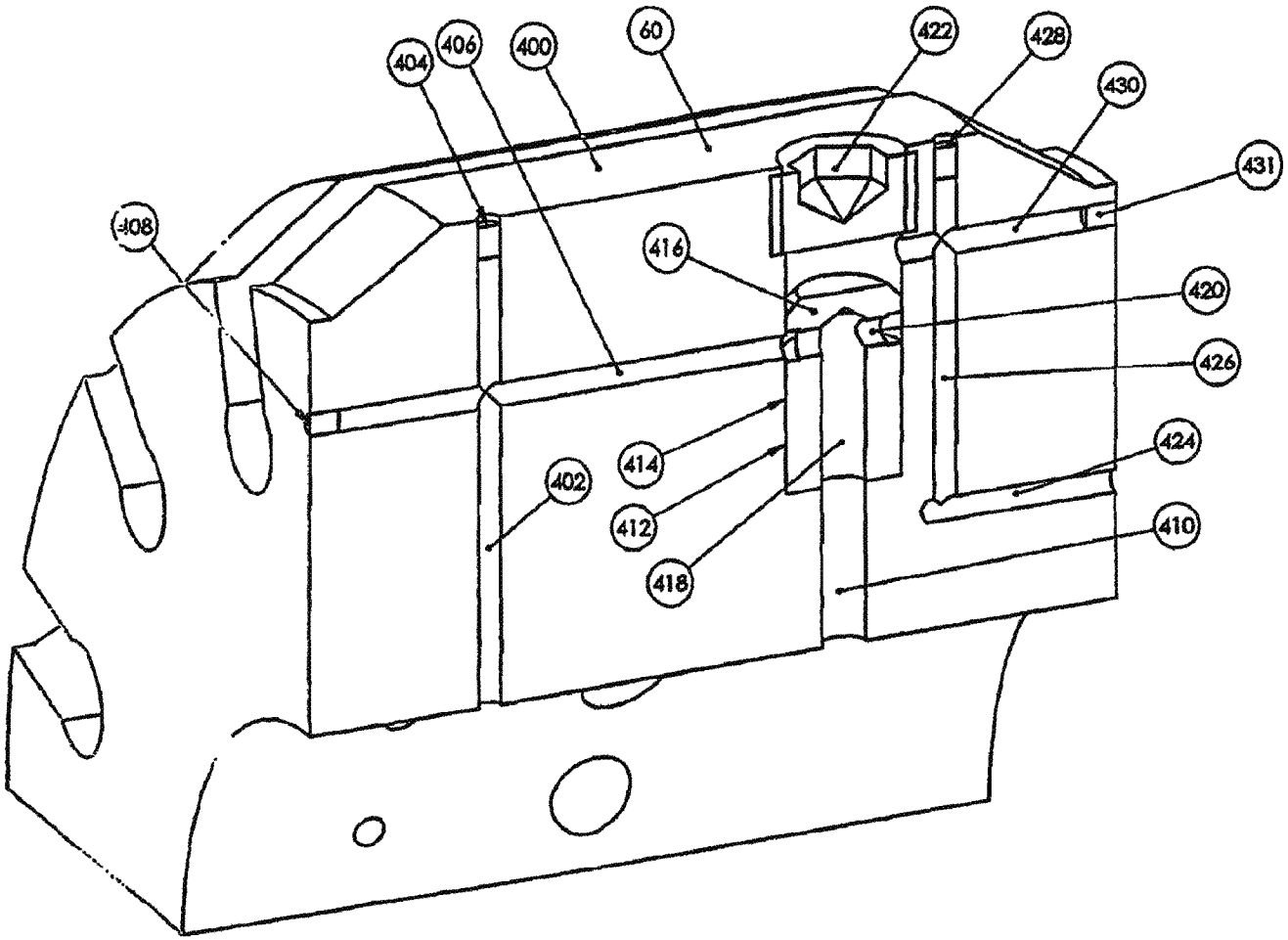
FIG. 33 is a three dimensional view of part of the cross-section shown in FIG. 32.

As best shown in FIG. 33, oil gallery 102 is positioned to receive oil from the undervane pin passages in accordance with description provided hereinabove in this specification.

Figure 32:
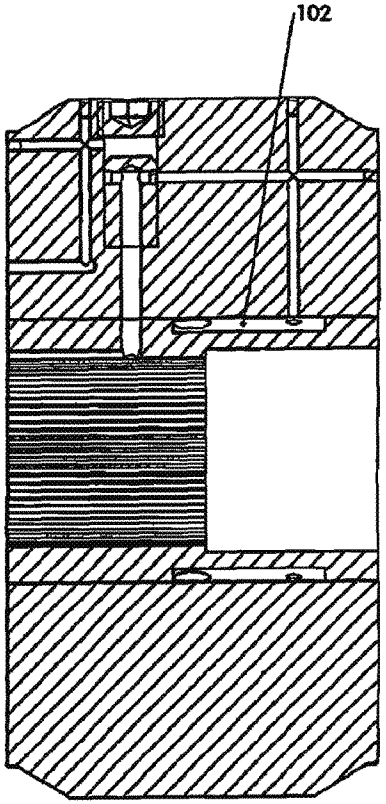
FIG. 32 is a cross-section taken along line D-D of FIG. 31.
Figure 34:
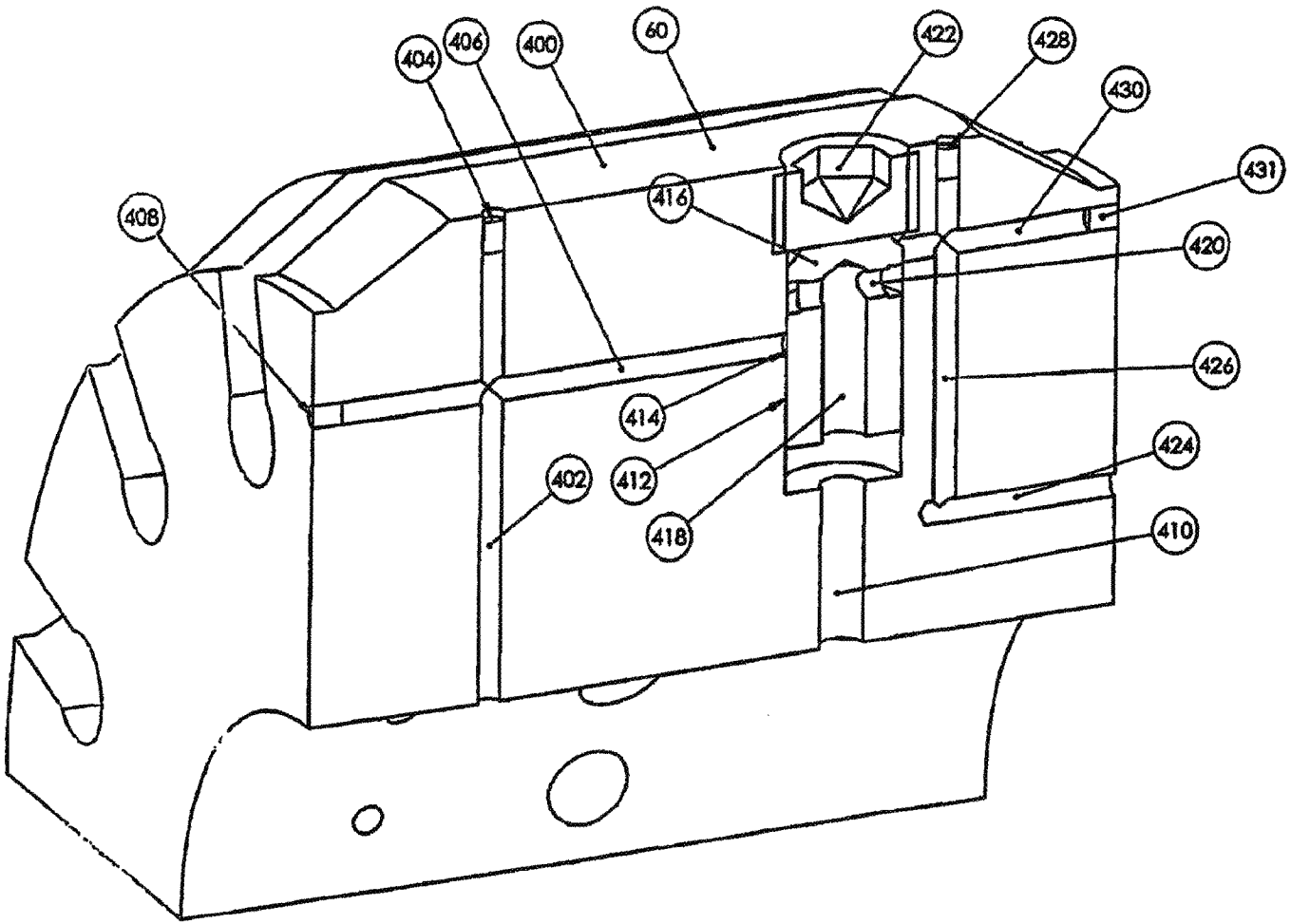
FIG. 34 is an enlarged three dimensional view of the embodiment shown in FIG. 33.

When all of the vanes progressively move to the retracted position and are locked down when the hydraulic machine shown in FIGS. 31 to 34 is operated in a mode where all of the vanes are retracted, pressure will build up in oil gallery 102 as each of the vanes moves to and is retained in the retracted position. If the oil in gallery 102 is not vented from the undervane pin passages sufficiently quickly enough, damage to the vanes, the detent pins and/or the chamber could occur. To this end, the raised land 400 as shown in FIGS. 32 to 34 is provided with a passage 402 that has a plug 404 at its outer end. A further passage 406 having a plug 408 at its outer end is also provided, with passages 402 and 406 being in fluid communication. A further passage 410 is formed in the rotor in the space between the vanes. Passage 410 is in fluid communication with the spline oil gallery, which opens into and drains to a low pressure region of the pump such as the splined section of the drive shaft in most pumps. The spline may have a slot formed therein or have one or more splines removed to enable oil to flow along the splined section of the drive shaft.

Passage 410 includes an enlarged portion 412. In this section a spool valve 414 is provided. Spool valve 414 includes a closed head 416, a passage 418 and another passage 420. Passage 420 is generally in alignment with passage 410. As can be seen from FIG. 33, passages 418 and 420 are in fluid communication with each other.

A spool plug 422 closes the enlarged portion 412 of passage 410.

A further passage 424 is provided, which passage 424 can move into register with a source of pressurised pilot hydraulic fluid. Passage 424 is in fluid communication with passage 426. A plug 428 closes the outer end of passage 426. A further passage 430 extends from passage 426 and opens into the enlarged region 412 of passage 410. Passage 430 is closed by plug 431.

When no pressurised pilot hydraulic fluid is applied to passage 424, the spool valve adopts the position shown in FIG. 34 due to centrifugal or spring force. In this position, passage 406, which is in fluid communication with the undervane oil gallery 102, is closed by the body of spool valve 414. Thus, no fluid can flow from the undervane pin gallery 102 to the spline gallery. Indeed, in normal operation, this is not required because the number of vanes moving into the retracted position is equalled by the number of vanes moving out of the retracted position, thereby maintaining an essentially constant volume of undervane pin passages in contact with the undervane pin oil gallery 102.

However, as the vanes are locked in the retracted position, the number of vanes moving into the retracted position progressively increases until all vanes are in the retracted position. It will be understood that this has the effect of reducing the combined volume of the undervane oil gallery 102 and the undervane passages (by virtue of the vanes moving down to reduce the volume of the undervane passages). Thus, it is necessary to vent some of the oil contained in the undervane passages.

When the vanes are to be moved into the retracted position, pressurised pilot hydraulic fluid is supplied to actuate the retaining means, which may be any of the retaining means described in this specification. At the same time, pressurised hydraulic fluid is supplied to passage 424. Due to the configuration of passages 424, 426 and 430, pressurised pilot hydraulic fluid impinges on the closed head 416 of spool valve 414 and forces the spool valve to move from the position shown in FIG. 34. As a consequence, passage 420 through the spool valve 414 comes into register with passage 406. This also has the effect of opening passage 410 to the flow of hydraulic fluid from the undervane oil gallery 102. Thus, the excess volume of oil in the undervane pin passages can be vented through passages 402, 406, 420, 418 and 410 into the oil gallery of the spline. As mentioned above, the splined section of the drive shaft is in fluid communication with the inlet region of the machine and thus the splined section of the drive shaft is a region of low pressure. If the spool 416 is of constant diameter as shown, the pump can only be put into neutral mode if the pilot pressure exceeds the oil gallery 102 pressure which is usually very near outlet pressure. In certain applications it would be desirable to neutral the pump while it is under load. To that end, the spool 416 may have a T-shaped cross section with the larger diameter pointing radially outward and on which, the pilot pressure acts. If gallery 102 pressure is prevented from acting on the top side (the larger diameter) be some means such as a simple o-ring seal, then the pilot pressure needed to actuate spool 416 could be significantly lower than outlet pressure, dependent on the areas of the spool diameters.

When pressurised pilot hydraulic fluid is removed from passage 424, the spool valve 414 can move from to the position shown in FIG. 34 by centrifugal force. Alternatively, a return spring may be provided.

Figure 35:
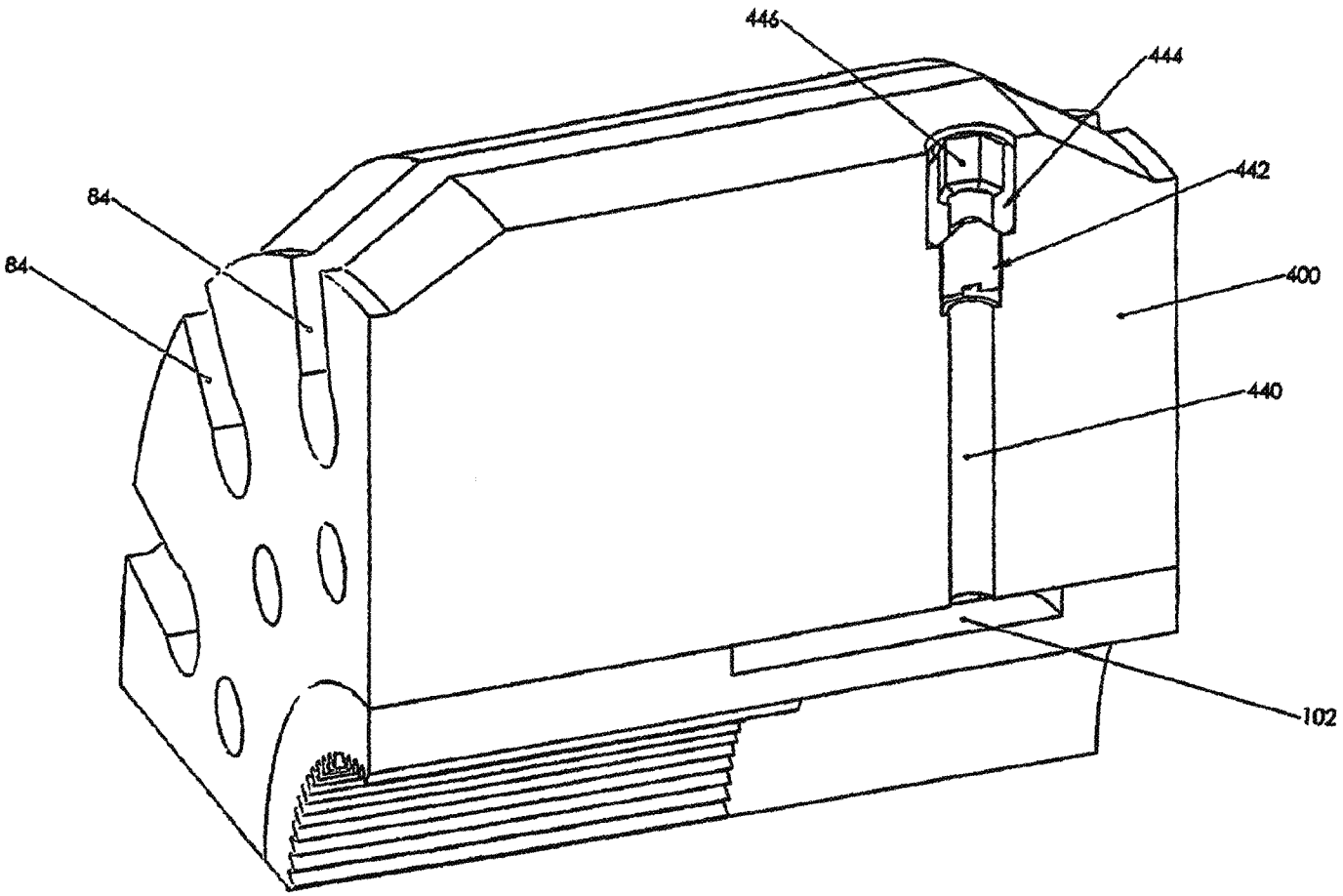
FIG. 35 is a three dimensional cross-sectional view showing part of a rotor for use in accordance with another embodiment of the present invention.

FIG. 35 shows an alternative embodiment that is similar to that shown in FIGS. 23 to 25 but in which the position of the check valve is different. In FIG. 35, a passage 440 is drilled in the raised land 400 of rotor 60 located between adjacent radial slots 84 of the rotor. A check valve 442 is mounted in passage 440 and a check plug 444 is positioned to maintain the check valve 442 in place. Check valve 442 may be any check valve known to the skilled person to be suitable for use in hydraulic vane machines. Check plug 444 has an opening 446 therethrough Check valve 442 allows hydraulic fluid to flow downwardly and into oil gallery 102 (not shown) but it does not allow hydraulic fluid to flow in the reverse direction. Other features of the embodiment of FIG. 35 that are not shown in FIG. 35 may be the same as shown in FIGS. 23 to 25.

Figure 37:
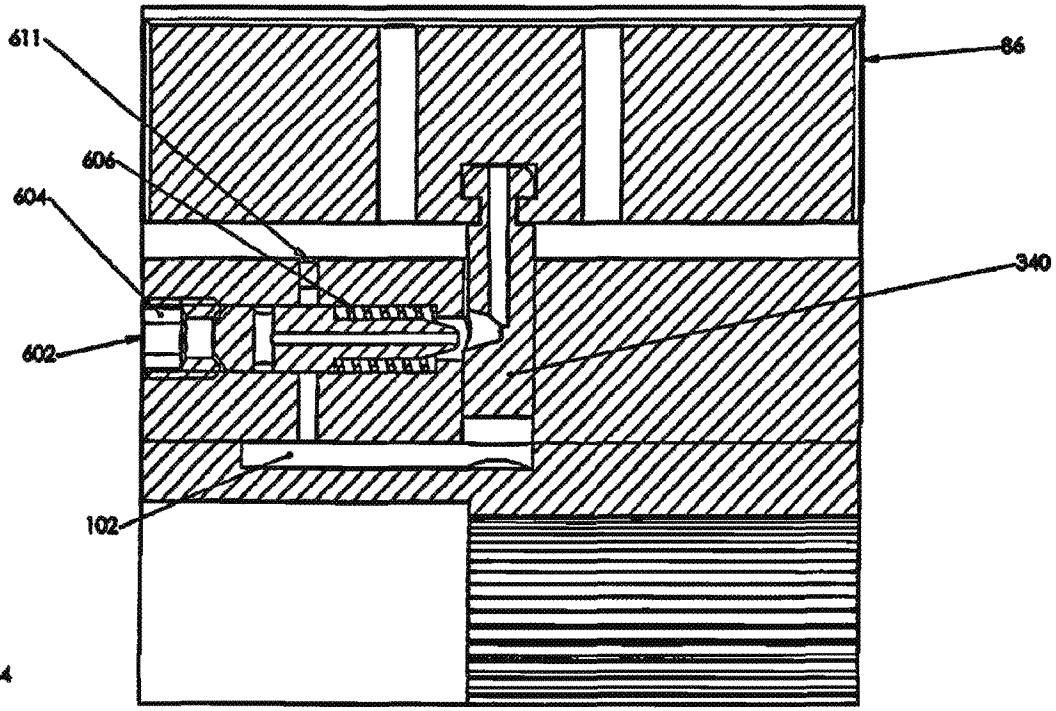
FIG. 37 is an enlarged sectional view taken along line K-K in FIG. 36.
Figure 36:
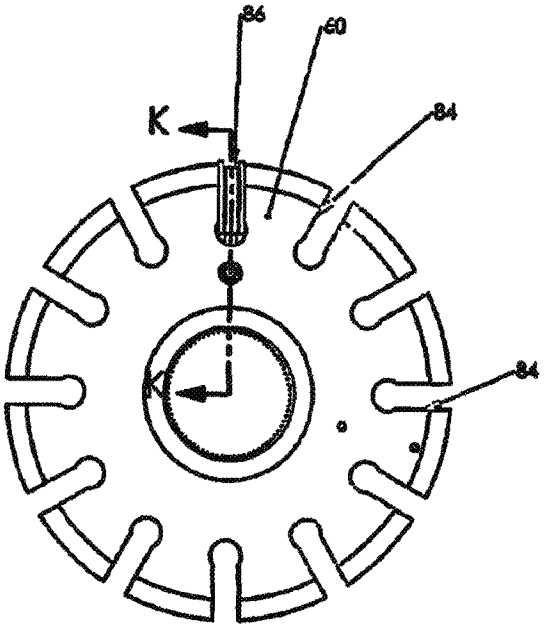
FIG. 36 is a front view of a rotor for use in a further embodiment of the present invention.
Figure 38:
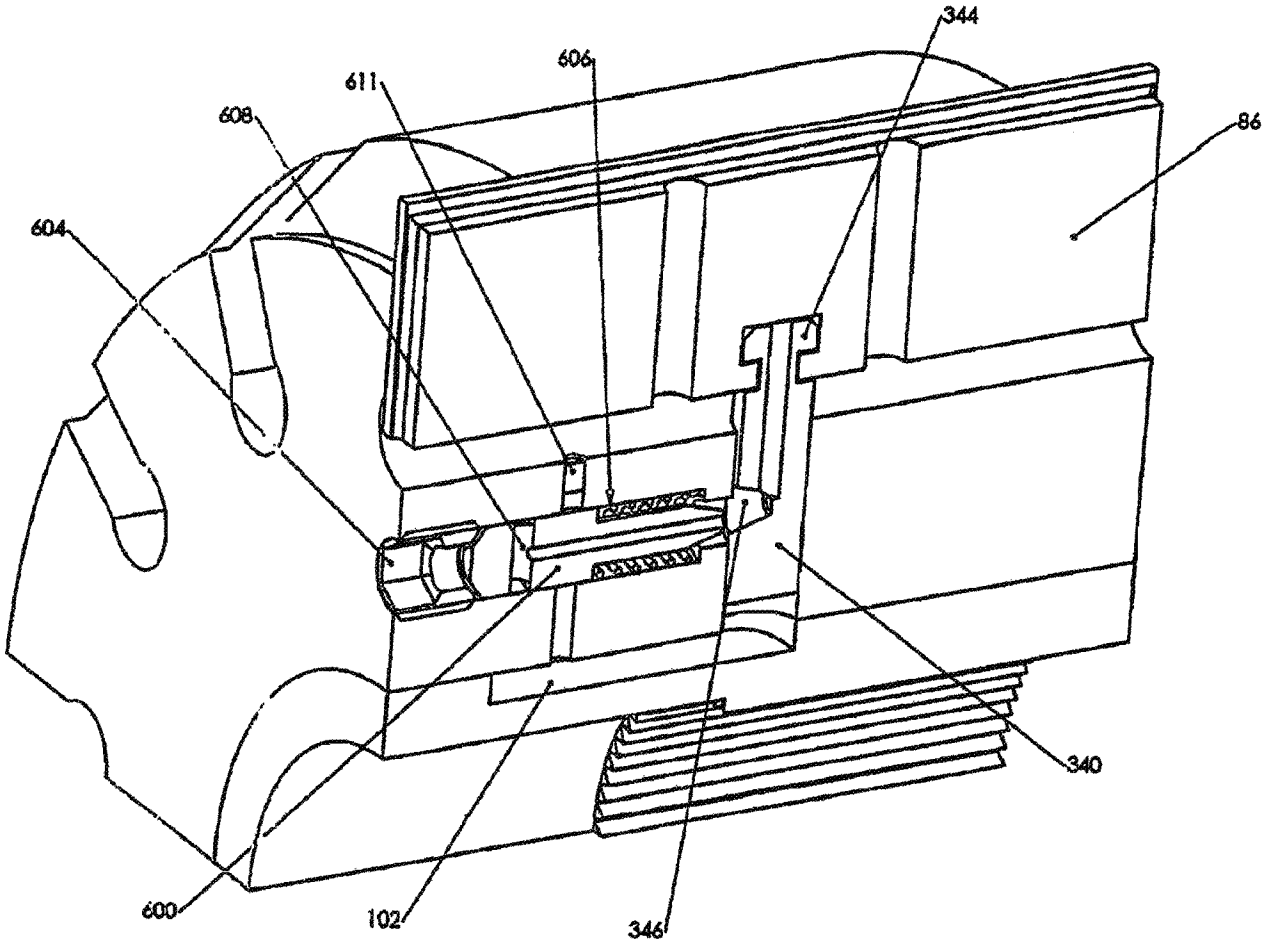
FIG. 38 is a perspective view of FIG. 37.

FIGS. 36-38 show a further alternative embodiment of the present invention. In the apparatus shown in FIGS. 36-38, engagement pin 600 is mounted in passage 602 formed in the rotor 60. Passage 602 has a screw in plug 604 positioned in an end thereof to retain the engagement pin 600 in the passage. A return spring 606 is used to bias the engagement pin 600 away from the undervane pin 340.

Undervane pin 340 includes a tapered recess 346 that is adapted to receive a complementary shaped tapered head on pin 600.

When it is desired to actuate the engagement pin 600 to retain the vanes 86 in the retracted position, pressurised pilot hydraulic fluid is supplied to passage 602, which forces engagement pin 606 to move into tapered recess-346 in undervane pin 340. At the same time, bore 608 in the engagement pin 600 comes into alignment with bore 610 formed in the rotor. Bore 610 has a plug 611 closing its outer end. In this fashion, pressurised fluid in undervane pin gallery 102 can be vented from the undervane pin gallery 102.

Figure 40:
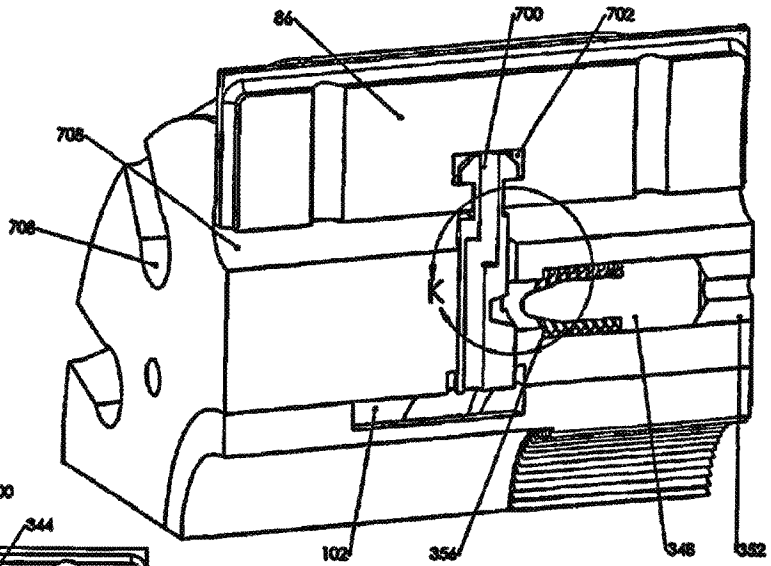
FIG. 40 is a perspective view of the part of the rotor shown in FIG. 39.
Figure 39:
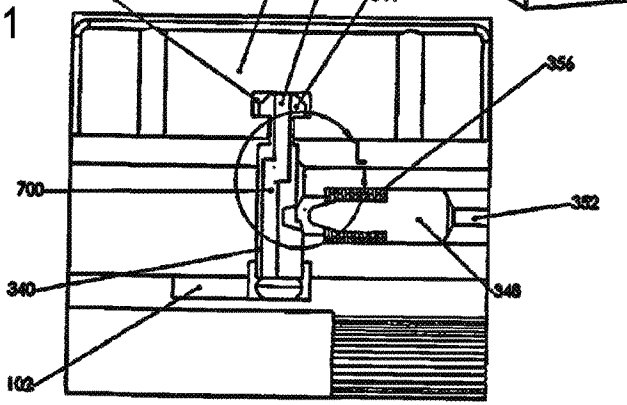
FIG. 39 is a fragmentary side view, in cross section, of a rotor for use in another embodiment of the present invention.
Figure 41:
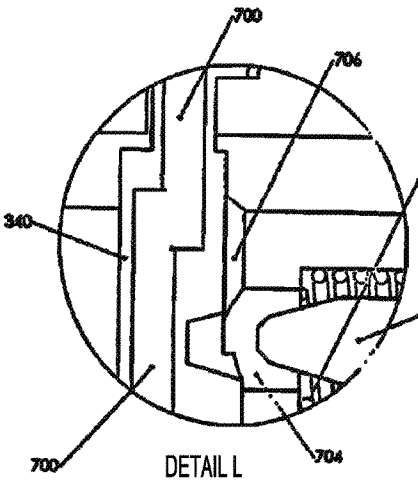
FIG. 41 is an enlargement of detail L shown in FIG. 39.

FIGS. 39 to 41 show a further embodiment in accordance with the present invention. In these figures, vane pin 340 has a T-shaped head 344 that fits into a complementarily-shaped recess 702 in vane 86 to thereby affix the vane 86 to the vane pin 340.

An engagement pin 348 is used to selectively retain the vane 86 in the retracted position. The engagement pin essentially operates along the same principle as the engagement pin of FIGS. 23 to 25. Accordingly, like reference numerals to those used in FIGS. 23 to 25 will be used in FIGS. 39 to 41 in relation to the engagement pin operation and arrangement and further description of these features need not be given.

The embodiment of FIGS. 39 to 41 differs from that of FIGS. 23 to 25 in that passage 358 and ancillary fittings of FIGS. 23 to 25 are not included in the embodiment of FIGS. 39 to 41. Instead, vane pin 340 is provided with a passage 700 extending therethrough. The lower opening of passage 700 opens into under vane pin gallery 102. As vane 86 moves from the extended position to the retracted position, especially when the retaining means are operating to retain all of the vanes in the retracted position (whether all vanes are retracted at once or in sequence), pressurised oil in pin gallery 102 can escape via passage 700. When pressure in slot 708 exceeds the pressure in gallery 102, fluid flow is restricted by means of the head 344 and recess 702 acting as a check valve. Thus, fluid in the gallery 102 cannot be vented via passage 700 when the vane is in the inlet or suction region of the pump. Similarly, pressurised hydraulic fluid can be supplied to the gallery 102 to assist in extending vanes 86. Normal operation of a pump similar to that shown in FIGS. 39 to 41 but without retaining means is well known to the person skilled in the art During extension of engagement pin 348, hydraulic fluid in chamber 704 that surrounds the tapered head of engagement pin 348 will become pressurised and require venting. To this end, a slot 706 is formed, which slot 706 extends from chamber 704 to slot 708 formed in rotor 60. Slot 706 is preferably formed by recessing the side of the vane pin 340. Alternatively, slot 706 may be formed in the side wall of the vane pin duct that houses the vane pin 340.

Figure 42:
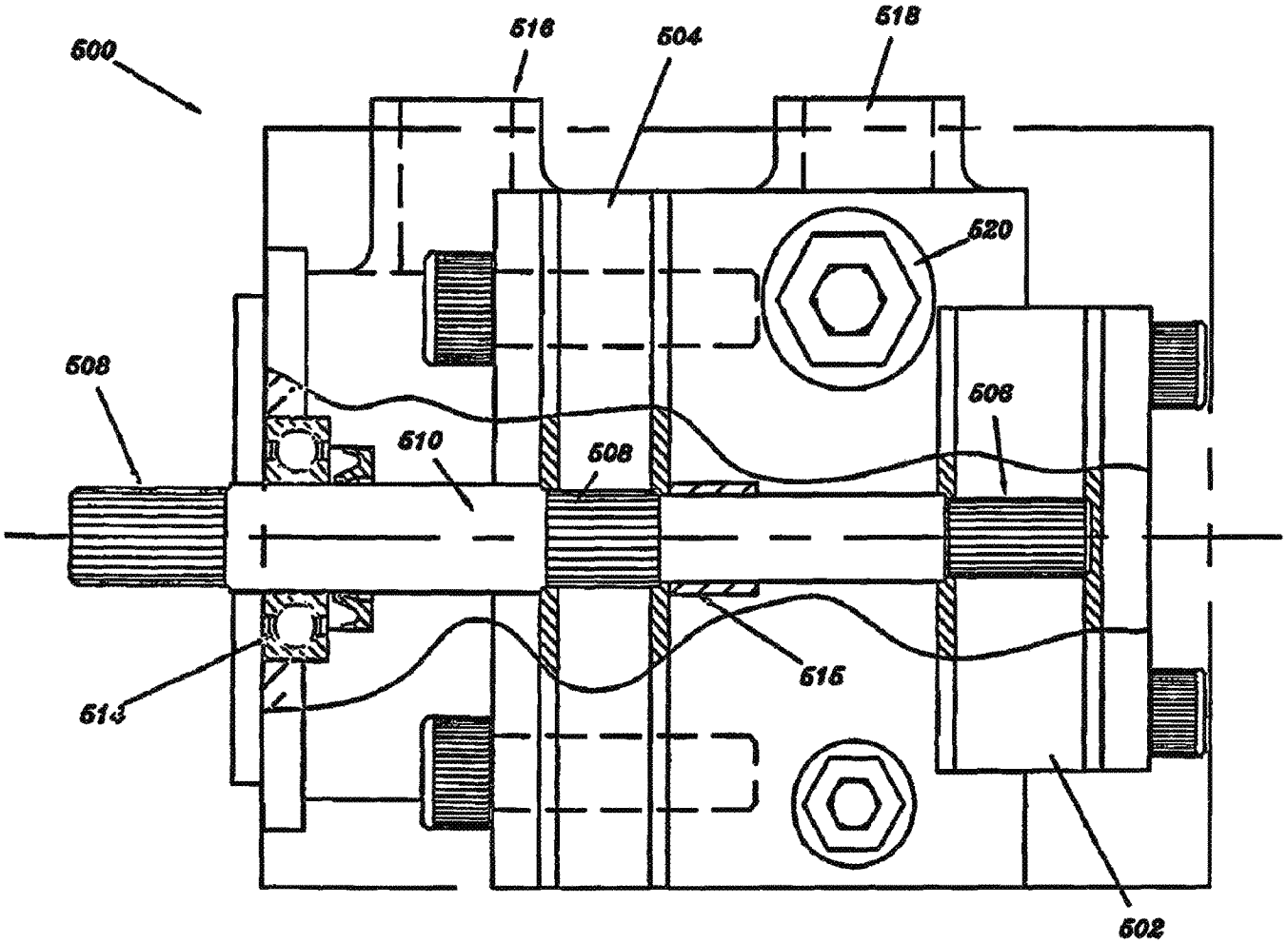
FIG. 42 is a side view, partly in cross-section, of a power steering pump in accordance with another embodiment of the present invention.

FIG. 42 shows a side view schematic diagram of a power steering pump in accordance with the present invention. FIG. 42 is typical of many power steering pumps in that it includes two rotors. In particular, the power steering pump 500 includes a first rotor 502 and a second rotor 504. Rotors 502, 504 are splined via splines 506, 508 to a drive shaft 510. Drive shaft 510 includes a further spline or gear 512 to enable a drive shaft 510 to be driven. The drive shaft 510 is journaled in bearings 514 and 515. The power steering pump 500 includes a first inlet 516 and a second inlet 518. A bypass 520 is provided, which bypass feeds hydraulic fluid back to the inlet.

In the power steering pump 500 shown in FIG. 42, one rotor operates as a conventional rotary vane pump in which the vanes continuously move between the retracted and extended positions. The other rotor is configured in accordance with the present invention and it allows for the possibility of locking down the vanes into the retracted position when either the power steering pump is running at a speed that will deliver more flow than is required to operate the steering of the vehicle or when the vehicle is operating in a mode where it does not require much flow from the pump to operate the steering (e.g. when the vehicle is driving along a straight road). However, when the power steering pump is required to provide extra flow, the vanes on one of the rotors can be released so that they work the hydraulic fluid and provide the extra flow required.

Figure 43:
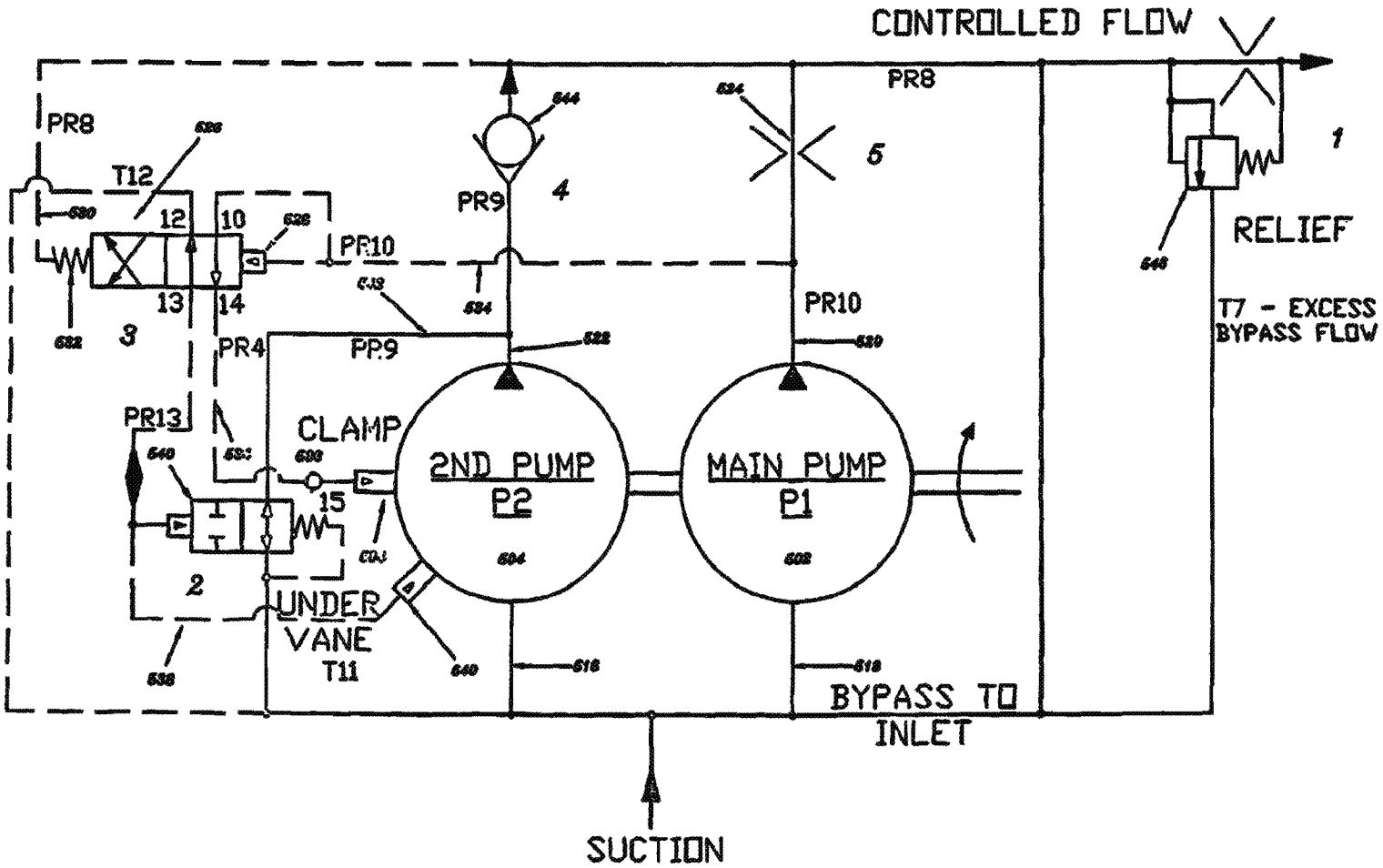
FIG. 43 is a schematic flow diagram showing control of the power steering pump shown in FIG. 39.

FIG. 43 shows a schematic flow and control diagram for controlling operation of the power steering pump 500 shown in FIG. 42. In FIG. 42, the main pump P1, which includes rotor 502, has an inlet 518 and an outlet 520. Second pump P2, which includes rotor 504 has an inlet 516 and an outlet 522.

Outlet line 520 from main pump P1 has a flow orifice 524. As fluid flows along outlet line 520, it passes through flow orifice 524. Flow orifice 524 causes a pressure drop. The pressure in outlet line 520 measured before the orifice is designated by pressure PR10. The pressure in the outlet line after the flow orifice is designated by pressure PR8.

The control system for controlling the operation of the second pump P2 includes a spool valve 526. One end 528 of the spool valve detects pressure PR10. The other end 530 of spool valve 526 detects pressure PR8. Additionally, end 530 of spool valve 526 has a spring 532 mounted thereto. Spring 532 has a weight or strength that sets the pressure drop where the second pump cuts in.

In operation, as the flow through outlet 520 from the main pump P1 increases, for example by virtue of increasing engine revolutions of the motor vehicle, the pressure drop across restriction orifice 524 increases. When the pressure drop across orifice 524 increases to a level where pressure PR10 is greater than the combined pressure PR8 plus the force of spring 532, pressure PR10 in line 534 moves the spool valve 526 to the left against the biasing force of the spring 532. This then results in pressurised pilot hydraulic fluid being provided to the pressurised pilot hydraulic fluid gallery 534 of the second pump P2. This actuates the vane retaining means and the vanes on pump P2 become locked down in the retracted position. A non-return valve 536 is provided in the relevant fluid line.

If the flow through outlet 520 drops to a level where the pressure PR10 is less than the total of pressure PR8 plus the biasing force of spring 532 the spool valve 526 moves to the right. In this position, the pressurised pilot hydraulic fluid is no longer supplied to gallery 534 and the retraction means are thereby released. At the same time, pilot fluid travels via line 538 to the undervane passages 540. This assists or facilitates movement of the vanes from the retracted position to the extended position as the vanes move into rise regions inside the pump.

The flow circuit shown in FIG. 43 also includes a phasing valve 540. This valve operates such that as second pump commences pumping operation (by virtue of the vanes moving to the extended position from the locked retracted position), a portion of the outlet fluid from second pump is diverted via line 542 back to inlet 516. This assists in providing a softer start up that imposes less shock on the components.

The flow circuit shown in FIG. 43 also includes a non-return valve 544 in the outlet line 522 from the second pump P2 and a flow cover or relief 546 that allows for bypass of excess flow from the pump.

The flow and control circuit shown in FIG. 43 allows for automatic control and operation of the power steering pump shown in FIG. 42.

Figure 44:
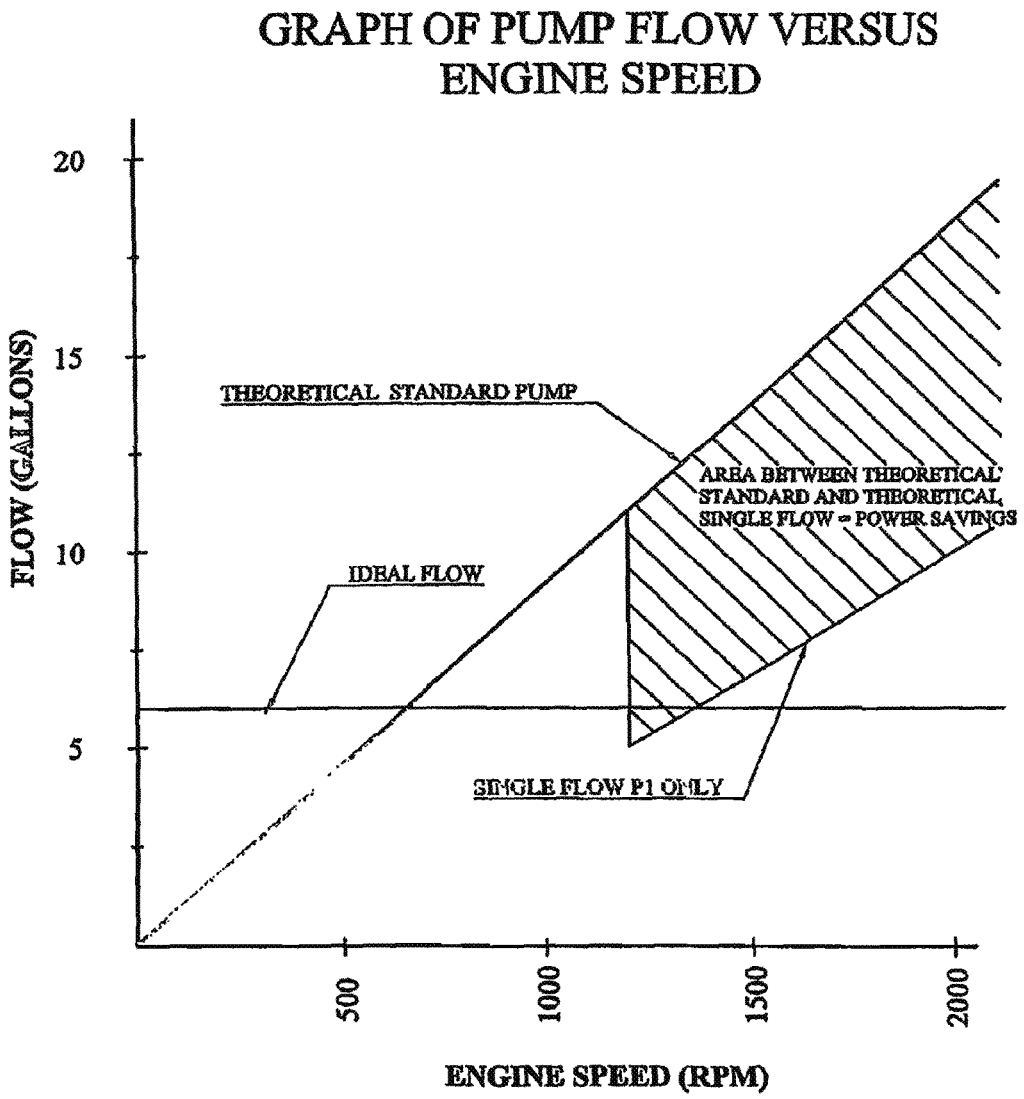
FIG. 44 is a plot of pump flow against engine speed for the power steering pump shown in FIG. 36.

In order to demonstrate the benefits of the power steering pump shown in FIGS. 42 and 43 a modelling study was conducted which shows a graph of flow from the power steering pump plotted against engine speed. As can be seen from FIG. 44, the flow from the theoretical standard pump increases with increasing engine speed. This theoretical pump comprises an 11 gallon pump having two rotors. The ideal flow line of FIG. 44 represents the minimum flow required to satisfactorily operate the steering of the vehicle. It can be seen, the theoretical standard pump provides flow in excess of the ideal flow from above or approximately 600 rpm engine speed.

In comparison, the power steering pump in accordance with the present invention can be operated such that the second pump P2 can effectively be switched off by retaining the vanes in the retracted position once engine speed gets above approximately 1200 rpm. The flow arising from this operation is shown in FIG. 44 as single flow P1 only. The area between that line and the theoretical standard pump represents the power savings provided by the power steering pump in accordance with the present invention. Table 1 demonstrates the calculations conducted with respect to the power steering pump in accordance with the present invention. The following assumptions were made when calculating the savings figures:

power steering pump is running 1:1 relative to engine speed;

engine consumes 0.35 gallons per horse power hour;

6.6 lbs in 1 US gallon;

the pump will be running an average efficiency of 75% rotors are 6 gallon primary ring and 5 gallon secondary ring pressures and engine speed data referenced from Mack Truck consultant;

standard power steering pump (comparator) will pump 11 GPM at 1200 rpm running an average efficiency of 75%.

Results and Comparison

Shown in Table 1, the power steering pump in accordance with the present invention will provide an average saving of 2.2 horsepower (typical highway truck). This power saving will equate to approximately 120 US gallons per 1000 hours of operation for each truck it is fitted to. This is under the assumption that the pump in accordance with the present invention will be replacing a positive displacement pump running 11 GPM at 1200 rpm.

Case Study (National per 4000 Hours)

7 million trucks running in North America, each truck running approximately 4000 hours per year (average). If the pump power steering pump in accordance with the present invention is fitted to only 25% of these trucks, the annual fuel saving would be 840 million gallons of fuel per annum.

Case Study (per Vehicle per 4000 Hours)

USA based on the fuel saving figures will be $480.

Australia based on the fuel saving figures will be $1080.

Europe based on the fuel saving figures will be $2000.

Figure 45:
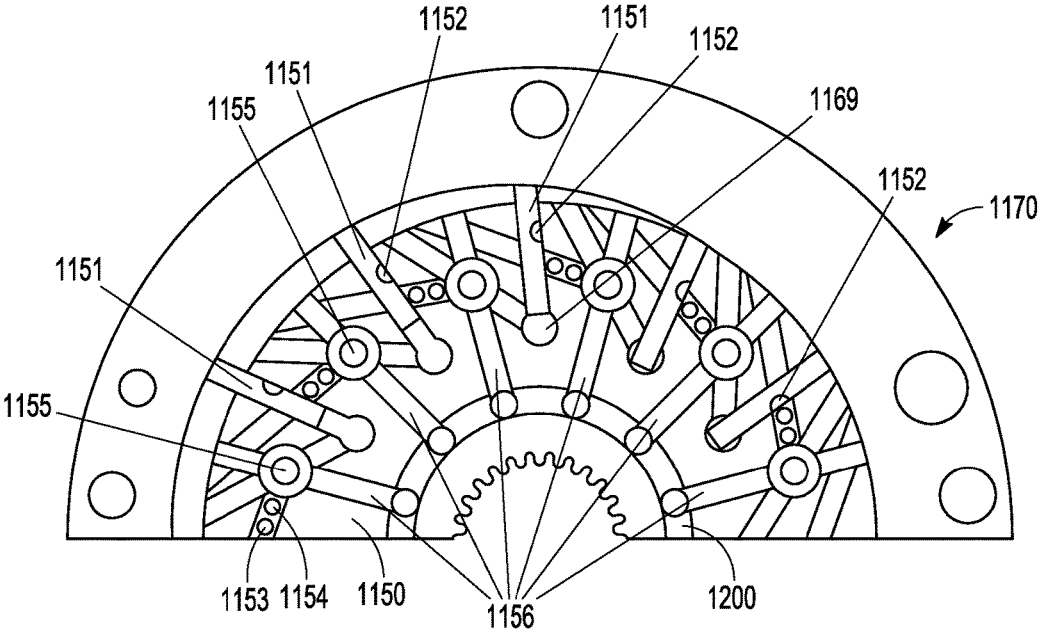
FIG. 45 is a schematic diagram of part of a hydraulic vane pump in accordance with an embodiment of the third aspect of the present invention.
Figure 46:
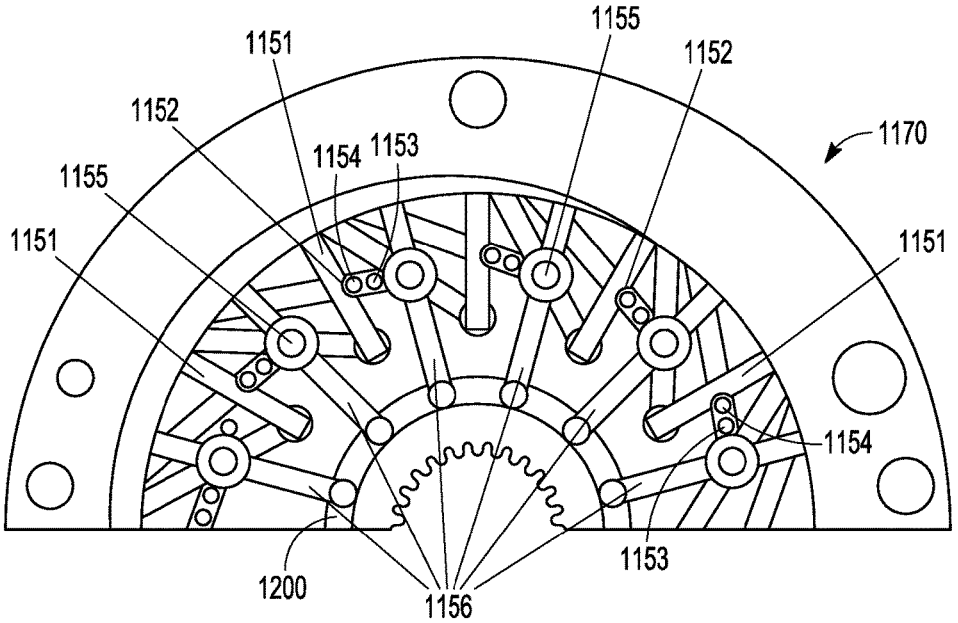
FIG. 46 shows the hydraulic vane pump of FIG. 45 but with vanes of the clamp being in a retracted and clamped mode.

FIGS. 45 and 46 show a view of a hydraulic vane pump 1170 in accordance with an embodiment of the third aspect of the present invention. In FIGS. 45 and 46 the rotor 1150 is shown as though it was transparent in order to disclose the various galleries of the rotor 1150. In FIG. 45, the pump 1170 is operating in the unclamped mode in which the vanes 1151 are free to extend and retract as the rotor 1150 rotates within the housing. An under vane passage 1169 extends beneath each vane 1151.

Each of the vanes 1151 includes a cavity or hole 1152 formed in a side wall thereof. Each clamping mechanism comprises two small balls 1153, 1154 that are in engagement with a spool 1155. Spool 1155 will be described in greater detail with reference to FIG. 47. Spool 1155 is in fluid communication via appropriate galleries with pressurised oil. These galleries are shown at 1156.

Figure 47:
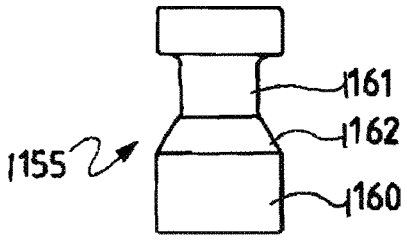
FIG. 47 shows a detent spool suitable for use in the hydraulic pump shown in FIGS. 45 and 46.

As seen in FIG. 47, the spool 1155 includes a region 1160 of relatively large diameter, a region 1161 of relatively smaller diameter and a frusto-conical region 1162 therebetween. Frusto-conical region 1162 provides a ramped region. Each spool 1155 is mounted in an appropriate gallery in the rotor 1150 together with a spring (not shown).

When the pump 1170 is operating normally and the vanes 1151 are unclamped (or not retained), the spools 1155 are retracted, meaning that there is no force applied to the balls 1153, 1154. In the retracted position, ball 1153 rests within the spool region 1161 of smaller diameter. This provides sufficient clearance such that ball 1154 is not pushed into contact with the side of the vanes 1151 by way of intermediate ball 1153.

When the pump is clamped (i.e. when the vanes are retained in the retracted position), as shown in FIG. 46, a positive pressure signal comes from the pressure plate through annular passage 1200 and via galleries 1156. This acts on the spools 1155 and causes the spool 1155 to move (in a generally longitudinal direction) and compress the spring such that the region 1160 of relatively large diameter comes into contact with ball 1154. This pushes the balls 1153, 1154 towards the vanes 1151 such that one of the balls 1154 moves into the hole or cavity 1152 formed in the side of the vane 1151 to thereby retain the vane 1151 in the retracted position (see FIG. 46). In the absence of a positive pressure signal, the spring moves the spool region 1161 of relatively smaller diameter back into engagement with the ball 1154.

Figure 48:
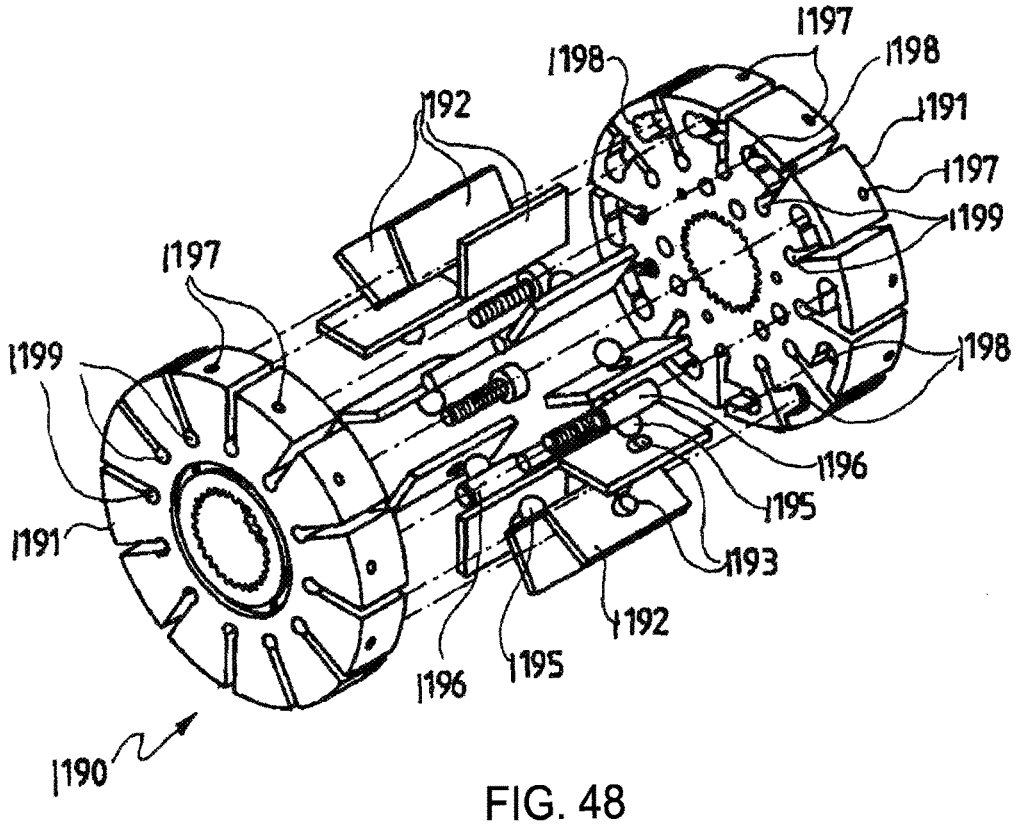
FIG. 48 is an exploded view of part of a hydraulic vane pump in accordance with another embodiment of the present invention.
Figure 51:
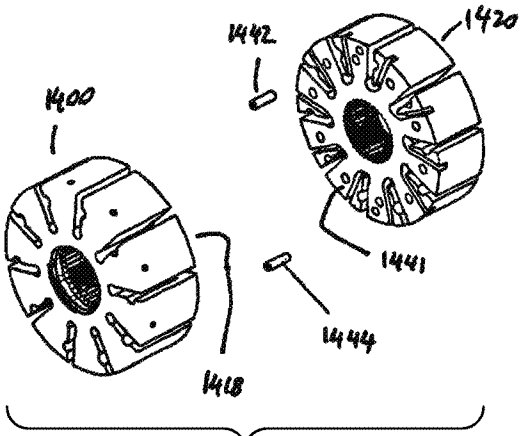
FIGS. 49 to 53 illustrate an embodiment of the present invention in which the rotor is made from two parts.

FIG. 48 shows a view of a hydraulic vane pump 1190 in accordance with another embodiment of the third aspect of the present invention. The pump 1190 is essentially the same as pump 1170 in that it has a rotor 1191, vanes 1192 having cavities 1193 in the side walls thereof, and a clamping mechanism comprising a spool 1196, one ball 1195 (instead of two) and a spring.

Spool 1196 has substantially the same shape as spool 1155. Spool 1196 is in fluid communication with pressurised oil via galleries 1197. Each spool 1196 is slidably mounted in a gallery 1198 in the rotor 1191 together with a spring. An under vane passage extends beneath each vane 1192.

When the pump 1190 is operating normally and the vanes 1192 are unclamped, the spools 1196 are retracted, meaning that there is no force applied to the balls 1195. In the retracted position, ball 1195 rests within the spool 1196 region of smaller diameter. When the pump 1190 is clamped, a positive pressure signal comes from the pressure plate via galleries 1197. This acts on the spools 1196 and causes the spool 1196 to compress the spring and to laterally force the ball 1195 into the cavity 1193 formed in the side of the vane 1192, to thereby retain the vane 1192 in the retracted position. In the absence of a positive pressure signal, the spring moves the spool 1196 region of relatively smaller diameter back into engagement with the ball 1195.

Figure 49:
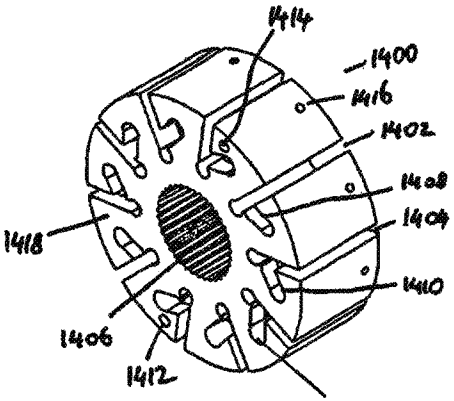

FIGS. 49 to 53 show an embodiment of the present invention in which the rotor is made from two parts. FIG. 49 shows a first rotor part 1400. First rotor part 1400 includes a plurality of vane slots, some of which are numbered at 1402, 1404. The vane slots carry the vanes in the completed rotor. As can be seen from FIG. 49, first rotor part 1400 includes 10 vane slots. The vane slots may be formed in the first rotor part by machining the slots or by casting the first rotor part to include slots.

The first rotor part 1400 also includes a central opening 1406 that is splined and which receives a splined shaft (not shown) in the completed hydraulic machine.

Figure 50:
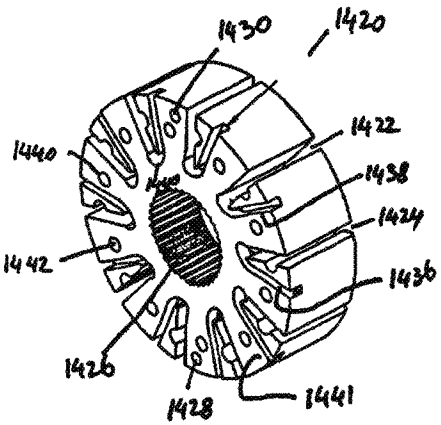

First rotor part 1400 includes a plurality of vane retaining means movement passages. In particular, the vane retaining means movement passages comprise spool movement passages 1408, 1410 (the other spool movement passages are not numbered for the sake of clarity). First rotor part 1400 also includes dowel holes 1412 and 1414. The first rotor part 1400 also includes a plurality of oil galleries, some of which are numbered at 1416. Oil galleries 1416 receive pressurised oil and provide pressurised oil to the spools to selectively actuate the spools. Galleries 1416 may be formed by cross drilling to the centre of the spline cavity 1406. The outermost portion of gallery 1416 is then plugged. Pressurised oil can be provided through the shaft extending through the spline cavity, into the spline chamber 1406 and then into gallery 1416 to thereby supply pressurised oil to the spool cavity 1410 to move the spool. FIG. 50 shows a second rotor part 1420. Second rotor part 1420 includes a plurality of vane slots, some of which are numbered at 1422, 1424. The vane slots on second rotor part 1420 are formed so that they are in alignment with the vane slots in first rotor part 1400. The second rotor part 1420 also includes a central opening 1426. Central opening 1426 is splined and receives a splined shaft in the completed hydraulic machine.

Second rotor part 1420 also includes dowel holes 1428, 1430. These are dowel holes are formed such that they can be placed in alignment with dowel holes 1412, 1414 in the first rotor part 1400.

The second rotor part 1420 includes oil galleries 1436, 1438 that provide fluid communication from the undervane passages 1440 to the external periphery of the rotor part 1420. In this manner, the undervane passages have equal pressure to the region of the pump through which the vane is travelling.

Figure 53:
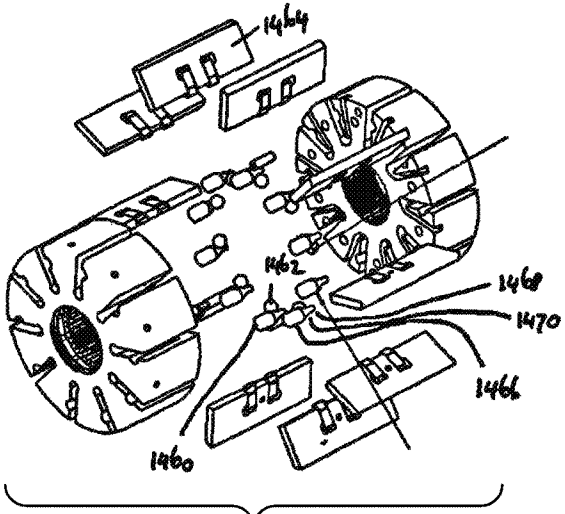
Figure 52:
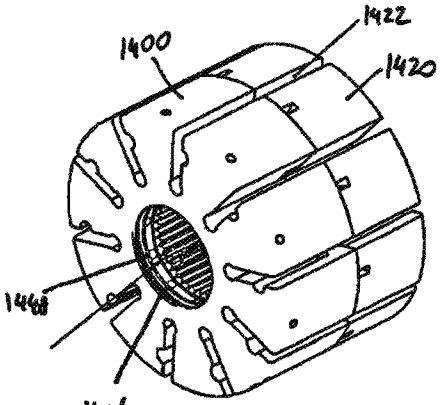

As can also be seen from FIG. 50, the second rotor part 1420 also includes spool passages 1440, 1442. Spool passages 1440, 1442 are positioned and shaped to receive at least part of the spool during movement of the spool in a direction towards the second rotor part. It will be appreciated that the spools form part of the vane retaining means for this rotor. Once the first rotor part and the second rotor part, as shown in FIGS. 49 and 50 respectively, have been formed, typically by machining, the first rotor part 1400 is oriented so that interface 1418 of first rotor part faces interface 1441 on second rotor part 1420 (see FIG. 51). Dowels 1442 and 1444 are positioned in respective dowel holes 1414, 1430 and 1412, 1428, respectively and this acts to hold of the rotor parts in the orientation as shown in FIG. 53. Also shown more clearly in FIG. 52 are oil galleries 1446, 1448 that comprise the inner ends of oil galleries 1416 shown in FIG. 49. Final machining and grinding of the rotor can take place with the rotor being dowelled together.

In order to assemble the final rotor, spools 1460 and balls 1462 (see zure 54) are positioned in the vane retaining means movement passages and the vanes are positioned in the vane slots. The rotor parts are dowelled together and spot welds are applied on the interface of the two rotor parts to thereby form the completed rotor.

As can be seen from FIG. 53, the spools 1460 include a region of large diameter 1466, an end region of small diameter 1468 and a ramped region 1470 therebetween. The region of large diameter 1466 at one end of the spool 1460 is positioned in the passage 1408 formed in the first rotor part and the region of small diameter 1468 at the other end of the spool 1460 is positioned in or can move into the passages 1440, 1442 that are formed in the other rotor part.

By forming the rotor from two rotor parts, it is possible to minimise the amount of machining required to form the rotor. This assist in ensuring that the rotor is as strong as it can possibly be, it being appreciated that excess machining of the rotor will remove metal from the rotor and thereby weaken the rotor. Further, the amount of plugging of drill holes used to form the oil galleries is minimised, thereby enhancing the speed of manufacture. By forming the rotor from two rotor parts, a rotor of small dimension that carries a large number of vanes, such as from 10 to 12 vanes, can be formed. These rotors are robust. Furthermore, it will be understood that when the spools move in a generally longitudinal direction, this causes the balls to move in a direction that is generally lateral to the spools. Accordingly, the vane retaining means is of compact dimension.

Other advantages arising from the method of making the motor include:

a) In some embodiments, the pin required to engage the ball bearing in the dimple in the vane to retain the vane must be positioned within a tolerance of nominally 0.005 inches relative to the vane slot and ball bearing slot. This could only be achieved by working on the face of the rotor with the rotor in two parts and doweled for location on reassembly. The extreme accuracy demanded is not achievable any other way and in fact this complex machining is most likely simply not possible even with Jigs and fixtures, except on modern CNC machinery.

b) Upon assembly of the rotor, the vanes have to slide in and out of the slots but not allow oil at high pressure to by-pass the vanes. In some embodiments, the vanes and slots are held to an accuracy of 0.0005 inches, again demonstrating the complex process required.

c) Rotors as small as those with widths down to 0.875 inches and 2¼ diameter with 10 vanes can be produced.

d) Oil under high pressure must be prevented from leaking via the multiple galleries.

e) Vane systems used in gas pumping (such as in air compressors) use much larger rotors.

Importantly the tolerances in such systems with a small number of vanes (such as 3 or 4 vanes) are much greater and relatively large ball bearings for detent and retaining of the vanes can be loosely positioned in slots in vane systems that pump or compress gases. The outlet pressures of hydraulic pumps tend to be 25 to 40 times higher than the outlet pressures of gas pumping systems.

The present invention provides a hydraulic machine that can be operated in an economical mode in situations where conventional hydraulic machines would be consuming unnecessary power. The hydraulic machine of the present invention can be manufactured using existing manufacturing facilities. The hydraulic machine of the present invention allows for selectively retaining the vanes in the retracted position. The retaining means most suitably interact with the vanes when the vanes are in the retracted position to maintain the vanes in the retracted position. The retaining means are capable of retaining the vanes in the retracted position even as the vanes pass through the rise regions, the major dwell regions and the fall regions. Most suitably, the retaining means interact with the vanes as hydraulic fluid passages that operate the retaining means associated with each vane each come into fluid communication with a source of pressurised hydraulic fluid. The retaining means may be selectively actuable by an operator of the hydraulic machine or by an automatic control means that responds to situations where low flow or low power is required. Preferred embodiments of the machine also allow for positive driving of the vanes from the retracted position to the extended position in the dwell regions by virtue of applying pressurised hydraulic fluid to the undervane passages.

For start-up, known hydraulic vane motors typically require an external force to extend the vanes. Springs are normally used for initial start-up and then system pressure is directed under the vanes to maintain pressure equilibrium. In the present invention, however, the remote pilot fluid extends the vanes and eliminates the need for springs.

In this way, the hydraulic machine of the present invention may be operated such that hydraulic fluid is not pumped excessively or unnecessarily, in the absence of expensive space invasive clutches or other disconnecting means.

The hydraulic pump or motor is suitable for use in, for example, earth moving, industrial and agricultural machines, waste collection vehicles, fishing trawlers, cranes, and vehicle power steering systems, as well as in air compressors and air-conditioners.

Those skilled in the art will appreciate that the present invention may be susceptible to variations and modifications other than those specifically described. It is to be understood that the invention encompasses all variations and modifications that fall within its spirit and scope.

What is claimed is:

1. A hydraulic assembly, comprising:

a first hydraulic pump;

a second hydraulic pump coupled together with the first hydraulic pump, the second hydraulic pump including: a body having a chamber;

a rotor mounted within the chamber, the chamber and the rotor being shaped to define one or more rise regions, fall regions, and dwell regions between the walls of the chamber and the rotor, the rotor including;

a plurality of slideable vanes, a plurality of slots within the rotor, each configured to accept a corresponding one of the plurality of slidable vanes, wherein each slot in the plurality of slots includes a selectable vane retainer movable between a first position to lock a vane in a retracted vane position, and a second position to allow the vane to move freely within the slot;

wherein each slot in the plurality of slots includes an under vane passage in fluid communication with pressurized fluid, such that when the selectable vane retainer is in the second position, the vane is driven to an extended position by the pressurized fluid, and a control system for controlling operating of the second hydraulic pump, the control system including a spool valve having a first end portion configured to detect a first pressure in an outlet line from the first hydraulic pump prior to a flow orifice, the spool valve including a second end portion configured to detect a second pressure in the outlet line from the first hydraulic pump after the flow orifice.

2. The hydraulic assembly of claim 1, further including an engine driving the first hydraulic pump and the second hydraulic pump, wherein at high engine speeds, the second hydraulic pump is configured to run with vanes in the retracted position.

3. The hydraulic assembly of claim 1, further comprising a spring mounted to the second end portion of the spool valve.

4. The hydraulic assembly of claim 3, wherein the spring has one of a weight or strength that sets the pressure drop where the second pump cuts in.

5. The hydraulic assembly of claim 4, wherein the spool valve is configured for movement to overcome a biasing force of the spring when the first pressure exceeds the second pressure and a force of the spring on the second end portion of the spool valve.

6. The hydraulic assembly of claim 5, wherein movement of the spool valve to a first position allows the pressurized fluid to flow to the second hydraulic pump.

7. The hydraulic assembly of claim 6, wherein the flow of the pressurized fluid causes each of the selectable vane retainers to become locked down to a corresponding one of the plurality of vanes with the plurality of vanes in the retracted vane position.

8. The hydraulic assembly of claim 5, wherein movement of the spool valve to a second position stops the flow of the pressurized fluid to the second hydraulic pump.

9. The hydraulic assembly of claim 8, wherein a lack of supply of the pressurized fluid to the second hydraulic pump causes each of the selectable vane retainers to be released from a corresponding one of the plurality of vanes allowing the plurality of vanes to move to the vane extended position.

10. The hydraulic assembly of claim 9, further comprising a pilot fluid line coupled to the second hydraulic pump, whereby a pilot fluid travels via the pilot fluid line to one or more undervane passages in the second hydraulic pump, the pilot fluid facilitates movement of the plurality of vanes to the vane extended position.

11. The hydraulic assembly of claim 1, wherein the control system includes a phasing valve that is configured to operate such that as the second hydraulic pump commences a pumping operation. a portion of an outlet fluid from the second hydraulic pump is diverted back to an inlet of the second hydraulic pump.

12. The hydraulic assembly of claim 1, wherein the first hydraulic pump and the second hydraulic pump is a power steering pump, wherein the rotor of the second hydraulic pump is a second rotor and the first hydraulic pump comprises a first rotor, and wherein the first rotor is coupled to the second rotor via a drive shaft.

13. The hydraulic assembly of claim 12, wherein the first rotor includes a plurality of vanes that continuously move between a vane retracted position and a vane extended position.

14. The hydraulic assembly of claim 1, wherein the control system includes a non-return valve in the outlet line and a flow relief that allows for bypass of excess flow from the second hydraulic pump.

15. A hydraulic system, comprising:

a first hydraulic pump including a first rotor having a plurality of vanes that continuously move between a vane retracted position and a vane extended position;

a second hydraulic pump coupled together with the first hydraulic pump, the second hydraulic pump including a second rotor with a plurality of vanes, the plurality of vanes are configured to be selectively locked in a vane retracted position within the second rotor of the second hydraulic pump and are selectively releasable to move to a vane extended position to work the pressurized fluid: and a control system for controlling operating of the second hydraulic pump, the control system including a spool valve having a first end portion configured to detect a first pressure in an outlet line from the first hydraulic pump prior to a flow orifice, the spool valve including a second end portion configured to detect a second pressure in the outlet line from the first hydraulic pump after the flow orifice.

16. The hydraulic system of claim 15, wherein movement of the spool valve to a first position allows the pressurized fluid to flow to the second hydraulic pump.

17. The hydraulic system of claim 16, wherein the flow of the pressurized fluid causes each of a plurality of selectable vane retainers to become locked down to a corresponding one of the plurality of vanes of the second hydraulic pump with the plurality of vanes in the retracted vane position.

18. The hydraulic system of claim 16, wherein movement of the spool valve to a second position stops the flow of the pressurized fluid to the second hydraulic pump.

19. The hydraulic system of claim 18, wherein a lack of supply of the pressurized fluid to the second hydraulic pump causes each of a plurality of selectable vane retainers to be released from a corresponding one of the plurality of vanes allowing the plurality of vanes of the second hydraulic pump to move to the vane extended position.

* * * * *